US010568372B2

(12) United States Patent
Pandolfino

(10) Patent No.: US 10,568,372 B2
(45) **Date of Patent: *Feb. 25, 2020**

(54) NECKWEAR FOR DISPLAYING COINS, MEDALS OR BARS WITH DISPLAY INSERTS

(71) Applicant: PATUGA LLC, Clarence, NY (US)

(72) Inventor: Joseph Pandolfino, Clarence, NY (US)

(73) Assignee: PATUGA LLC, Clarence, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/171,592

(22) Filed: Oct. 26, 2018

(65) Prior Publication Data

US 2019/0059481 A1 Feb. 28, 2019

Related U.S. Application Data

(63) Continuation of application No. 15/647,902, filed on Jul. 12, 2017, now Pat. No. 10,172,400, which is a (Continued)

(51) Int. Cl.
*A41D 25/00* (2006.01)
*A44C 21/00* (2006.01)
(Continued)

(52) U.S. Cl.
CPC ..... *A41D 25/005* (2013.01); *A41D 15/002* (2013.01); *A41D 25/003* (2013.01);
(Continued)

(58) Field of Classification Search
CPC ..... A41D 25/003; A41D 25/005; A41D 27/08
See application file for complete search history.

(56) References Cited

U.S. PATENT DOCUMENTS 1,847,898 A * 3/1932 Prestinari ..... B43K 23/001 24/10 R
1,979,894 A * 11/1934 Lyons ..... E05D 3/02 16/263

(Continued)

FOREIGN PATENT DOCUMENTS

AT 389630 B 1/1990
CN 2888922 Y 4/2007

(Continued)

OTHER PUBLICATIONS

Engineering Corner, https://www.shapeways.com/product/MUT37CQWA/articulated-necktie-clips-on-toyour-top-button ; author and publication date unknown.

(Continued)

*Primary Examiner* — Sally Haden
(74) *Attorney, Agent, or Firm* — Sughrue Mion, PLLC

(57) ABSTRACT

A neckwear includes a neckband and a neckband module and may further include one or more fastener members and one or more display segments for coins, medals or bars. The neckband is connected to said neckband module, and said one or more fastener members pivotably connects said neckband module and said one or more display segments. Also provided for a neckwear are a hermetically sealed neckband module or display segment, a display segment configured to be intra-changeable, display inserts for a neckband module or display segments, torso segments, and a neckband module with a member of a fastener to accommodate interchangeable display segments.

26 Claims, 36 Drawing Sheets

Related U.S. Application Data continuation of application No. 15/639,356, filed on Jun. 30, 2017, now Pat. No. 10,136,689.

(51) Int. Cl.

| | |
|---|---|
| ***A41D 27/08*** | (2006.01) |
| ***A41D 15/00*** | (2006.01) |
| ***A44C 25/00*** | (2006.01) |
| ***A44C 3/00*** | (2006.01) |
| ***A44B 6/00*** | (2006.01) |
| ***A44B 17/00*** | (2006.01) |
| ***A44C 15/00*** | (2006.01) |
| ***A41D 25/04*** | (2006.01) |
| *A44C 5/00* | (2006.01) |
| *A41D 23/00* | (2006.01) |
| *F21S 2/00* | (2016.01) |

(52) U.S. Cl.

CPC ..... *A41D 25/04* (2013.01); *A41D 27/08* (2013.01); *A44B 6/00* (2013.01); *A44B 17/0041* (2013.01); *A44C 3/004* (2013.01); *A44C 15/005* (2013.01); *A44C 21/00* (2013.01); *A44C 25/002* (2013.01); *A41D 23/00* (2013.01); *A44C 5/0015* (2013.01); *A44C 15/00* (2013.01); *A44C 25/004* (2013.01); *F21S 2/00* (2013.01)

(56) References Cited

U.S. PATENT DOCUMENTS

| | | | | | |
|---|---|---|---|---|---|
| 2,024,943 | A | * | 12/1935 | Mix | A44B 6/00 24/327 |
| D112,303 | S | | 11/1938 | Huddle | |
| 2,578,807 | A | * | 12/1951 | Johnson | A41B 15/02 2/145 |
| 3,167,784 | A | * | 2/1965 | Less | A41D 25/00 2/150 |
| 3,181,175 | A | * | 5/1965 | Less | A41D 25/025 2/150 |
| 3,206,765 | A | * | 9/1965 | Sherman | A41D 25/00 2/144 |
| 3,218,650 | A | * | 11/1965 | Less | A41D 25/00 2/151 |
| 3,222,683 | A | * | 12/1965 | Less | A41D 25/00 2/150 |
| 3,225,358 | A | * | 12/1965 | Less | A41D 25/00 2/150 |
| 3,225,359 | A | * | 12/1965 | Less | A41D 25/00 2/150 |
| 3,430,829 | A | * | 3/1969 | Wilson | A45C 1/02 224/182 |
| 3,453,698 | A | * | 7/1969 | Mosby | A41D 25/022 24/66.1 |
| 3,635,335 | A | * | 1/1972 | Kramer | A47G 1/12 206/0.82 |
| 3,708,802 | A | * | 1/1973 | Seibert | A41D 25/02 2/155 |
| D230,540 | S | | 3/1974 | Gillman | |
| 4,159,542 | A | * | 7/1979 | Pehr | A41D 25/022 24/66.11 |
| 4,246,658 | A | * | 1/1981 | Liaw | A41D 25/14 2/152.1 |
| 4,546,494 | A | * | 10/1985 | Garber | A41D 25/02 2/144 |
| 4,627,113 | A | * | 12/1986 | Lord | A41D 25/02 2/144 |
| 4,723,422 | A | | 2/1988 | Foster | |
| 4,827,576 | A | | 5/1989 | Prince, Jr. | |
| 5,003,636 | A | | 4/1991 | Marostica | |
| 5,016,285 | A | | 5/1991 | Just | |
| D318,754 | S | * | 8/1991 | Hughes | D2/605 |
| 5,036,550 | A | * | 8/1991 | Wilsey | A41D 25/005 2/144 |
| D320,499 | S | | 10/1991 | White et al. | |
| 5,073,987 | A | * | 12/1991 | Crosier | A41D 25/00 2/144 |
| 5,191,972 | A | * | 3/1993 | Helzer | A47G 1/12 206/0.8 |
| 5,493,731 | A | * | 2/1996 | Amnott | A41D 25/022 2/148 |
| D374,111 | S | | 10/1996 | Wilson | |
| 5,600,852 | A | * | 2/1997 | Densch | A41D 25/005 2/144 |
| 5,673,434 | A | * | 10/1997 | Risk | A41D 25/005 2/144 |
| 5,774,893 | A | * | 7/1998 | Torres | A41D 25/025 2/148 |
| D398,435 | S | | 9/1998 | Gray | |
| 6,226,844 | B1 | | 5/2001 | Lerra et al. | |
| 6,266,823 | B1 | * | 7/2001 | Padoan | A41D 25/00 2/144 |
| 6,792,654 | B2 | | 9/2004 | Schmitz | |
| D509,944 | S | * | 9/2005 | Mason | A41D 25/00 D2/608 |
| D663,916 | S | | 7/2012 | Bracey | |
| 9,095,180 | B1 | * | 8/2015 | Lovett | A41D 25/025 |
| 9,161,582 | B2 | | 10/2015 | Anderson | |
| 9,222,150 | B2 | | 12/2015 | Johns | |
| D748,370 | S | * | 2/2016 | Johnson | A41D 25/00 D2/605 |
| D775,777 | S | * | 1/2017 | Peral | A41D 25/00 D2/605 |
| 2004/0111005 | A1 | | 6/2004 | Lu | |
| 2004/0261154 | A1 | * | 12/2004 | Dotterer | A41D 25/06 2/144 |
| 2005/0172458 | A1 | * | 8/2005 | Schell | A44B 6/00 24/66.2 |
| 2007/0214543 | A1 | * | 9/2007 | Yuan | A41D 25/00 2/144 |
| 2015/0201712 | A1 | | 7/2015 | Keller | |

FOREIGN PATENT DOCUMENTS

| | | | |
|---|---|---|---|
| CN | 201182232 | Y | 1/2009 |
| WO | 88/06414 | A1 | 9/1988 |

OTHER PUBLICATIONS

The fusionguy, https://thefusionguy.wordpress.com/category/woodworking/ ; author and publication date unknown.

http://woodknot.com/; author and publication date unknown.

http://www.jebiga.com/cams-wooden-ties-new-take-fashion/; author and publication date unknown.

https://www.vat19.com/item/wood-tie ; author and publication date unknown.

Written Opinion dated Apr. 13, 2017 from the International Searching Authority in application No. PCT/US2016/068168.

International Search Report dated Apr. 13, 2017 from the International Searching Authority in application No. PCT/US2016/068168.

* cited by examiner

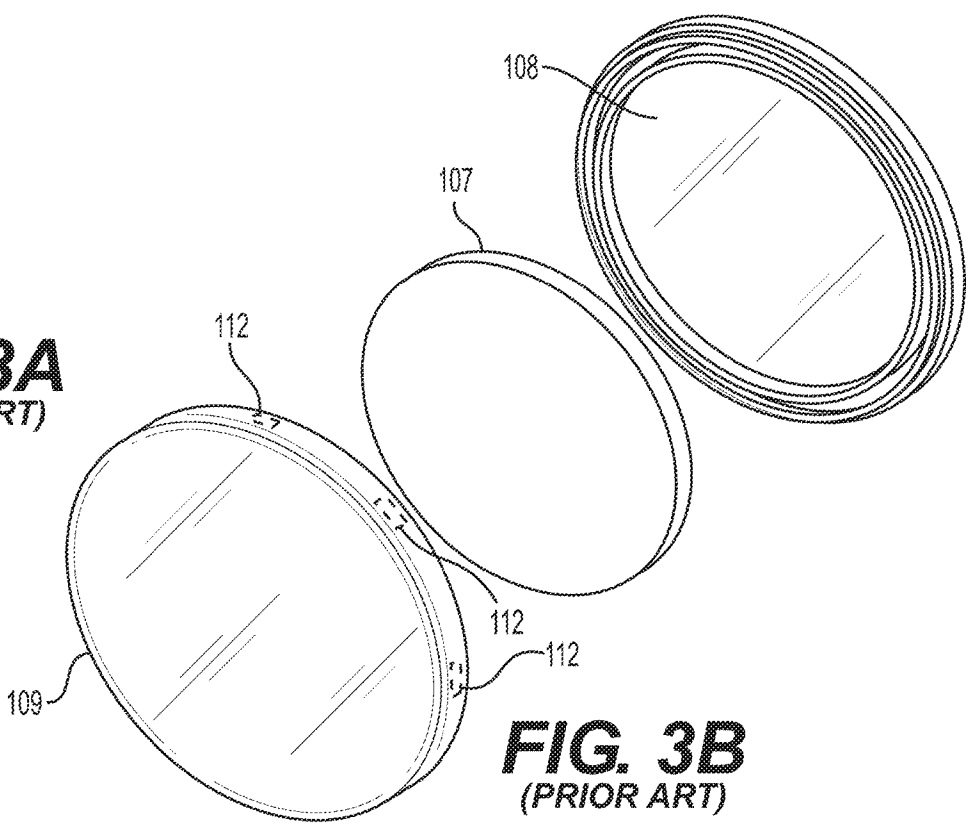
FIG. 3A
(PRIOR ART)
FIG. 3B
(PRIOR ART)
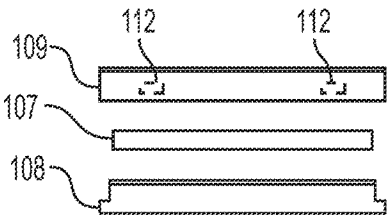
FIG. 3C
(PRIOR ART)
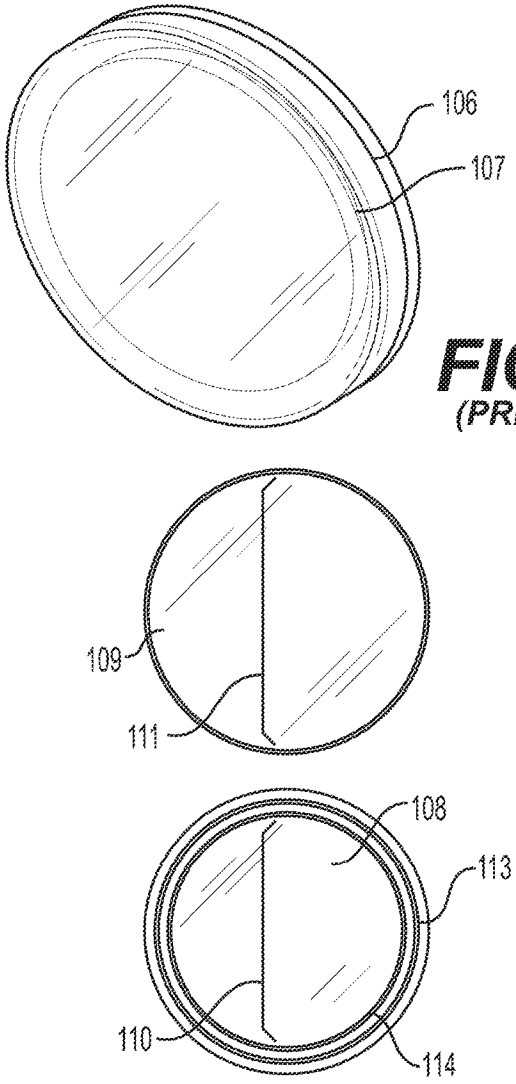
FIG. 3D
(PRIOR ART)

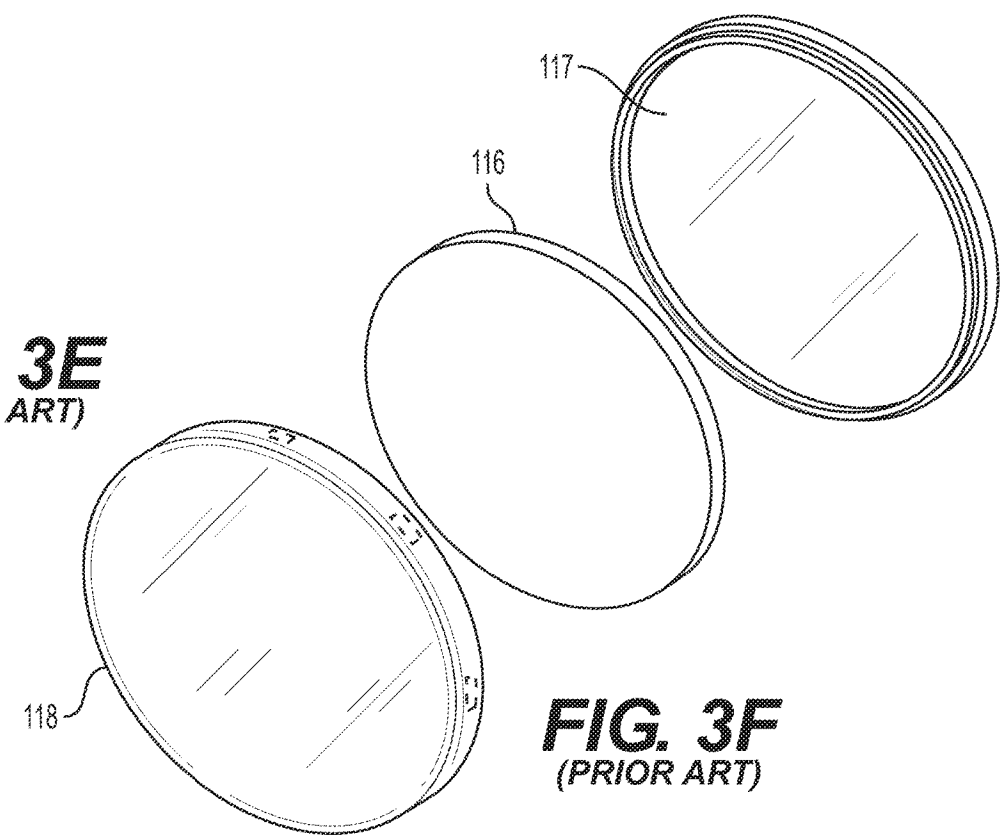
FIG. 3E
(PRIOR ART)
FIG. 3F
(PRIOR ART)
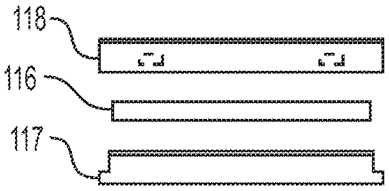
FIG. 3G
(PRIOR ART)
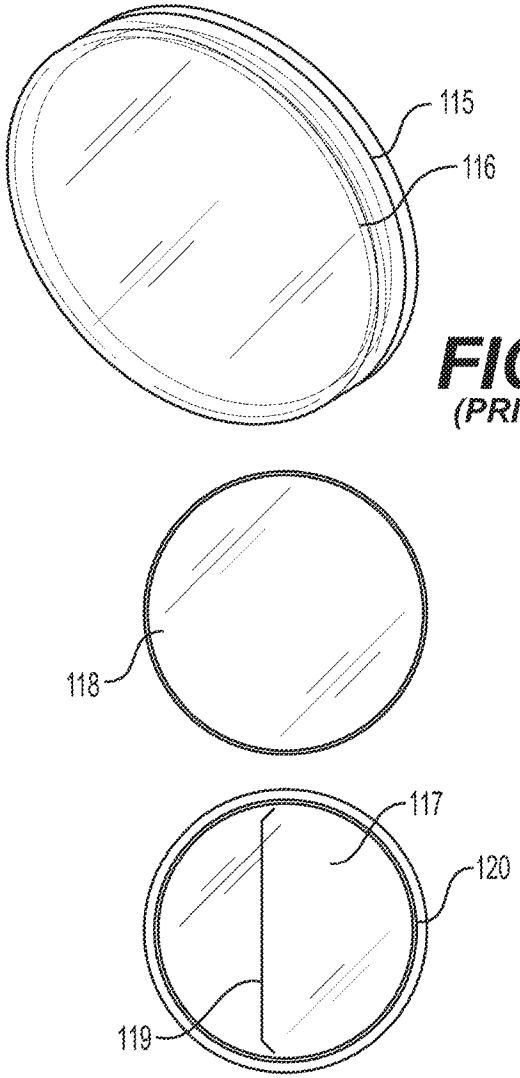
FIG. 3H
(PRIOR ART)

NECKWEAR FOR DISPLAYING COINS, MEDALS OR BARS WITH DISPLAY INSERTS

This application is a continuation application of U.S. patent application Ser. No. 15/647,902, filed Jul. 12, 2017, which is a continuation application of U.S. patent application Ser. No. 15/639,356 filed Jun. 30, 2017, the entire contents of which are herein incorporated by reference. The entire contents of U.S. patent application Ser. No. 15/384,540, filed Dec. 20, 2016, are herein incorporated by reference.

FIELD

The present disclosure relates to neckwear.

INTRODUCTION

Various types of neckwear have been proposed including those as an alternative to the necktie. For example, U.S. patent application Ser. No. 15/384,540 discloses functional metallic neckwear comprising of a neckband, a neckband module and pivoting torso segments directly connected by fasteners. The neckwear is positioned along the center of the wearer's torso like a necktie. The present inventor discovered that an efficient method of providing an extraordinary metallic neckwear panel, which includes the neckband module and torso segments, is the process used by private and government mints to produce coins, medals and bullion bars. A plurality of metallic torso segments may end at the beltline which is traditionally the preferred length of a necktie. Embodiments provide neckwear which allows the wearer to quickly and easily add, remove, relocate and replace torso segments resulting in a wide variety of potential neckwear appearances including various potential lengths of the same neckwear.

Jewelry bezels are known in the art to hold a single coin or bullion bar as a pendant. These have drawbacks and are deficient in certain respects which include, as a piece of jewelry, they are not otherwise functional such as being deficient in offering a hermetically sealed environment to prevent, for example, tarnishing of a silver coin, and they do not satisfy the functions of the necktie. Further, bezels are not configured for additional sections to be attached for multiple lengths of a neckwear to display a minted series or set of coins, medals or bullion bars nor are they configured to display different sized coins, medals or bullion bars.

Depending on the metal, certain coins, medals and bars such as silver and copper naturally tarnish when exposed to air in the atmosphere. For example, as silver and copper tarnishes, sulfides, oxides and/or carbonates are formed on the surface of the metal. Tarnishing diminishes the allure and appearance of silver, generally the most reflective metal, since as silver tarnishes its brightness and whiteness are reduced along with reflectively of the silver. Tarnish can be removed but cleaning is laborious and often negatively affects the surface of the metal and appearance of the article. Whether tarnish is left on the metal or cleaned, chemical damage has already occurred to the surface of the metal resulting in reduced detail on the surface of the coin, medal or bullion bar. The tarnishing of silver bullion, including coins, medals and bars, is an issue for mints, jewelers and collectors, as compared to gold or platinum bullion, which do not tarnish. Silver bullion is by far the most popular precious metal sold by mints.

Methods for addressing the tarnishing of silver are known in the art and include coating silver articles using rhodium or other coatings such as lacquers or varnishes, applying a film coating on the surface of silver by depositing successive molecular layers such as aluminum oxide on the silver, and using certain silver alloys such as those that contain germanium. For example, U.S. Pat. No. 9,222,150 B2 to Johns discloses a process for making a silver alloy comprising of at least 77 wt %, copper, and an amount of germanium that is preferably at least 0.5 wt %. A silver alloy is disclosed comprising 96-97.3 wt % silver, 1-2 wt % germanium, optionally up to 1 wt % zinc, optionally up to 0.2 wt % silicon, the balance copper and 1-40 ppm boron.

The above methods reduce the rate of tarnishing but do not prevent tarnishing, and each method has negative consequences including increased production costs and steps, discoloration of the silver which reduces silver's brightness, whiteness and reflectivity, and/or the wearing off of the surface application. Moreover, the addition of non-silver elements or compounds to silver or to the surface of a finished silver article is the very antithesis of silver bullion, which is the reason major mints do not incorporate these methods to their silver bullion products, nor do most collectors or investors desire their silver bullion to be adulterated or contaminated by these methods. Millesimal fineness is a system used to denote the purity of metals by parts per thousand of pure metal in the alloy by mass; silver bullion is generally at least 99.9% pure silver referred to as "999 fine" or "fine silver." Some silver bullion is 9999 fine.

A drawback of wearing articles of gold or silver that are 999 fine is that these are both soft metals prone to scratches and nicks. Gold has a Vickers hardness of approximately 188-216 MPa and silver and has a Vickers hardness of approximately 251 MPa, as compared to platinum which has a Vickers hardness of approximately 400-550 MPa. Although alloys of gold (e.g., 14 karat gold is 58.33% gold) and alloys of silver (e.g., sterling silver is generally 92.5% silver) are popular in the jewelry industry due in part because these alloys are harder than their bullion counterparts, use of these gold or silver alloys in jewelry dramatically alters their optical properties and reduces the beauty and allure of these precious metals. Gold bullion that is 9999 fine, silver bullion that is 999 fine, and copper that is 999 fine each has a unique and appealing color, which is altered when any of these metals is alloyed with another metal. Gold bullion is cherished due to its color and has a more yellowish tone than 14 karat gold. The color of silver bullion is brighter and whiter than silver alloys including sterling silver. Copper, like gold, is one of the few metallic elements with a natural color other than gray or silver.

Accordingly, there is a need for functional neckwear capable of multiple lengths to display a set or series of coins, medals or bullion bars and which preserves the integrity of the metal including safeguarding the coins, medals or bullion bars from tarnishing, wear and tear, and/or being directly mounted to fasteners.

SUMMARY

One aspect is a neckwear comprising (a) a neckband; (b) a neckband module; (c) at least one display segment; and (d) at least one fastener, wherein said neckband is connected to said neckband module, and said neckband module is connected to said at least one display segment; wherein said neckband module is configured for displaying a coin, medal or bullion bar; wherein said at least one display segment is configured for displaying a coin, medal or bullion bar; and wherein said at least one fastener includes a first fastener that pivotably connects said neckband module to said at least one display segment.

The at least one display segment may comprises a plurality of display segments, said plurality of display segments including a first display segment and a second display segment, and, the at least one fastener may further comprises a second fastener that connects said first display segment to said second display segment.

The at least one display segment may also include an intra-changeable display segment.

The at least one display segment may include one or two glass display windows.

The at least one display segment may include a closure.

The neckwear may also include at least one of said neckband module including a coin, medal or bullion bar, and said at least one display segment including a coin, medal or bullion bar.

The neckwear may further comprise a clip segment configured to secure said neckwear to a shirt.

The neckwear may further comprise at least one torso segment that does not contain a coin, medal or bullion bar.

The at least one fastener may comprise a take-apart hinge.

The at least one fastener may comprises a quick-release buckle.

The plurality of display segments may comprise intra-changeable display segments.

The at least one intra-changeable display segment may be configured to be intra-changed without a key or a tool.

The closure may be configured to be connected and disconnected from said at least one display segment without a key or a tool.

Another aspect is a neckwear, comprising: a neckband, and a neckband module, wherein said neckband is connected to said neckband module; wherein said neckband module is configured for displaying a coin, medal or bullion bar; and wherein said neckband module includes a fastener or a fastener member for connecting said neckband module to at least one interchangeable display segment or at least one interchangeable torso segment.

The neckband module may further include a coin, medal or bullion bar.

The neckband module may include a closure.

The neckband module may include one or two glass display windows.

The fastener or fastener member may comprise a take-apart hinge or a member of a take-apart hinge.

The fastener or fastener member may comprise a quick-release buckle or a member of a quick-release buckle.

The closure may be configured to be connected and disconnected without a key or a tool.

Another aspect is an interchangeable display segment for a neckwear, wherein said display segment is configured for displaying a coin, medal or bullion bar, and wherein said display segment includes a fastener or a fastener member.

The fastener or fastener member may comprise a take-apart hinge or a member of a take apart hinge.

The fastener or fastener member may comprise a quick-release buckle or a member of a quick-release buckle.

Another aspect is an interchangeable coin, medal or bullion bar configured for being housed within a neckband module or a display segment of a neckwear.

Another aspect is a neckwear, comprising (a) a neckband; (b) a hermetically sealed neckband module configured for displaying a coin, medal or bullion bar through glass; (c) at least one hermetically sealed display segment configured for displaying a coin, medal or bullion bar through glass; and (d) at least one fastener, wherein said neckband is connected to said neckband module and said neckband module is connected to said at least one display segment; wherein said hermetically sealed neckband module contains a coin, medal or bullion bar; wherein said at least one hermetically sealed display segment contains a coin, medal or bullion bar; and wherein said at least one fastener includes a first fastener that pivotably connects said hermetically sealed neckband module to said at least one hermetically sealed display segment.

The at least one display segment may comprise a plurality of display segments, said plurality of display segments including a first display segment and a second display segment, and the at least one fastener may further comprise a second fastener that connects said first display segment to said second display segment.

The at least one hermetically sealed display segment may include an intra-changeable display segment.

The neckwear may further comprise a clip segment configured to secure said neckwear to a shirt.

The neckwear may further comprise at least one torso segment that does not contain a coin, medal or bullion bar.

The at least one coin, medal or bullion bar may comprise silver, copper, gold or platinum.

The at least one fastener may comprise a take-apart hinge.

The at least one fastener may comprise a quick-release buckle.

A neckwear, comprising (a) a neckband; (b) a neckband module; (c) at least one hermetically sealed display segment configured for displaying a coin, medal, or bullion bar through glass; and (d) at least one fastener, wherein said neckband is connected to said neckband module and said neckband module is connected to said at least one hermetically sealed display segment; wherein said neckband module is not configured for displaying a coin, medal or bullion bar, and wherein said neckband module is not hermetically sealed; wherein said at least one hermetically sealed display segment contains a coin, medal, or bullion bar; and wherein said at least one fastener includes a first fastener that pivotably connects said neckband module to at least one hermetically sealed display segment.

The plurality of display segments may comprise intra-changeable display segments.

The at least one intra-changeable display segment may be configured to be intra-changed without a key or a tool.

Another aspect is a neckwear, comprising: a neckband, and a neckband module, wherein said neckband is connected to said neckband module; wherein said neckband module is configured to display a coin, medal or bullion bar through glass; and wherein said neckband module is hermetically sealed and contains a coin, medal or bullion bar.

The neckband module may further include a coin holder, coin capsule or bullion bar capsule containing said coin, medal or bullion bar.

The neckband module may include a fastener or fastener member for connecting to at least one interchangeable display segment or for connecting to at least one interchangeable torso segment that does not contain a coin, medal or bullion bar.

Another aspect is an interchangeable display segment for a neckwear, wherein said display segment is hermetically sealed, wherein said display segment is configured for displaying a coin, medal or bullion bar through glass and wherein said display segment contains a coin, medal or bullion bar.

The coin, medal or bullion bar may be encapsulated by a coin holder, coin capsule or bullion bar capsule within said display segment.

The display segment may include a fastener or fastener member.

The fastener or fastener member may comprise a take-apart hinge or a member of a take-apart hinge.

The fastener or fastener member may comprise a quick-release buckle or a member of a quick-release buckle.

Another aspect is a neckwear, comprising (a) a neckband; (b) a neckband module; (c) at least one display segment; and (d) at least one fastener, wherein said neckband is connected to said neckband module, and said neckband module is connected to said at least one display segment; wherein said neckband module is configured to house a display insert; wherein said at least one display segment is configured to house a display insert; and wherein said at least one fastener includes a first fastener that pivotably connects said neckband module to said at least one display segment.

The at least one display segment may comprise a plurality of display segments, said plurality of display segments including a first display segment and a second display segment, and the at least one fastener may further comprise a second fastener that connects said first display segment to said second display segment.

The at least one display segment may include an intra-changeable display segment.

The neckwear may include at least one of said neckband module including a display insert and said at least one display segment including a display insert.

The at least one display segment may include a closure.

The neckwear may further comprise a clip segment configured to secure said neckwear to a shirt.

The neckwear may further comprise at least one torso segment that is not configured to house a display insert.

The at least one fastener may comprise a take-apart hinge.

The at least one fastener may comprise a quick-release buckle.

The plurality of display segments may comprise intra-changeable display segments.

The at least one intra-changeable display segment may be configured to be intra-changed without a key or a tool.

The display inserts may comprise a coin holder, coin capsule or bullion bar capsule.

The display inserts may contain a coin, medal or bullion bar.

The closure may be configured to be connected and disconnected from said at least one display segment without a key or a tool.

The coin holder, coin capsule or bullion bar capsule may contain a coin, medal or bullion bar.

Another aspect is a neckwear, comprising: a neckband, and a neckband module, wherein said neckband is connected to said neckband module; wherein said neckband module is configured to house a display insert; and wherein said neckband module includes a fastener or a fastener member for connecting said neckband module to at least one interchangeable display segment or at least one interchangeable torso segment.

The neckband module may contain a display insert.

The fastener or fastener member may comprise a take-apart hinge or member of a take-apart hinge.

The fastener or fastener member may comprise a quick-release buckle or member of a quick-release buckle.

The display insert contained within said neckband module may contain a coin, medal or bullion bar.

The display insert contained within said neckband module may comprise a coin capsule or bullion bar capsule.

The coin capsule or bullion bar capsule may contain a coin, medal or bullion bar.

Another aspect is an interchangeable display segment for a neckwear, wherein said display segment is configured for housing a display insert, and wherein said display segment includes a fastener or fastener member.

The interchangeable display segment may contain a display insert.

Another aspect is an interchangeable display insert configured for being housed within a neckband module or a display segment of a neckwear.

The interchangeable display insert may contain a coin, medal or bullion bar.

BRIEF DESCRIPTION OF THE DRAWINGS

FIG. 3A is a front perspective view of a prior-art coin holder that has been snapped together and configured for a 32.7 mm coin which is included within said holder. FIG. 3B is a front perspective view of said coin holder which has been taken apart showing the cover and base of said coin holder and said coin. FIG. 3C is a front view of said cover, base and coin. FIG. 3D is a top view of said cover and base.

FIG. 3E is a front perspective view of a prior-art coin holder that has been snapped together and configured for a 40.6 mm coin which is included within said holder. FIG. 3F is a front perspective view of said coin holder which has been taken apart showing the cover and base of said coin holder and said coin. FIG. 3G is a front view of said cover, base and coin. FIG. 3H is a top view of said cover and base.

DETAILED DESCRIPTION OF THE EXEMPLARY EMBODIMENTS

Figure 1A:
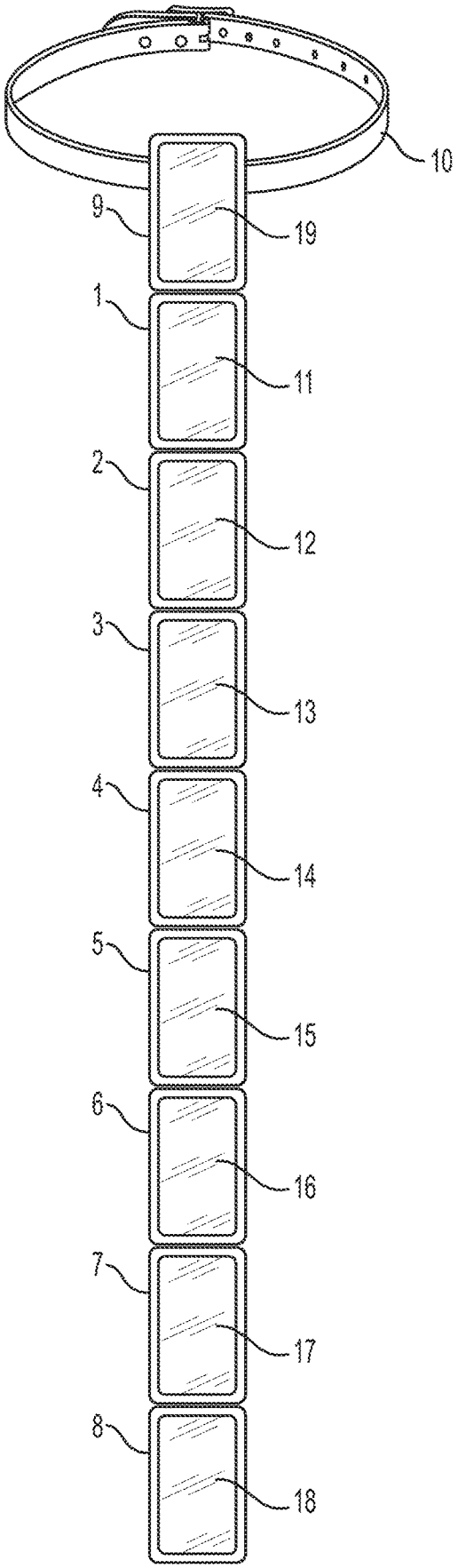
FIG. 1A is a front view of an exemplary embodiment of a neckwear including a neckband, a hermetically sealed neckband module containing a silver bullion bar and eight hermetically sealed display segments; each of which contains a silver bullion bar.

The present inventor identified a need for functional neckwear with the capability to display a set or series of coins, medals or bullion bars which preserves the integrity of the metal including safeguarding the coins, medals or bullion bars from tarnishing, wear and tear, and/or being directly mounted to fasteners. Important features for optimizing the functionality and versatility of the neckwear is the capability of the user to add, remove and replace display segments, which contain the coins, medals or bars, for multiple neckwear lengths and to relocate the position of display segments across the neckwear panel. These intra-changeability and interchangeability features are useful, for instance, since mints often release individual members of a series or set of coins, medals or bars over time and the neckwear herein is capable of adding these to the neckwear. Moreover, in some embodiments of neckwear herein, the functions of a necktie are fulfilled which include covering the front shirt placket and the front shirt buttons, bridging the gap between the shirt collars along the neckline, and being an important component of formal or semi-formal attire.

An ideal and efficient method of producing extraordinary metallic neckwear as a functional necktie alternative is by utilizing and displaying coins, medals and bullion bars provided by the pressing method used by private and government mints, as further described below. This method can replicate any image, including images with exquisitely detailed designs, which is engraved onto coins, medals or bullion bars resulting in high-quality metallic neckwear unmatched by other production methods. Mints around the world annually produce a vast number of coins (including rounds), medals and bullion. These include commemorative coins and medals and bullion coins and bars made available to collectors and sold all at once as a set or as a series in which one or more is released for sale periodically such as annually. A set or a series of coins, medals or bullion bars, which may be at least two minted articles, usually has a common theme and each coin, medal or bullion bar of the set or series typically has a unique design on at least one of its two sides, the obverse and reverse.

Three of many examples available to collectors by both government and private mints include the Platinum American Eagle coin series, the Gods of Maya coin set and the Suisse Lunar Series bullion bars, all of which are further described below. These and many other coins and bullion bars are exquisitely crafted showcasing the beauty of metals and metalworking and are considered works of art. Coin and precious metal collectors relish displaying their collections. The exemplary neckwear embodiments herein allow collectors to wear and display their coins, medals or bullion bars, including sets or series thereof, as a functional and fashionable alternative to the necktie. These neckwear embodiments provide innovative uses of coin and bullion collections which are usually destined to be stored in containers or storage boxes that they were purchased with and kept out of sight. Metallic neckwear provided by a mint's pressing method provides a dramatic contrast with the fabrics of shirts, vests and suitcoats in composition, texture, color and light reflectance value. As further discussed below, the light reflectance value of metallic bars provided by a mint's pressing method compare favorably to the light reflectance value of fabrics.

In one aspect, exemplary embodiments provide neckwear in which the integrity of the displayed coins, medals or bullion bars is safeguarded and preserved within a hermetically sealed neckband module and/or hermetically sealed display segments of a neckwear to prevent tarnishing and/or the wear and tear that may result from wearing the neckwear. Coins, medals and bullion bars may be specifically configured for a neckwear (in terms of engraving, other design elements and dimensions including thickness) or commercially available coins, medals and bullion bars may be utilized for a neckwear.

In another aspect, exemplary embodiments provide neckwear in which displayed coins, medals or bullion bars, may be intra-changed among those that a neckwear comprised of originally and interchanged with extrinsic coins, medals or bullion bars that a neckwear was not comprised of originally. These features are accomplished vis-à-vis (i) directly intra-changing or interchanging the actual coin, medal or bullion bar, (ii) intra-changing or interchanging the display segments containing coins, medals or bullion bars which, among other advantages, allows multiple lengths of the same neckwear, or (iii) intra-changing or interchanging display inserts (e.g., coin holders) containing coins, medals or bullion bars. Combinations of (i) and (ii) above or (ii) and (iii) above may be accomplished with the same neckwear.

In another aspect, exemplary embodiments provide a neckwear panel and display inserts (which may include commercially available coin holders, coin capsules or bullion bar capsules) which are configured for one another.

In another aspect, exemplary embodiments provide interchangeable display segments, interchangeable display inserts, and interchangeable coins, rounds, medals and bullion bars. Interchangeable display segments and interchangeable display inserts may include coins, rounds, medals or bullion bars which are either specifically configured and custom designed (in terms of engraving, other design elements and dimensions including thickness) for a neckwear or commercially available coins, medals and bullion bars may be utilized for a neckwear. Interchangeable coins, interchangeable rounds, interchangeable medals and interchangeable bullion bars are specifically configured and custom designed for a neckwear.

The exemplary embodiments described herein provide comfortable neckwear in which the neckband module is situated at approximately the same position on the wearer as a necktie knot and is supported by a neckband. The neckwear panel of a neckwear may originally comprise of a neckband module, including capacity for interchangeable display or torso segments to be added. The neckwear panel may also originally comprise of a neckband module and at least one display segment and/or at least one torso segment. Any display or torso segment(s) are positioned below the neckband module and may end at the beltline which is traditionally the preferred length of a necktie.

A neckband of a neckwear of the exemplary embodiments herein may be adjustable to comfortably fit various size necks and may include a strap or the like and a fastener to attach and/or adjust the circumference of the neckband. The neckband supports the neckband module and the neckband may comprise a multitude of suitable materials. Suitable materials for a flexible neckband strap include leather, nylon or fabric such as silk. For example, leather neckbands, similar to belts, have various holes on the strap allowing the wearer to place the prong of a buckle through any hole along the strap for optimal comfort and appearance. Various types of fasteners known in the art may be utilized in conjunction with the neckband strap, including those used for neckbands and belts. For example, suitable fasteners include buckles, quick-release buckles such as side-release buckles and center-release buckles and hook-and-loop fasteners such as Velcro®. Suitable materials for a neckband fastener to accommodate the strap (or the like) are metals including aluminum, metal alloys such as steel, fiber reinforced polymers and synthetic polymers including plastics. It will be appreciated that the neckband may comprise of non-flexible materials, including metallic materials, as an alternative to a flexible neckband strap. For example, types of chains or necklaces such as a rigid choker comprising two approximate half-circle sections which open and close by a hinge and said sections are secured around the wearer's neck with a fastener to form a circle or an oval. A neckband may comprise of two bands, irrespective of its composition, each connected separately to the neckband module.

A neckband module, including an aperture mechanism, display segments, torso segments and clip segments, which include a mechanism akin to a tie clip, of a neckwear may be provided by any method known in the art such as being casted or by three-dimensional printing (3D printing), also known as additive manufacturing (AM). "3D printing" or "AM" as used herein refers to various processes used to synthesize a three-dimensional object, including the means of producing an object through successive or multiple layers of material formed under computer control from a model or other electronic data source. Many types of 3D printing may be utilized for the inventive neckwear, including powder bed and inkjet head 3D printing (3DP), electron-beam melting (EBM), selective laser melting (SLM), direct metal laser sintering (DMLS), directed energy deposition, electron beam freeform fabrication (EBF) and robocasting.

A neckwear may include clip segment(s) allowing the neckwear panel be secured to a shirt placket or front shirt panel, without any additional accessories that are not already mounted to the neckwear, to curtail undesired movement of the neckwear while being worn including that the neckwear remains substantially straight on the wearer and covers the front shirt buttons.

Exemplary embodiments provide display segments and torso segments that have the capability to be added to a neckwear or to replace display segments or torso segments of a neckwear. In this regard, a display segment or a torso segment that a neckwear was not comprised of originally, a so called "extrinsic" display segment or torso segment, may be temporarily or permanently added to the neckwear. Should the wearer misplace or lose a display segment or a torso segment, or simply wish to temporarily or permanently replace one or more display segments or torso segments with other display segment(s) or torso segment(s), exemplary embodiments provide additional and/or replacement "extrinsic" display segments or torso segments for use in a neckwear. It is understood that such additional and/or replacement "extrinsic" display segments or torso segments may attach at any segment position of a neckwear having this feature, as both "intrinsic" display segments or torso segments that the neckwear comprised of originally and the "extrinsic" display segments or torso segments have uniform fasteners, or at least sufficiently uniform fasteners, providing the capability of connecting to one another. Extrinsic display segments and torso segments, also referred herein as interchangeable display segments and interchangeable torso segments, may be commercially available as individual display segments or individual torso segments or as a plurality of display segments or a plurality of torso segments. In some embodiments, interchangeable display segments include display inserts, coins, medals or bullion bars.

Likewise, exemplary embodiments provide coins, medals or bullion bars which are specifically configured and custom designed (in terms of engraving, other design elements and dimensions including thickness) for display segments or a neckband module of a neckwear to replace coins, medals or bullion bars of a neckwear. In this regard, a custom designed coin, medal or bullion bar that a neckwear was not comprised of originally, a so called "extrinsic" coin, medal or bullion bar may be temporarily or permanently added to the neckwear. Should the wearer misplace or lose a coin, medal or bullion bar or simply wish to temporarily or permanently replace one or more coins, medals or bullion bars with other coin(s) medal(s) or bullion bar(s) specifically configured and custom designed for a neckwear, exemplary embodiments provide additional and/or replacement "extrinsic" coins, medals or bullion bars for use in a neckwear. It is understood that such additional and/or replacement "extrinsic" coins, medals or bullion bars specifically configured and custom designed for a neckwear may be inserted into any neckband module or display segment of a neckwear having this feature (e.g., FIGS. 2A-2P and the related description below). Extrinsic coins, medals or bullion bars, also referred herein as "interchangeable coins," "interchangeable medals" or "interchangeable bars," may be commercially available as individual coins, medals or bars or may be commercially available in conjunction with neckband modules, display segments or display inserts.

As used herein, "neckwear" includes a neckband and a neckband module and may further include one or more fastener members, one or more display segments, and/or one or more torso segments.

"Neckwear panel" as used herein means the neckband module, display segment(s), if any, and torso segment(s), if any, collectively, that form the length of a neckwear. "Front neckwear panel" as used herein means the front plane of the neckwear panel which is visible to the casual observer when the neckwear is worn.

"Neckband module" as used herein means the component of the neckwear panel to which the neckband connects. A neckband module may or may not be configured to secure and display a coin, medal, bullion bar or display insert. A neckwear may only include a neckband module without any display segments or torso segments as shown in FIGS. 1E (neckwear on woman in middle illustration) and 2J. A neckband module may include a fastener or portion of a fastener that is part of the same casting of the neckband module or part of any other production method fabricating the neckband module.

"Display segment" as used herein means a component of a neckwear panel configured to secure and display a coin, medal, bullion bar or display insert. For example, display segment one, the top most display segment, connects to the neckband module, and if the neckwear includes more than one display segment, display segment two connects to display segment one, et cetera. A display segment may include a fastener or portion of a fastener that is part of the same casting of the display segment or part of any other production method fabricating the display segment.

A display segment includes one or two display windows through which a coin, medal or bar is viewed either directly through the cutout of the display window, through glass of the display window, or if a display insert is utilized which may comprise of a coin holder, coin capsule or bullion bar capsule, through the glass of the display insert. A display window of a display segment or neckband module (if a neckband module is configured to display a coin, medal, bullion bar or display insert) may be a cutout of the display segment or neckband module so that the coin, medal or bullion bar is directly viewed without any intermediary glass. The display window may include glass, in which the glass display window further safeguards a coin, medal or bullion bar while allowing the coin, medal or bullion bar to be viewed. If a display segment or neckband module is configured for a display insert, the coin, medal or bullion bar is viewed through the display-insert glass which is visible through the display window cutout. The area around the display window of a display segment or neckband module may have an ornamental design.

"Torso segment" as used herein means a component of a neckwear panel not configured to secure or display a coin, medal, bullion bar or display insert. A torso segment may connect to a neckband module, a display segment or another torso segment. A torso segment may include any type of ornamental design and may comprise of a coin, medal or bullion bar. In some exemplary embodiments, torso segments of a neckwear are intra-changeable among other torso segments and display segments.

The term "display-clip segment" as used herein means a display segment which includes a mechanism, akin to a tie clip or the like, mounted on the backside of the display segment. The term "torso-clip segment" as used herein means a torso segment which includes a mechanism, akin to a tie clip or the like, mounted on the backside of the torso segment. The term "clip segment" as used herein means either a display segment or a torso segment which includes a mechanism, akin to a tie clip or the like, mounted on the backside of the respective display segment or torso segment. A clip segment secures neckwear to a garment such as a shirt placket or front shirt panel without any additional unattached or unmounted accessories.

"Display insert" as used herein means any capsule, frame, holder or other mechanism, for use in a neckwear, that's capable of being inserted or otherwise attachable to a display segment or neckband module to secure and display a coin, medal or bullion bar in a display segment or neckband module. In some exemplary embodiments of a neckwear, display inserts (including custom designed coin holders, coin capsules or bullion bar capsules) and display segments are specifically configured for one another. Display segments may also be configured for prior art coin holders, coin capsules or bullion bar capsules. Whether display inserts and display segments are configured for one another or display segments are configured for prior art coin holders, coin capsules or bullion bar capsules, a display insert (i) may contain a coin, medal or bullion bar that has already been designed, produced or sold separately or (ii) may contain a custom designed (in terms of engraving, other design elements and dimensions including thickness) coin, medal or bullion bar.

"Closure" as used herein means any mechanism or combination of mechanisms that secures a display insert, coin, medal or bullion bar within or to a display segment or neckband module and allows the user to access the display insert, coin, medal or bullion bar. In some exemplary embodiments, a display segment or neckband module does not include a closure. An example of a display segment or neckband module not including a closure is a display segment or neckband module in which two portions (e.g., halves) completely separate by disconnecting fastener(s) for the user to access a coin, medal or bullion bar in the display segment or neckband module. Another example is a display segment or neckband module which resembles a clamshell container consisting of two halves joined by a hinge or the like.

"Hermetically sealed display segment" and "hermetically sealed neckband module" as used herein means a display segment or neckband module which is virtually impervious to air flow to the extent of preventing tarnishing of the encapsulated coin, medal or bullion bar. There are several analytical test methods to quantify acceptable leak rates for hermetically sealed containers, including MIL-STD-883 TM 1014, and even the most stringent of these methods allow a minute amount of air and moisture to pass through the container while still deeming the container "hermetic."

"Coin" as used herein means a piece of metal issued by a government as money, and "coin" also includes "rounds" which are flat pieces of round metal resembling coins sold for their precious metal content or common metal content as well as their aesthetics and are not legal tender. "Bullion bar" or "bar" are used interchangeably herein and each term means a bar or wafer comprised of a precious metal such as silver, a common metal such as copper, or a metal alloy such as bronze. "Medal" as used herein, includes medallions, and means a finished piece of metal that has been marked with an insignia, portrait or other artistic rendering. Medals may commemorate significant historical events or to honor people or organizations with notable achievements or deeds. In some exemplary embodiments of a neckwear, a custom designed (in terms of engraving, other design elements and dimensions including thickness) coin, medal or bullion bar and a neckband module are specifically configured for one another. In other exemplary embodiments of a neckwear, a neckband module is configured to fit a coin, medal or bullion bar that has already been designed, produced and/or separately made available commercially. Likewise, in some exemplary embodiments of a neckwear, a custom designed (in terms of engraving, other design elements and dimensions including thickness) coin, medal or bullion bar and a display segment are specifically configured for one another. In other exemplary embodiments of a neckwear, a display segment is configured to fit a coin, medal or bullion bar that has already been designed, produced and/or separately made available commercially.

"Glass" as used herein and related to a display window of a display segment or neckband module means any type of glassy transparent or semitransparent material. Examples include plastics such as acrylic and display-type glasses such as sapphire glass and Corning® Gorilla® glass. Glass display windows may include a colored tint.

"Fastener" as used herein means any article or combination of articles which connects, links or attaches (i) a neckband module to a display segment or torso segment, display segments to one another, torso segments to one another, and/or a display segment to a torso segment; (ii) a closure to a display segment or neckband module; or (iii) one or more sections of a display segment to one another or one or more sections of a neckband module to one another. A fastener or a portion or member of a fastener may be part of the same casting of a neckband module, display segment, torso segment or closure. Types of fasteners include for example, and in no way limiting, adhesives such as epoxies or epoxy resins, aperture mechanisms that accommodate straps or the like, anchors, bolts, buckles, quick-release buckles, side-release buckles, center-release buckles, buttons, cables, catch, chains, clamps, clasps including barrel clasps, bayonet clasps, box clasps, fish hook clasps, hook clasps, hook & eye clasps, lobster clasps, S hook clasps, spring tension clasps, spring ring clasps, snap clasps and toggle clasps, clevis pins, clips, single end and double end swivels, deadeyes, eye bolts, hinges including locking hinges, hinges with security pins, barrel hinges, take-apart hinges and hinges which include hinge pins with, for example, external (male) thread which can be fastened into the hinge with, for example, internal (female) thread, hook-and-loop fasteners also known as hook-and-pile fasteners and Velcro®, hooks, lanyards, latches, locks, locking pins, magnetic locks or other magnetic mechanisms, loops, pins, rings, ropes, screw eyes, screws, snap hooks, snaps, spring fasteners, springs, straps, strings, swivel clips, ties, wires, zippers and any combination between or among the foregoing.

Examples of suitable fasteners for a neckwear panel include any type of fastener which includes one or more of the following features. The first feature is a fastener that allows one or more display segments or torso segments to be quickly and easily intra-changed with other display segments or torso segments. The term "quickly and easily" as used herein and related to display segments or torso segments means the capability to add, remove, replace and/or relocate (in terms of position along the neckwear panel below the neckband module) one or more display segments or torso segments of a neckwear without any key, tool or the like. The second feature, mainly for the wearer's comfort, is a fastener that enables display segments or torso segments to pivot (move from front to back and back to front on the wearer) in order for the neckwear to essentially contour to the wearer's torso during body movements and while sitting, including as the wearer goes from a standing position to a sitting position and vice versa. This feature of the exemplary neckwear affords a level of comfort to the wearer while maintaining the functionality of the necktie. The third feature is a fastener that allows the display segments or torso segments to effectively straighten out by gravity, without effort from the wearer of the neckwear, in order for the neckwear to become approximately parallel with the wearer's torso after body movements including, for example, when the wearer goes from a sitting position to a standing position. This feature avoids the necessity of the wearer straightening out the display segments or torso segments manually.

The term "quickly and easily" as used herein and related to a closure means the capability to add, remove, replace and/or relocate (in terms of position along the neckwear panel) a display insert (e.g., a coin holder), coin, medal or bullion bar from a display segment or neckband module without any key, tool or the like. An example is the closure of the exemplary embodiment described below and shown in FIGS. 2F and 2G, which has been incorporated on the neckwear described below and shown in FIGS. 2H and 2I. The user of the neckwear may "quickly and easily" intra-change or interchange the coins of this neckwear without disconnecting any display segment from the neckwear panel. Likewise, the term "quickly and easily" as used herein and related to a display segment without a closure or related to a neckband module without a closure means the capability to fasten or unfasten portions (e.g., halves) of the display segment or the neckband module without any key, tool or the like to add, remove or replace a display insert, coin, medal or bullion bar.

"Comprised of originally" or "originally comprise" as used herein including any other form of the words in each phrase means a neckwear or neckwear panel at the time of the initial sale, transfer, gift or assignment of the neckwear or neckwear panel into the wholesale or retail trade (whichever occurs first) or in the event said sale, transfer, gift, or assignment of the neckwear or neckwear panel into the wholesale or retail trade does not take place, a neckwear or neckwear panel at the time of the initial sale, transfer, gift or assignment of the neckwear or neckwear panel to an end user of the neckwear or neckwear panel.

The term "intra-changeable" including any other form of the word as used herein and related to display segments or torso segments of a neckwear, means any one of the following three examples or any combination thereof: the capability of (a) two or more display segments (or torso segments) that a neckwear comprised of originally to be switched in terms of position along the neckwear panel (below the neckband module), (b) one or more display segments (or torso segments) that a neckwear comprised of originally to be relocated along the neckwear panel (below the neckband module), and/or (c) one or more display segments (or torso segments) that a neckwear comprised of originally to be detached and reattached to the neckwear. For example, each one of the eight display segments of the neckwear in the exemplary embodiment of FIG. 1A may be intra-changed with every other of the seven display segments, including for instance, the positions of display segment three and display segment seven may be switched. This entails detaching display segments three and seven and attaching the previously numbered and positioned display segment three in the place of the newly numbered and positioned display segment seven and attaching the previously numbered and positioned display segment seven in the place of the newly numbered and positioned display segment three. Each of the eight display segments in the exemplary embodiment of FIG. 1A is an "intra-changeable display segment." Another example is that display segment eight may be relocated as display segment one, in which case, all the previously numbered and positioned display segments change in that the previously numbered and positioned display segment one is now display segment two, the previously numbered and positioned display segment two is now display segment three, the previously numbered and positioned display segment three is now display segment four, et cetera. Yet another example of neckwear intra-changeability in the exemplary embodiment of FIG. 1A is that display segment eight, for instance, may be detached from the neckwear without taking the position of another display segment of the neckwear and may be reattached at a later time. An example of intra-changeable torso segments is the exemplary embodiment described below and shown in FIGS. 2H and 2I.

Figures 2A, 2B:
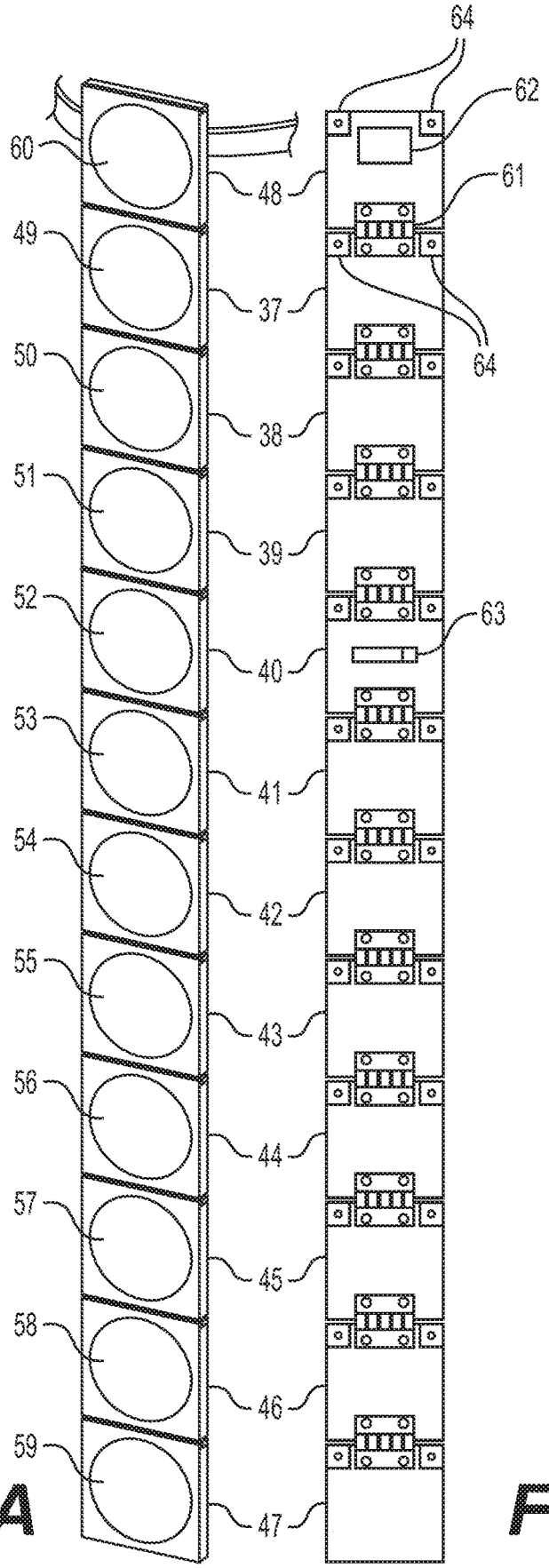
FIG. 2A is a front perspective view of another exemplary embodiment of a neckwear including a neckband, square neckband module, and eleven square display segments in which the top of the neckband module and every display segment includes a closure allowing the user access to twelve intra-changeable coins.
FIG. 2B is a rear view of said neckwear panel.
Figure 2C:
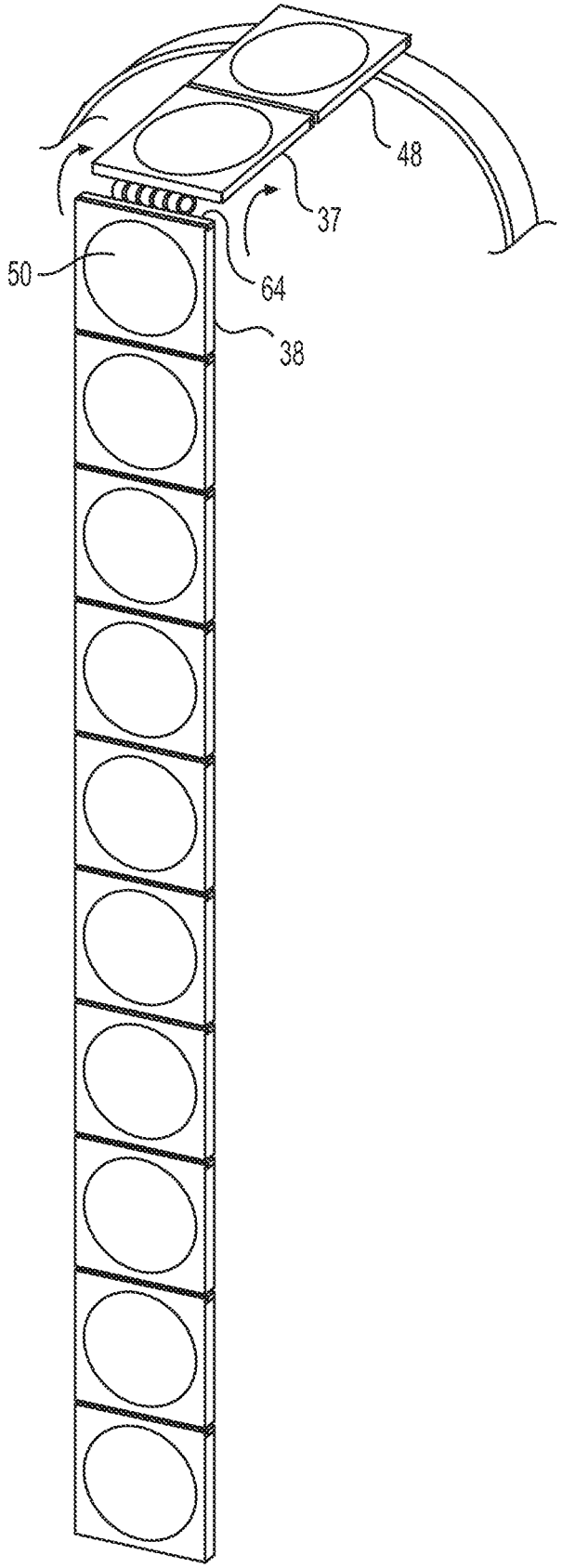
FIG. 2C is a front perspective view of the neckwear in FIG. 2A in which the neckwear panel is angled backwards above display segment two for user access to the closure on display segment two.

The term "intra-changeable" including any other form of the word as used herein and related to display inserts, coins, medals or bullion bars contained in the neckband module or display segments that a neckwear comprised of originally, means the capability to switch the positions, in terms of position along the neckwear panel, of two or more display inserts, coins, medals or bullion bars. For example, each of the twelve coins of the neckwear in the exemplary embodiment of FIGS. 2A-2C is an "intra-changeable coin." The exemplary embodiment described below and shown in FIG. 5B is an example of "intra-changeable display inserts."

The term "interchangeable" including any other form of the word as used herein and related to a display segment or torso segment means the capability to add one or more extrinsic display segments or torso segments that a neckwear was not comprised of originally to the neckwear or to replace one or more display segments or torso segments that a neckwear comprised of originally with extrinsic display segments or torso segments that the neckwear was not comprised of originally. An extrinsic display segment or torso segment configured to be added to a neckwear or to replace a display segment or torso segment that a neckwear was comprised of originally is an "interchangeable display segment" or "interchangeable torso segment." In some embodiments, an interchangeable display segment also contains a coin, medal or bullion bar and in other embodiments an interchangeable display segment does not contain a coin, medal or bullion bar. Interchangeable display segments and interchangeable torso segments may be made commercially available with or without mounted fasteners. Of course, extrinsic neckband modules or neckbands that a neckwear was not comprised of originally may also be interchanged with a neckband module or neckband that a neckwear comprised of originally.

The term "interchangeable" including any other form of the word as used herein and related to coins, medals or bullion bars contained in a neckband module or display segments of a neckwear, means the capability to replace one or more coins, medals or bullion bars that a neckwear comprised of originally with extrinsic coins, medals or bullion bars (that the neckwear was not comprised of originally) which are specifically configured and custom designed (in terms of engraving, other design elements and dimensions including thickness) for the neckwear. An extrinsic coin, medal or bullion bar specifically configured and custom designed for use in a neckwear to replace a coin, medal or bullion bar that a neckwear comprised of originally is an "interchangeable coin," "interchangeable medal" or "interchangeable bullion bar."

The term "interchangeable" including any other form of the word as used herein and related to display inserts contained in the neckband module and/or display segments of a neckwear, means the capability to replace one or more display inserts that a neckwear comprised of originally with extrinsic display inserts (that the neckwear was not comprised of originally) which are specifically configured for the neckwear. An extrinsic display insert specifically configured and for use in a neckwear to replace a display insert that a neckwear comprised of originally is an "interchangeable display insert." Interchangeable display inserts for a neckwear may be made available commercially containing a coin, medal or bullion bar.

"Contrast" including any other form of the word as used herein means the arrangement of opposite elements such as hard versus soft, light versus dark colors and rough versus smooth textures in a piece or ensemble to create visual interest, excitement and drama.

"Light Reflectance Value" (LRV) of an object means the percentage of light in the visible part of the spectrum that is reflected from its surface (and conversely the percentage of light the surface absorbs). LRV is measured using a integrating sphere reflectometer, the results of which run on a scale between 1 and 0 with a theoretical perfect white achieving a value of 1, reflecting 100 percent of visible light, and a theoretical perfect black achieving a value of 0, absorbing 100 percent. In practice, LRVs will not reach these theoretical limits.

The term "mount" including any other forms of the word as used herein, means to connect a fastener to an article with the intention of the connection being on a permanent or semi-permanent basis by any method including, for example, soldering, brazing or utilizing screws or bolts.

In some exemplary embodiments, the neckwear includes metal compositions for the neckband module and any display segments or torso segments and illustrative metals include silver, copper, gold, platinum, titanium, cobalt, nickel, aluminum, iron, tin, alloys of the foregoing including bronze, brass, steel and pewter. As disclosed in U.S. patent application Ser. No. 15/384,540, a torso segment or neckband module may be an actual coin, medal or bullion bar provided by the pressing method or may be provided by a casting. As a neckwear component which does not display a coin, medal or bar, a torso segment may be provided by any method known in the art including a casting which is not a coin, medal or bullion bar or a molding. Display segments, torso segments or a neckband module of a neckwear may comprise of the same or different metals. For example, the neckband module may be gold and the display segments may be fine silver. Display segments, torso segments or a neckband module of a neckwear may comprise of any type of material such as, for example, natural polymeric materials also known as biopolymers including wood and rubber, synthetic polymers such as synthetic rubber, acrylic, plastics and silicones, glassy materials, or fiber reinforced polymers such as carbon-fiber reinforced plastics. An individual neckband module, display segment or torso segment may be comprised of multiple materials such as multiple types of metal.

In exemplary embodiments in which the neckband module and any display segments or torso segments are metallic or metallic including glass display windows, the neckwear includes one or more of the following advantages as specifically compared to the fabric necktie: (1) stain resistant, (2) considerably easier and more economical to clean if soiled by food, beverages, ink, ashes from smoking, or other contaminants, (3) more durable, (4) wrinkle proof, (5) does not snag, (6) impervious to burn holes from smoking, (7) no need to tie a knot, and (8) more symmetrical to an observer when worn due to lack of necktie knot (and the resulting asymmetrical folds and crinkles below the necktie knot).

Given the metallic nature of such a neckwear, the pivoting capability of the display segments and torso segments provided by suitable fasteners is an important feature for comfort. In some exemplary embodiments, the neckwear comprises a sufficient number of display segments or display segments and torso segments so that the terminal display segment or torso segment of the neckwear ends approximately at the wearer's beltline, the preferred traditional length of the necktie.

A frontal view of a hermetically sealed neckwear in one exemplary embodiment is shown in FIG. 1A. The neckwear may be worn similarly to a necktie with the neckband positioned around the neck of the wearer and under the collar. The neckband 10 supports a rounded-rectangle neckband module 9, which is situated at approximately the same position on the wearer as a necktie knot. The rounded-rectangle neckband module 9 is connected to a series of eight, intra-changeable, rounded-rectangle display segments 1-8, which the neckwear comprised of originally. The front of the hermetically sealed neckband module 9 and the front of each of the hermetically sealed display segments 1-8 (as further described below and shown in FIGS. 1B and 1C) include a glass display window as depicted by the shading lines in FIG. 1A. The neckband module 9 and each of the eight display segments 1-8 are configured to fit, secure and display a silver rounded-rectangle bullion bar. Each of the nine hermetically sealed bullion bars 11-19, which are located behind the glass display windows, is engraved with a unique design, which are not depicted in FIG. 1A. These nine bullion bars 11-19 are safeguarded and preserved within the hermetically sealed neckband module and the hermetically sealed display segments to prevent tarnishing and wear and tear of the bullion bars.

Identifying and numbering display segments of any neckwear panel embodiment in the present disclosure is exemplified by the embodiment of FIG. 1A in that, display segment one 1 is below the neckband module 9, display segment two 2 is below display segment one, display segment three 3 is below display segment two, display segment four 4 is below display segment three, display segment five 5 is below display segment four, display segment six 6 is below display segment five, display segment seven 7 is below display segment six, and display segment eight 8 is below display segment seven, which is the terminal display segment in this exemplary embodiment. For any neckwear panel comprising greater than or less than eight display segments, the sequential numbering of display segment(s) follows the methodology described above for the embodiment of FIG. 1A. For a neckwear panel that includes display segments and torso segments, identifying and numbering the display segments and torso segments follows the same methodology, as further described below in the exemplary embodiment of FIGS. 2H and 2I.

Identifying and numbering bullion bars, coins or medals of any neckwear panel embodiment in the present disclosure is also exemplified by the embodiment of FIG. 1A in that, (behind the glass display windows of the neckwear panel as depicted by the shading lines) bullion bar one 11 is in display segment one 1 below the neckband module 9, bullion bar two 12 is in display segment two 2 below display segment one, bullion bar three 13 is in display segment three 3 below display segment two, bullion bar four 14 is in display segment four 4 below display segment three, bullion bar five 15 is in display segment five 5 below display segment four, bullion bar six 16 is in display segment six 6 below display segment five, bullion bar seven 17 is in display segment seven 7 below display segment six, bullion bar eight 18 is in display segment eight 8 below display segment seven, and bullion bar nine 19 is in the neckband module 9. For any neckwear panel comprising greater than or less than eight bullion bars, coins or medals, the sequential numbering follows the methodology described above for the embodiment of FIG. 1A.

Figure 1B:
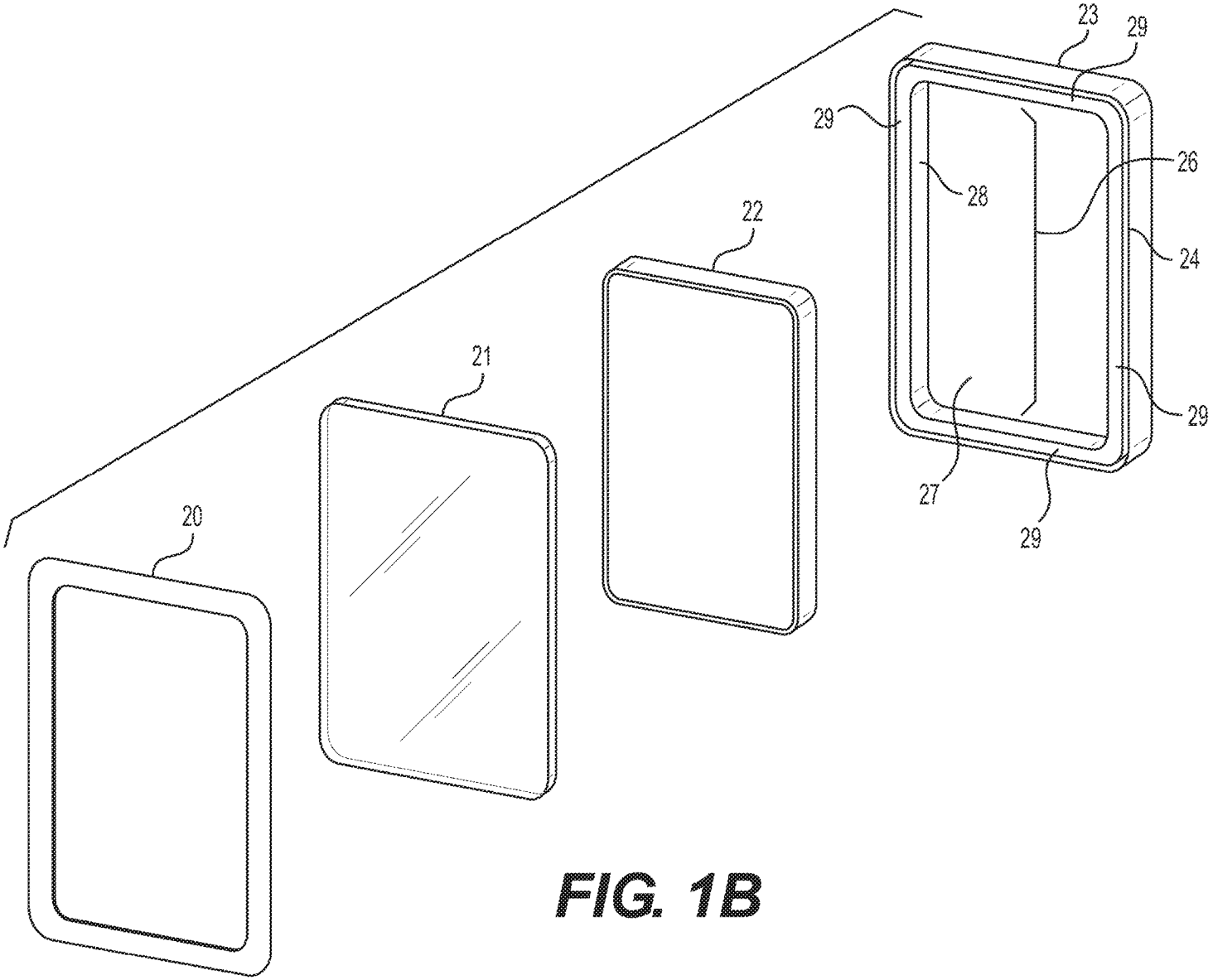
FIG. 1B is a front perspective exploded view of an exemplary embodiment of one of the display segments in FIG. 1A.
Figure 1C:
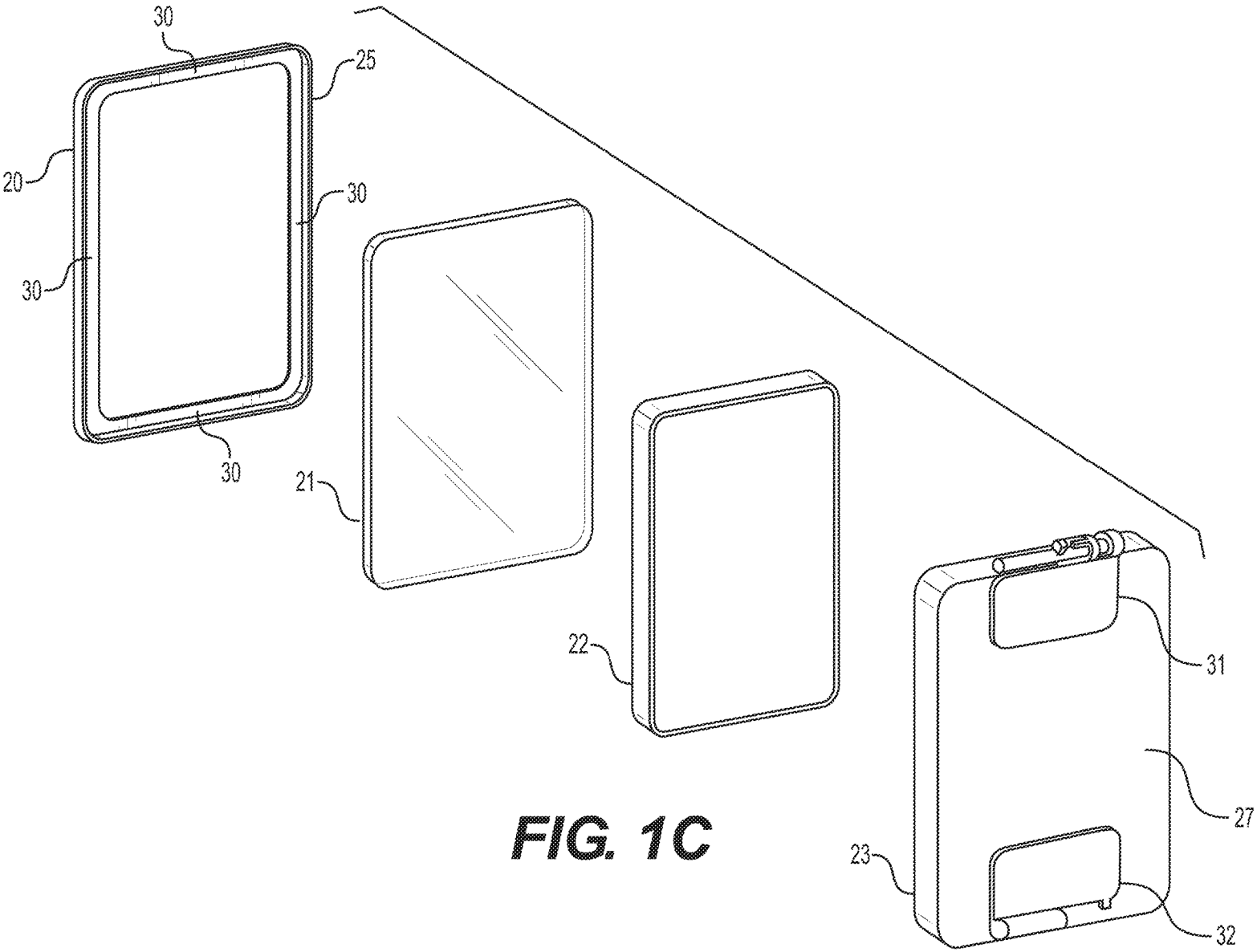
FIG. 1C is a rear perspective exploded view of said display segment.
Figure 1D:
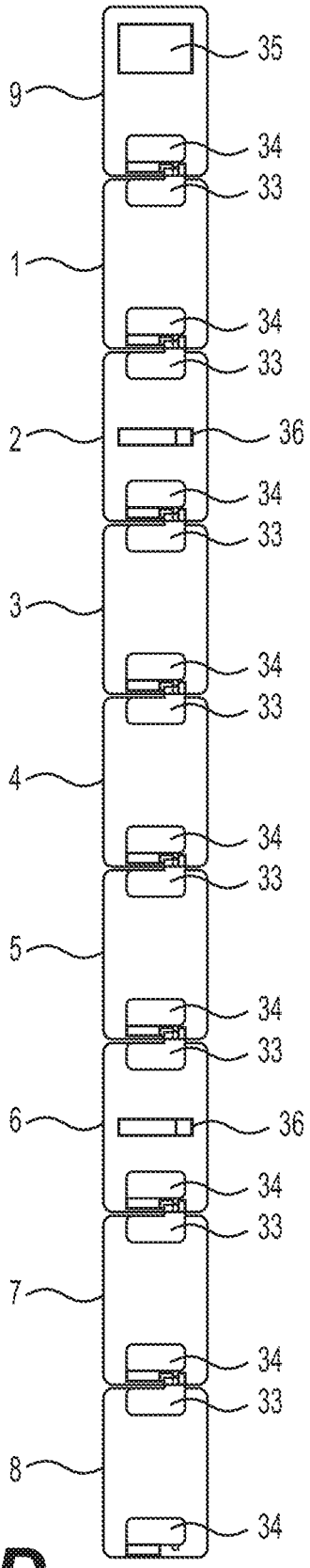
FIG. 1D is a rear view of the neckwear panel of FIG. 1A showing connectivity of the neckband module and eight intra-changeable display segments with an improved take-apart fastener.
Figure 1E:
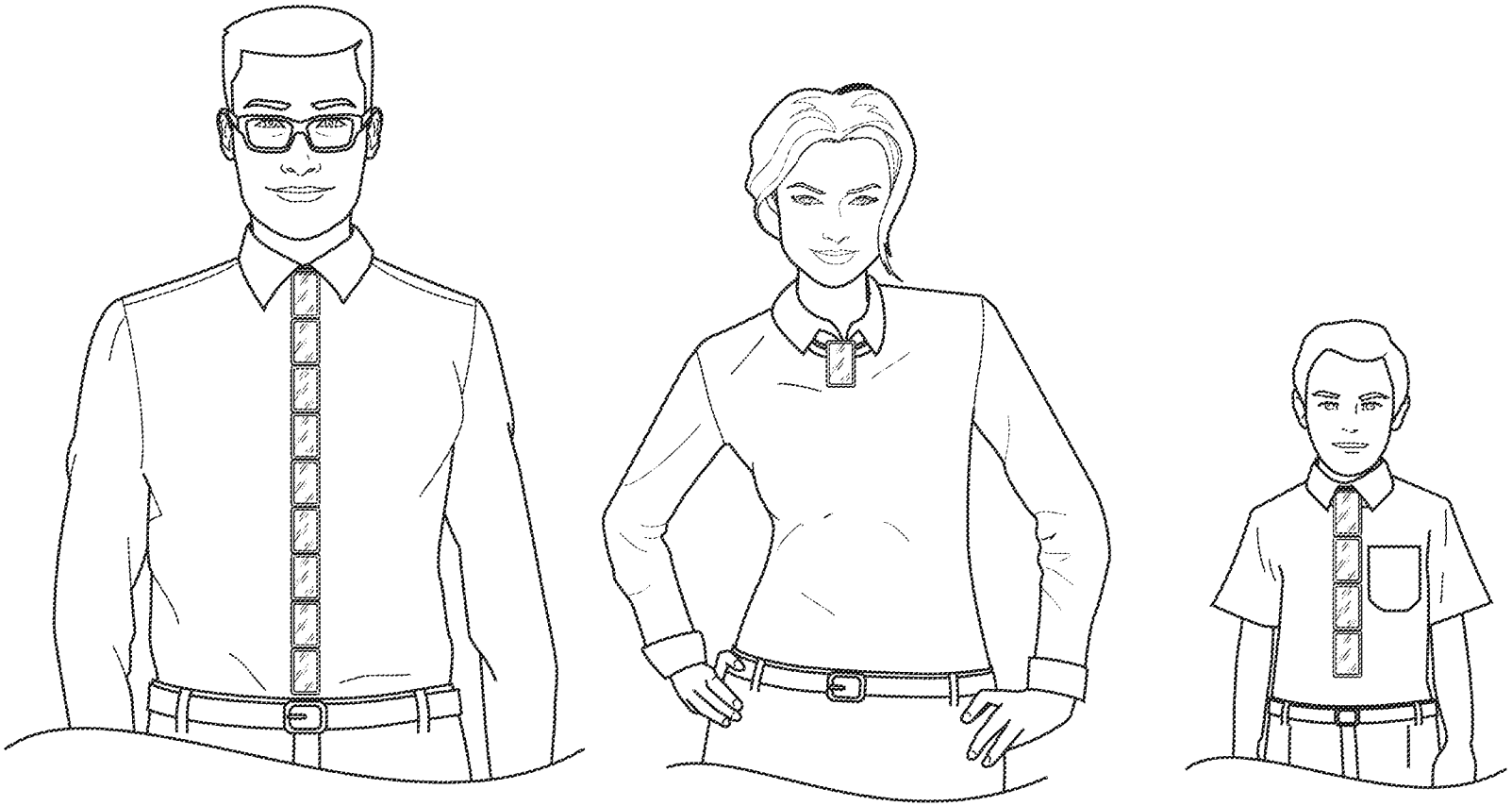
FIG. 1E is a front view of the neckwear of FIG. 1A worn by three people; each person utilizing a different length of the same neckwear.

A front perspective exploded view of one of the hermetically sealed, rounded-rectangle display segments (not one of the two display-clip segments 2, 6 as shown in FIG. 1D) of the exemplary embodiment of FIG. 1A is shown in the exemplary embodiment of FIG. 1B, and a rear perspective exploded view of said display segment is shown in the exemplary embodiment of FIG. 1C. This hermetically sealed display segment includes a metallic rounded-rectangle front frame 20, a rounded-rectangle glass pane 21, a rounded-rectangle silver bullion bar 22, and a metallic rounded-rectangle rear panel 23. The groove 24 on the rear panel 23, as shown in FIG. 1B, and the lip 25 on the front frame 20, as shown in FIG. 1C, are configured to fit one another for bonding. The rear panel 23 is one continually-casted metal piece conducive to a hermetically sealed display segment and, as shown in FIG. 1B, includes a compartment 26 to fit and secure the silver bullion bar 22.

As shown in FIG. 1B, the compartment 26 of the rear panel 23 is open at the front (facing the bullion bar 22) and is delimited by a back wall 27 and four sides of the inner frame 28. The inner frame 28 and the compartment 26 are configured to fit and secure the bullion bar 22. As shown in FIG. 1C, the glass pane 21 and the bonding plane 30 on the front frame 20 are configured to fit one another for bonding which is achieved by any method known in the art, including methods that form a hermetic seal. Glass and metal may be bonded together by purely mechanical means or by chemical interaction where the oxide layer on the metal surface forms a bond with the glass, which generally results in stronger joints. See, Donald, Ian W. Glass-to-Metal Seals. Society of Glass Technology, 2009. Depending on the level of hermetic seal desired, a second glass pane (not shown in FIGS. 1B and 1C) may also be bonded to the four portions of the bonding plane 29 on the rear panel 23 shown in FIG. 1B (e.g., in front of the bullion bar so that the bullion bar is in between the second glass pane and the compartment 26). To complete the seal of the display segment, the metallic front frame 20 and metallic rear panel 23 of the display segment are bonded with the lip 25 on the front frame 20 (in FIG. 1C) inserted into the groove 24 on the rear panel 23 (in FIG. 1B). This bonding process may be accomplished by any method known in the art such as soldering and/or the use of an epoxy. The bullion bar 22 is encapsulated in the display segment after this bonding. As shown in FIG. 1C, the back wall 27 of the rear panel 23 includes a first hinge member 31 and the second hinge member 32 of an improved take-apart fastener, as further discussed below, for connectivity to the remainder of the neckwear panel.

A vacuum condition may also be achieved within the hermetically sealed neckband module or display segment by methods known in the art to remove the minute amount of air that may exist within the sealed neckband module or display segment. Epoxy hermetic seal designs may be utilized for low or high vacuum pressures, effectively sealing gases to very low leak rates. See, Roth, Alexander. Vacuum Sealing Techniques. American Institute of Physics, 1994.

The hermetically sealed neckband module 9 of the neckwear shown in FIGS. 1A and 1D is a modified embodiment of the hermetically sealed display segment shown in FIGS. 1B and 1C, in which the first hinge member 31 at the top of the display segment has been eliminated, and the hermetically sealed display segment has been configured to include an aperture mechanism 35 (as shown in FIG. 1D) to accommodate the neckband 10 (as shown in FIG. 1A).

A hermetically sealed neckband module and hermetically sealed display segments prevent tarnishing of coins, medals or bullion bars that are susceptible to tarnishing and prevent wear and tear of the coins, medals and bullion bars from use of the neckwear regardless of the composition of the metal. These types of neckband modules and display segments are especially relevant for silver, copper and other types of metal that tarnish and for soft metals. The softer the metal, the more relevant preventing wear and tear becomes. For example, preventing wear and tear of fine silver and fine gold coins, medals and bullion bars in neckwear is more relevant than those comprised of platinum. A hermetically sealed display segment or hermetically sealed neckband module may be configured to further include a coin holder, coin capsule or bullion bar capsule (encapsulating the coin, medal or bullion bar) within the hermetically sealed display segment or the hermetically sealed neckband module.

FIG. 1D is a rear view of the exemplary embodiment of FIG. 1A demonstrating the connectivity of the rounded-rectangle neckband module 9 and eight intra-changeable, rounded-rectangle display segments 1-8 with an improved take-apart fastener (disclosed in U.S. patent application Ser. No. 15/384,540 and further discussed below), which has two hinge members. The first hinge member 33 and the second hinge member 34 are mounted to each of the eight display segments and the second hinge member 34 is mounted to the bottom of the neckband module 9. The improved take-apart fasteners have been put together and are locked thereby connecting all components of the neckwear panel. Both hinge members 33, 34 of all the improved take-apart fastener are essentially hidden from view of the casual observer when the neckwear is worn. The improved take-apart fastener exhibits all three aforementioned features of a suitable fastener for a neckwear panel including allowing one or more display segments to be quickly and easily intra-changed with other display segments. Moreover, a neckwear panel that utilizes an improved take-apart fastener (or other types of fasteners with similar features) allows display segments to be quickly and easily added or removed for variable lengths of a neckwear and interchanged with extrinsic display segments that a neckwear was not comprised of originally. Each of the eight rounded-rectangle display segments 1-8 of the neckwear shown in FIGS. 1A and 1D may be quickly and easily intra-changed with one another. The intra-changeability feature of the neckwear of this exemplary embodiment equates to more than 40,000 neckwear combinations of the eight display segments (8 factorial also recognized as 8!) affording the wearer a wide variety of neckwear appearances. Likewise, each of these eight display segments the neckwear comprised of originally may be interchanged with additional extrinsic display segments providing even greater versatility and potential neckwear combinations and fashion appearances.

As shown in FIG. 1D, the rear of the neckband module 9 has a mounted aperture mechanism 35 which is an opening to accommodate the neckband (neckband not shown in FIG. 1D) and to connect the neckband to the neckband module 9. Two display-clip segments have been placed at display segment two 2 and display segment six 6 which include a tie-clip-like mechanism 36. The composition of the aperture mechanism 35 on the neckband module 9 in FIG. 1D and in other exemplary embodiments herein may be a variety of suitable materials, including metals, metal alloys including steel, wood, fiber reinforced polymers and synthetic polymers such as plastics. An aperture mechanism may also be provided as part of a casting of the neckband module or may be provided by other methods. If not part of a casting, the aperture mechanism may be, for example, soldered to the neckband module. An aperture mechanism of the exemplary embodiments herein may be any size or shape other than the rectangular shape of the aperture mechanism 35 shown in FIG. 1D and of the aperture mechanism 62 shown in FIG. 2B. Other configurations, including an aperture mechanism with a curvature, may be more suitable for a given neckband type or composition.

In modified exemplary embodiments of FIGS. 1A-1D, the neckwear embodiment may not include any intra-changeable display segments or may include at least one intra-changeable display segment. The display segments 1-8 or neckband module 9 may also include a glass display window on the rear of the display segments, in which case the display segments and fasteners may be modified accordingly. For example, the frame of the display segments of the exemplary embodiments herein may be larger and/or the hinge members or fastener members may be smaller or positioned differently as to not impede the view of the coin, medal or bar such as positioning the hinge members (or other type of fastener members) on the sides of the display segments or on the top and bottom of the display segments.

It is understood that FIGS. 1A and 1D provide an exemplary eight display-segment configuration and this and other configurations of exemplary embodiments described herein are non-limiting examples. Since wearers of neckwear have different sized torsos and prefer different lengths of neckwear including that some wearers prefer the bottom of neckwear to end approximately at the beltline, the number of display segments a neckwear may originally comprise in the exemplary embodiments herein can be increased or decreased accordingly. For example, a tall person may prefer the neckwear in FIGS. 1A and 1D to originally comprise of ten display segments whereas a petite person may prefer six display segments. The length of each display segment also affects how many display segments a neckwear may originally comprise. For example, for a given sized torso and a desire for the neckwear to end approximately at the beltline, the number of display segments varies based on the length of the display segments. Of course the length of the display segments is a function of the size of the coins, medals or bullion bars that the display segments house.

In some exemplary embodiments, a single neckwear may be worn at various lengths in which display segments and/or torso segments are quickly and easily added, removed or replaced and, in terms of their position along the neckwear panel (below the neckband module), may be relocated or switched. For example, FIG. 1E illustrates the neckwear of FIGS. 1A and 1D worn in three different configurations: by a man in which the neckwear panel includes a neckband module and the eight display segments, by a woman in which the neckwear panel includes just a neckband module, and by a boy in which the neckwear panel includes a neckband module and three display segments. This feature, unlike the standard necktie and other types of neckwear resembling the necktie, renders the instant neckwear quite versatile and accommodating to a wide variety of people including people of both sexes and multiple sizes and age groups from children on up. Moreover, a single person can wear this neckwear, originally comprised of eight display segments, at nine different lengths. The shortest only utilizes the neckband module and the longest utilizes all eight display segments.

The size and shape of the front of the rounded-rectangle neckband module 9 and each of the eight rounded-rectangle display segments 1-8 of the neckwear in FIGS. 1A and 1D are the same. In this exemplary embodiment and other exemplary embodiments herein, the front of the neckband module and the front of each display segment are the same width and have two axes of symmetry (one vertically and one horizontally) resulting in the front neckwear panel also having two axes of symmetry. This unique geometric array for a neckwear maintains the neckwear's two axes of symmetry regardless of which display segments or how many display segments are intra-changed. Without disrupting the neckwear's symmetrical configuration, display segments the neckwear comprised of originally 1-8 may be rearranged in any order and/or may be removed from, and added back to, the neckwear panel for multiple neckwear lengths as desired by the user. These multiple potential neckwear and fashion appearances are achieved by the neckwear's symmetrical and intra-changeability features without any additional extrinsic parts or ornaments. Likewise, without disrupting the neckwear's two axes of symmetry, this geometric array also allows one or more interchangeable display segments (each of which may include uniquely engraved bars) to replace any of the display segments the neckwear comprised of originally and/or allows one or more interchangeable display segments to be added at any position along the neckwear panel (below the neckband module). In addition to these functional advantages, symmetry is an aesthetic feature of the neckwear.

Tying a perfectly symmetrical necktie is virtually impossible to accomplish. Even if the necktie knot is symmetrical, which is seldom achieved, necktie symmetry can rarely be accomplished since the fabric below the necktie knot often folds and crinkles in an unsymmetrical manner. Functional neckwear disclosed herein ending at the beltline and having two axes of symmetry, as compared to neckties rarely achieving one axis of symmetry, provides a formal or semi-formal fashion alternative to wearing a necktie or wearing a button-down shirt without a necktie. However, the invention is not limited in this way. A neckwear panel may be any length and may include any number of display segments and/or torso segments. A neckband module, display segments and torso segments may be various sizes including various widths. The neckband module, display segments and torso segments of any neckwear herein may be of any shape or size including rounded squares, squircles, squares, rounded rectangles, rectangles, ovals, circles, triangles, pentagons, hexagons, heptagons, octagons et cetera.

A neckwear may originally comprise of a neckband module without any display segments or a neckwear may originally comprise of a neckband module and any number of display segments, including one to forty or more display segments; of which, none or any number of the collective number of display segments of a neckwear may be intra-changeable display segments. Similarly, a neckwear may originally comprise of a neckband module and any number of torso segments, including one to forty or more torso segments; of which, none or any number of the collective number of torso segments of a neckwear may be intra-changeable torso segments.

A neckwear may also originally comprise of a neckband module and any numerical combination of display segments and torso segments. Any portion of the collective number of display segments and/or torso segments of a neckwear may be pivoting segments. Since the number of display segments and/or torso segments of a neckwear may vary based on the size of the neckband module, display segments, torso segments and other factors, including the wearer's preferences and the wearer's size (both of which may differ from person to person), a neckwear may originally comprise of a sufficient number of display segments and/or torso segments so that the neckwear ends approximately at the wearer's beltline, which is traditionally the preferred length of a necktie. A neckwear ending at the beltline satisfies the functions of a necktie including covering the front shirt placket and the front shirt buttons, bridging the gap between the shirt collars along the neckline, and being an important component of formal or semi-formal attire.

A neckwear may include at least one clip segment in some exemplary embodiments to limit undesired movement of a neckwear panel, including to curtail the neckwear panel from swinging forward or moving from side to side on the wearer during body movements, and to assist the neckwear to remain substantially straight on the wearer, as compared to a necktie and other types of neckwear resembling the necktie. Moreover, clip segment(s) assist in covering all of the front shirt buttons during body movements while a neckwear is worn. The clip segment(s) secure the neckwear to a shirt placket or front shirt panel without any additional unattached or unmounted accessories. In some embodiments, clip segment(s) are quickly and easily intra-changed by the wearer of the neckwear, at his or her sole discretion, with any of the other display or torso segments offering the wearer of the neckwear a personalized fit. The factors determining how many clip segments are utilized on the neckwear and the position to place the clip segment(s) on the neckwear include the size and shape of the wearer's torso. For example, for comfort and a neat appearance, as shown in FIG. 1D, the wearer may choose two display-clip segments and place one display-clip segment at segment position two 2 and the other display-clip segment at segment position six 6. This exemplary embodiment and other exemplary embodiments herein in which the neckwear includes intra-changeable display and torso segments allow the wearer to choose the number of clip segment(s) and the location of the clip segment(s) anywhere along the neckwear panel (below the neckband module), which is an important for a customized fit, especially for a metallic neckwear. This neckwear and other exemplary embodiments may include torso-clip segments in lieu of display-clip segments. If the wearer of the neckwear opts for two clip segments, for example, and the wearer always places the clip segments in the same positions, the aforementioned number of neckwear combinations in the embodiment of FIGS. 1A and 1D is reduced accordingly. The wearer also has the option of not connecting any clip segments even if the neckwear includes them.

The present inventor discovered that an ideal and efficient method of producing extraordinary metallic neckwear as a functional necktie alternative is by utilizing and displaying coins, medals and bars provided by the pressing method and he identified a need for neckwear to include capacity to display a set or series of coins, medals or bars. The pressing method (also known as the stamping or coining method) is efficient and unmatched in terms of providing metallic neckwear with exquisitely detailed designs. This method can replicate any image and engrave it on coins, medals or bullion bars for use in a neckwear. Metal blanks are first required in the pressing method. The blanks are provided by melting down the desired metal or metal alloy and emptying the molten metal into billets. The heated billets then proceed through an extruder which operates under pressure to fashion the heated forms into thin strips of soft annealed metal.

After the long thin strips of extruded metal have cooled, they are trimmed and may be done so using a hydraulic shearer and then rolled by a high pressure rolling machine until an exact desired thickness is achieved. From the rolled strips, a blanking press then punches out metal blanks to the size and shape desired of the coin, medal or bar to be subsequently engraved. Blanks must undergo certain steps prior to being engraved which include that a rimming machine removes the rough edges left by the blanking press and adds a raised rim to the blanks before they are burnished by a vibratory finishing machine and cleaned.

Before the engraving dies are produced to engrave (strike) the blank metal to produce coins, medals or bars with the desired designs and information, three-dimensional plaster sculptures of the desired designs and information may be produced. A plaster copy of the coin design is transferred onto a rubber disc to produce a positive image and then transferred onto an epoxy resin disc to produce a negative impression of the original design. A reducing machine works like a key cutter by following the contours of the original epoxy disc to engrave a smaller scale version onto a brass plate. The dies actually used to strike coins, metals or bars are copied from the reduced original design. A second reducing machine takes the brass plate and shrinks all of the information onto a steel die, called the matrix, which is the original die. Through a process known as hobbing, the matrix is copied to produce the master punch and then hobbed onto another blank die to produce working dies to engrave coins, metals or bars.

With each strike of the press, the impact of the dies on the blank within the collar forces the metal into the alcoves of the dies and engraves the coin, medal or bullion bar with the desired design and information on each side, the obverse and reverse. In addition the obverse on reverse sides, the edges of coins, medals or bars may also be engraved with desired designs and information which may include hallmarking. It will be appreciated by those skilled in the art that the foregoing description of the pressing method is a general description and exact methods may vary from mint to mint. Moreover, temperatures, timeframes, pressures and forces required for striking coins, medals and bars, and other particulars utilized in the pressing method depend on the specific metal or metal alloy of the coin, medal or bar being produced. For example, silver melts at approximately 962° C. and has a Vickers hardness of approximately 251 MPa whereas platinum melts at approximately 1,768° C. and has a Vickers hardness of approximately 400-550 MPa.

The pressing method of engraving coins, medals and bullion bars for use in a neckwear panel of the present disclosure imparts many advantages, as compared to other methods such as casting methods. Generally, there is greater control over quality, finishes, and uniformity including weight, with the pressing method. Most advantageous is the capability of producing exquisitely detailed designs with high quality finishes. These finishes include matt, proof, and reverse proof. For example, proof bullion bars, production methods of which are well known in the art which include highly polished dies, result in a frosted appearance on the higher fields of the surface of the bullion bar and a mirror-like finish on the lower fields of the surface of the bullion bar. Coins, medals and bullion bars provided by the pressing method may also be struck in high relief or ultra-high relief. The images on high relief coins, medals or bullion bars, generally extend above the outer edges of the coin, medal and bullion bar and those struck in ultra-high relief result in images that rise even higher. Popular examples produced by the United States Mint include the 2015 American Liberty High Relief gold coin and the 2009 Ultra High Relief Gold Double Eagle. High relief and ultra-high relief coins, medals or bullion bars elevate the level of detail that can be seen and felt on the image and are often described as works of art. Multiple levels of relief may be achieved. For example, coins, medals or bullion bars may include "3-dimensional" designs resulting from the artwork being sculpted in contoured multi-level relief.

Color may be added to a coin, medal or bullion bar by various methods known in the art. These include incorporating plating, enamels, epoxy, porcelains, paints and/or inks. Examples include gold plate may be applied to selected areas of an engraved design on a silver bullion bar for inclusion in a hermetically sealed display segment, and ink overlays can virtually duplicate a digital image on a silver coin. Coins, medals or bars may include any custom design element to display, promote, proclaim or represent, for example, artistic themes, musical themes or bands, books, movies, casts, cartoons, action figures, cites, states, countries, historical events or figures, mythological figures, ethnic or national heritage, family members, movements, political parties, law, religion, science, symbols, schools, universities, professions, organizations, trades unions, trade groups, companies, industries, corporate affiliations, trademarks, logos, clubs, proverbs, slogans, sports or sports teams, holidays, special events or occasions, and personal experiences.

An example of a coin series is the Platinum American Eagle series produced and sold by the United States Mint. The $100 face-value proof coin contains one ounce of platinum and each year, from 1997 to 2016, has featured an entirely unique design created by various artists on the reverse side of the coin. The obverse for this ongoing series has always included an engraved image of the Statue of Liberty and the year the coin was engraved by the mint. A six-year design sub-series of the one-ounce poof Platinum American Eagle, starting in 2009 and concluding in 2014, portrays the foundations of American democracy as found in the Preamble to the U.S. Constitution on the reverse of each of the six coins which features an entirely unique design. In addition to sales by the United States Mint for each current-year release of the Platinum American Eagle, the earlier years of the coin series are available on the secondary market.

An example of a coin set provided by a mint is the Fine Silver Coloured 5-Coin Set—Mythologies of the World: Gods of Maya (2015) sold by the Royal Canadian Mint. The reverse side of the first, second, third and fourth coins in the set features Itzamná, god of divination and writing, Ah Bolom Tzacab, god of royalty and lineage, Chaac, god of rain, and Kukulcán, god of creation, respectively. The obverse side of each of these four coins includes Queen Elizabeth II. The reverse side of the fifth coin features an aerial view the Parque Nacional de Tikal-Gran Plaza and the obverse side includes the official effigy of the Guatemalan government. All five coins in the set are official legal tender coins. Although this coin set included a display box to store the five coins when it was purchased from the Royal Canadian Mint in January 2017, a neckwear device to wear and display the coin set was not available from the Royal Canadian Mint nor was such a device otherwise available for this coin set or any other coin set. Each of the five coins in the display box arrived from the Royal Canadian Mint encapsulated in a coin capsule.

An example of a series of bullion bars provided by a mint is the Suisse Lunar Series produced by Produits Artistiques Métaux Précieux. Every year a new type of Lunar Series bullion bar is released featuring one of the twelve traditional Chinese zodiac animals: rat, oxen, tiger, rabbit, dragon, snake, horse, goat, monkey, rooster, dog, and pig. Each type of Lunar Series annual bullion bar is available in various sizes that comprise of either fine silver or fine gold. The obverse side and the reverse side of each bullion bar have different engraved views of the animal.

FIG. 2A is another exemplary embodiment of a neckwear, which includes a square neckband module 48 and eleven square display segments 37-47. Display segment one 37 is below the neckband module 48 and display segment eleven 47 is the terminal display segment. The neckband module 48 and each of the eleven display segments 37-47 have been configured to receive a coin and display the coin through a circular cutout display window. Each of the twelve coins 49-60 of the neckwear panel, which the neckwear comprised of originally, is engraved with a unique design (none of which are depicted). The compartment (which houses the coin) of the neckband module 48 and all eleven compartments of the eleven display segments 37-47 are the same dimensions and all twelve coins 49-60 are the same dimensions, which enables each of the twelve coins of the neckwear to be intra-changed with every one of the other eleven coins.

A rear view of the exemplary embodiment of the neckwear panel of FIG. 2A is shown in FIG. 2B. The components of the neckwear panel, the neckband module 48 and the eleven display segments 37-47, are connected by eleven identical hinges. Only one hinge is labeled in FIG. 2B; the hinge 61 connecting the neckband module 48 and display segment one 37. The hinges in this exemplary embodiment do not allow the display segments per se to be intra-changed or interchanged. Intra-changeability of the neckwear is accomplished by the user relocating each of the twelve coins 49-60 (as shown in FIG. 2A) among those in the neckband module 48 and the eleven display segments 37-47. The intra-changeability feature of the neckwear in this exemplary embodiment allows a number of neckwear combinations of the twelve intra-changeable coins equating to 12 factorial (12!), which affords the wearer a wide variety of neckwear combinations and appearances. Each of the twelve coins 49-60 included in the neckwear in the embodiment of FIG. 2A is an intra-changeable coin. Interchangeability of the neckwear is accomplished by the user replacing any of the twelve coins 49-60 the neckwear comprised of originally with extrinsic coin(s).

In a modified embodiment of the neckwear panel of FIGS. 2A-2C, the neckwear panel may utilize an improved take-apart fastener (as further described below) or other types of fasteners with similar connectivity features allowing the display segments to be quickly and easily intra-changed including the addition or removal of display segments for variable lengths of a neckwear (e.g., FIG. 1E) or interchanged with extrinsic display segments or torso segments that the neckwear was not comprised of originally. Indeed, any embodiment of a neckwear disclosed herein may include fasteners such as the improved take-apart fastener for display segment intra-changeability and interchangeability.

As shown in FIG. 2B, the rear of the neckband module 48 includes an aperture mechanism 62 which is an opening to accommodate the neckband and connect the neckband to the neckband module. Display segment four 40 comprises a display-clip segment which includes a tie-clip-like mechanism 63. As further described below, the top of the neckband module 48 and the top of each of the eleven display segments 37-47 includes a closure 64 (only two of the twelve closures are labeled in FIG. 2B; the closure 64 on the neckband module 48 and the closure 64 on display segment one 37).

A front view of the neckwear in FIG. 2A is shown in FIG. 2C in which the neckwear panel is being pivoted to the appropriate angle (e.g., approximately at least 90°) between display segment one 37 and display segment two 38 for access to the closure 64 at the top of display segment two 38. Removing this closure 64, as further described below, allows the user to have access to coin two 50 within display segment two 38. The neckband module and each of the other ten display segments in this exemplary embodiment include the same closure at the same location (which are not labeled in FIG. 2C) as display segment two 38.

Figure 2E:
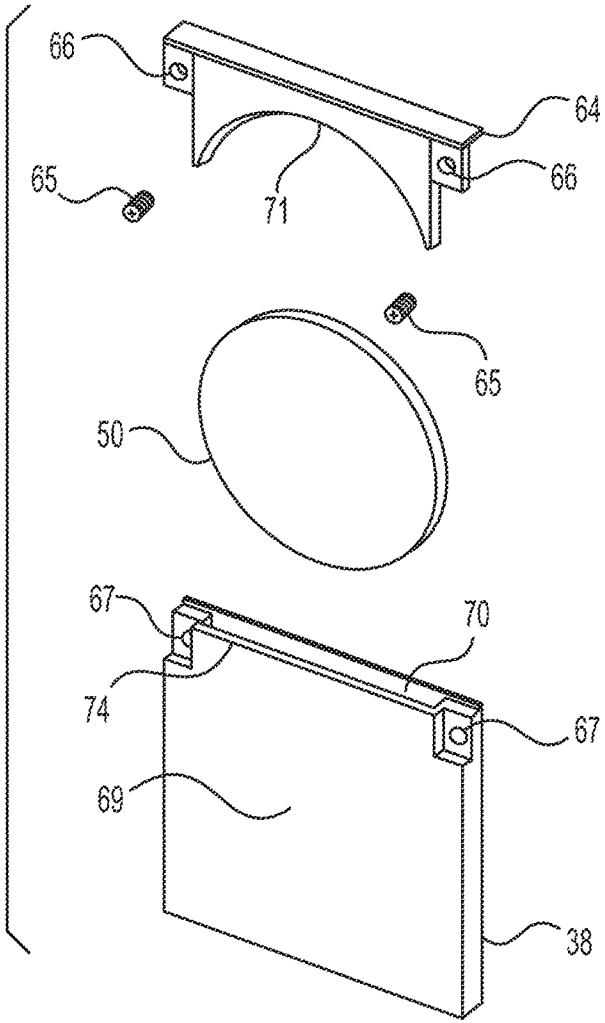
FIG. 2E is a rear perspective exploded view of said display segment.
Figure 2D:
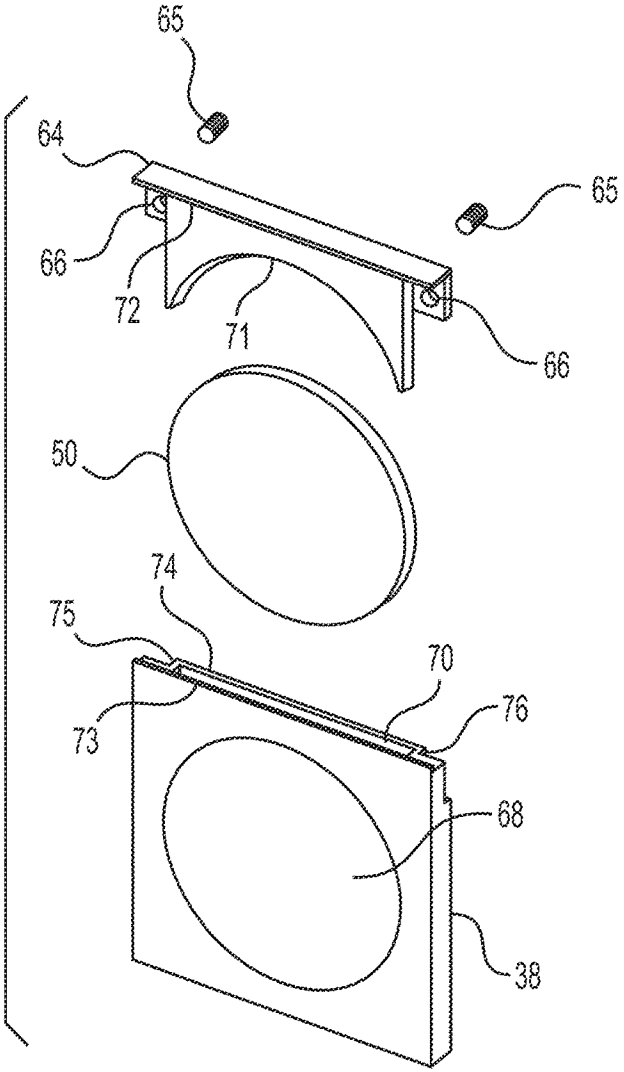
FIG. 2D is a front perspective exploded view of an exemplary embodiment of display segment two in FIG. 2C.

A front exploded view and a rear exploded view of display segment two 38 in FIG. 2C are respectively shown in FIGS. 2D and 2E. Two screws 65 are utilized to disconnect the closure 64 from the display segment. The screws go through two holes 66 on the closure 64 and are fastened to two receiving holes 67 on display segment two 38 (as shown in FIG. 2E). Coin two 50 is viewed through a cutout display window 68 at the front of display segment two 38. A display window is not included on the rear of display segment two 38, which includes a back wall 69 in this exemplary embodiment as shown in FIG. 2E. The closure 64 has been disconnected from display segment two 38 and coin two 50 has been removed through the opening 70 at the top of display segment two 38. To reinsert coin two 50 into display segment two 38, intra-change coin two with another coin the neckwear was comprised of originally (e.g., with coin one, three, four et cetera), or interchange coin two with an interchangeable coin or round, the user of the neckwear may insert any one of these coins through the opening 70 at the top of display segment two 38, and fit the closure 64 into the opening 70 at the top of the display segment. The closure may then be fastened to the display segment with the two screws 65. The hinge members for connecting display segment two 38 to other display segments are not included in FIGS. 2D and 2E.

As shown in FIGS. 2D and 2E, the bottom of the closure 64 includes the same curvature 71 as the coin 50. After the coin 50 is inserted into the opening 70 of the display segment 38 and the closure 64 is inserted into to the display segment 38 and attached by the two screws 65, the curvature 71 of the closure 64 supports the coin 50 and holds the coin in place inside the display segment. Upon the closure being attached and fastened to the display segment, the front of the top most panel 72 of the closure 64 is recessed behind the top 73 of the face of the display segment, which is higher than the other three portions surrounding the opening 70, the top 74 of the back wall 69 and the top of the two sides 75 and 76. This configuration renders the attached and fastened closure 64 hidden behind the top of the face 73 of the display segment 38 when the neckwear is directly viewed from the front by the casual observer.

The inside of the compartment of the display segment 38 that houses the coin 50 is configured to fit and secure the coin and is delimited by a back wall 69 (as shown in FIG. 2E), the curvature 71 of the closure, and two sides 75, 76, which are vertical to the horizontal floor inside the display segment. Other than the display window(s), the surfaces of the inside compartment of a display segment or neckband module (that houses a coin, medal or bullion bar) which come into contact with a coin, medal or bullion bar of the exemplary embodiments herein, such as the exemplary embodiments of FIGS. 1A-2P, may include a non-abrasive material such as leather to prevent wear and tear and maintain the condition of the coin, medal or bullion bar. If a display segment or neckband module includes a closure, the non-abrasive material may be included on the portion of the closure that comes in contact with the coin, medal or bullion bar. The configuration of the floor of the compartment may be straight across or may include a curvature to contour the coin. Of course, the exemplary embodiments of FIGS. 2A-2E, which utilize screws to fasten the closures to the display segments and neckband module, are just one example of a multitude of suitable types of fasteners.

Figure 2G:
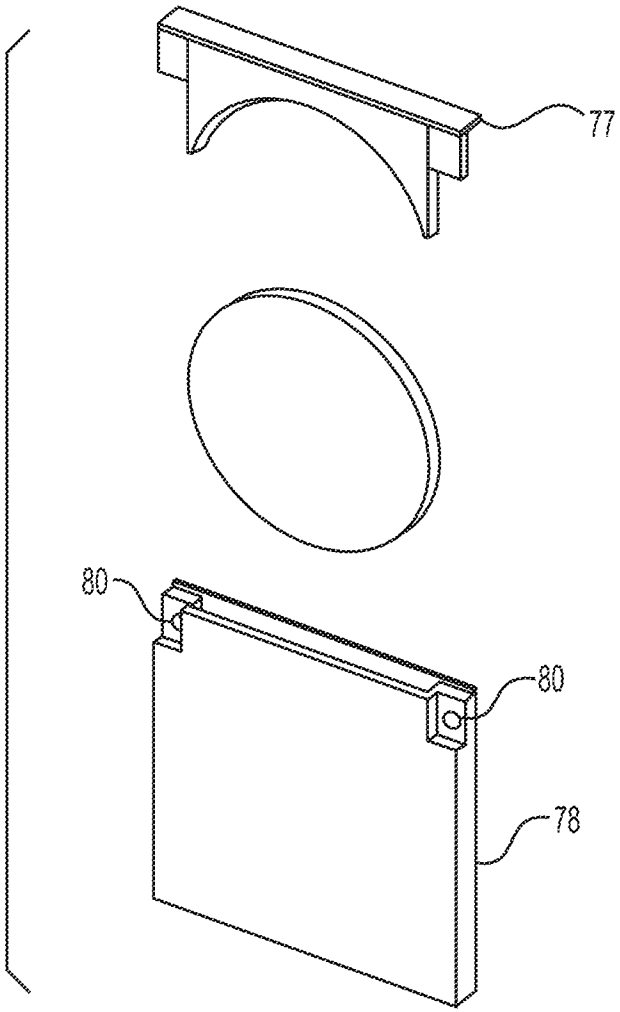
FIG. 2G is a rear perspective exploded view of said display segment.
Figure 2F:
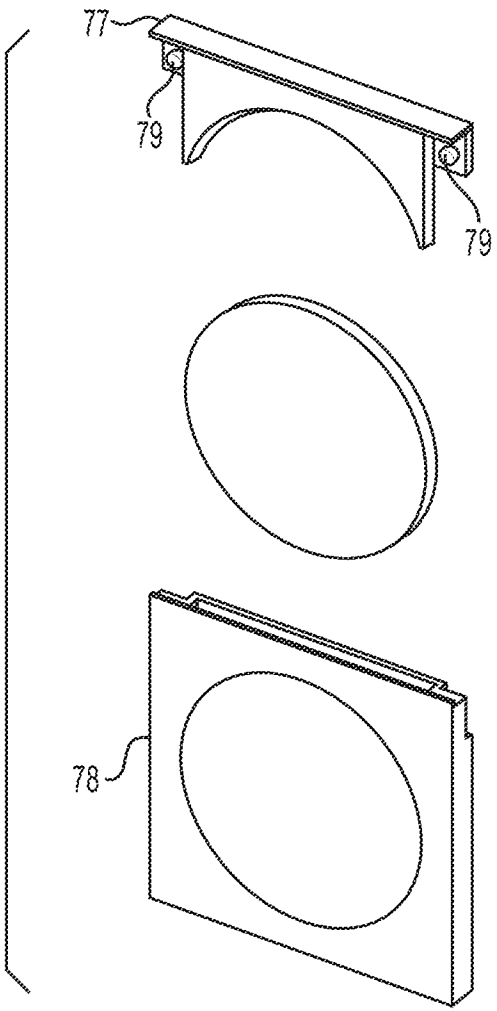
FIG. 2F is a front perspective exploded view of an exemplary embodiment of a display segment, which includes a closure that is quickly and easily connected and disconnected.

Although the type of closure for the display segments and neckband module in FIGS. 2A-2E does not allow the coins of the neckwear to be quickly and easily intra-changed or interchanged by the user, suitable closures also include any type of closure that allows the coins of a neckwear to be quickly and easily intra-changed or interchanged. For example, as shown in the exemplary embodiment of FIGS. 2F and 2G, which is a modified embodiment of FIGS. 2D and 2E, the closure 77 for the display segment 78 utilizes two snap fasteners which do not require any key, tool or the like to disconnect the closure 77 from the display segment 78. As shown in FIG. 2F, a front view of the display segment, two male portions 79 of two snap fasteners, sometimes referred to as studs, are included on each end of the closure 77. As shown in FIG. 2G, a rear view of the display segment, the corresponding two female portions 80 of the snap fasteners, sometimes referred to as sockets, are located on the back of the display segment. This closure 77 is quickly and easily fastened and unfastened by the user to intra-change or interchange coins by simply pushing the two studs 79 on the closure 77 into the two sockets 80 on the display segment 78. The fastener members (e.g., improved take-apart hinge) for connecting the display segment 78 to a neckband module or other display segments are not included in FIGS. 2F and 2G.

The determination of what type of closure that may be incorporated on a neckband module or display segment in the exemplary embodiments herein includes a tradeoff between level of security and ease of use. For example, utilizing screws to fasten the closure in the exemplary embodiment of FIGS. 2A-2E provides a higher level of security for the coins than the closure in the exemplary embodiment of FIGS. 2F and 2G; however, the closure in the exemplary embodiment of FIGS. 2F and 2G allows the coin to be quickly and easily intra-changed and interchanged.

Figure 2H:
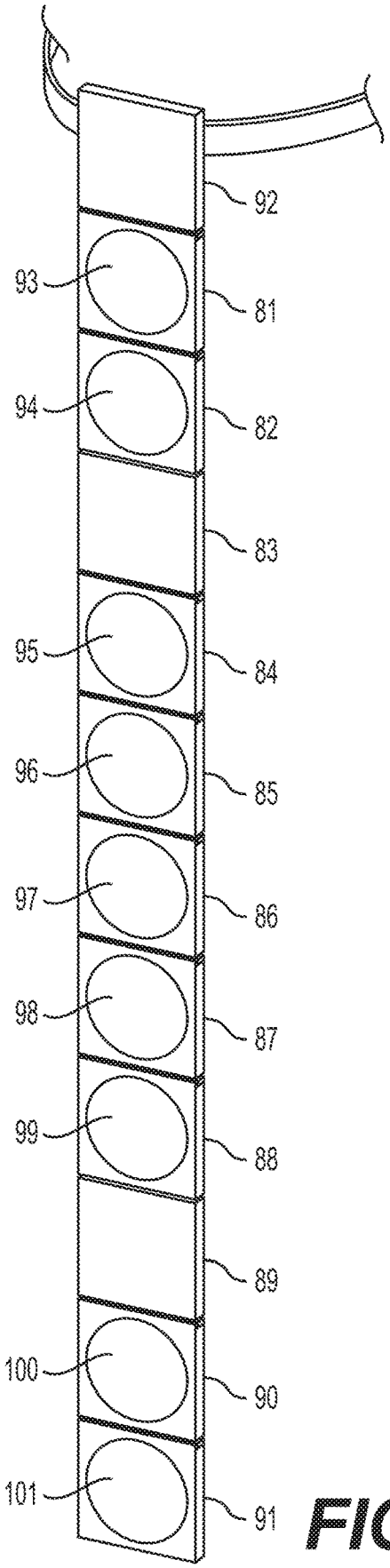
FIG. 2H is a front perspective view of an exemplary embodiment of a neckwear which includes display segments and torso segments.
Figure 2I:
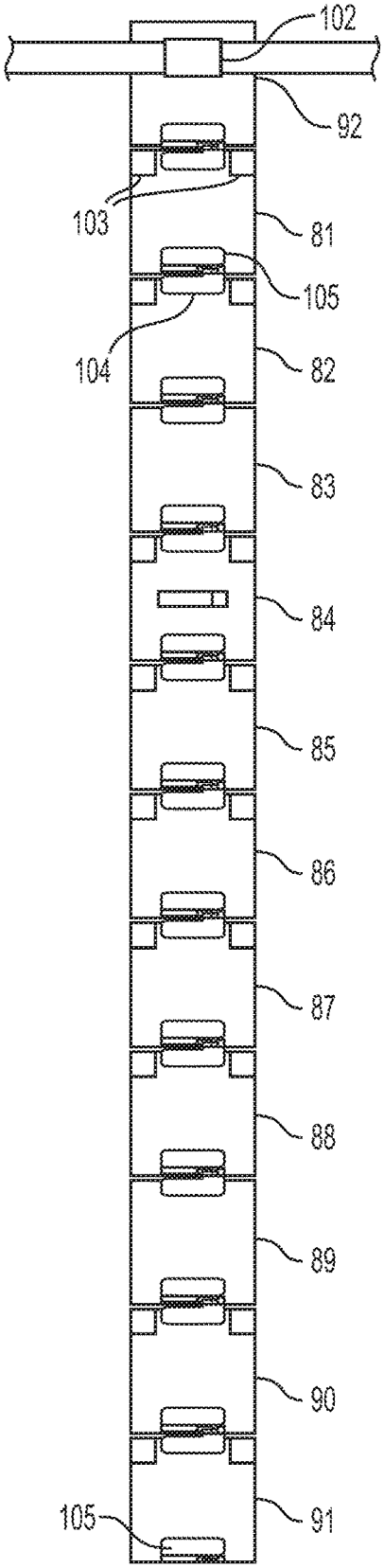
FIG. 2I is a rear view of said neckwear showing connectivity of the neckband module and intra-changeable display segments with an improved take-apart fastener.

A neckwear may include display segments and torso segments as shown in the exemplary embodiment in FIGS. 2H and 2I. Display segment one 81 is below the neckband module 92, display segment two 82 is below display segment one, torso segment three 83 is below display segment two, display segment four 84 is below torso segment three, display segment five 85 is below display segment four, display segment six 86 is below display segment five, display segment seven 87 is below display segment six, and display segment eight 88 is below display segment seven, torso segment nine 89 is below display segment eight, display segment ten 90 is below torso segment nine, and display segment eleven 91 which is the terminal display segment is below display segment ten. Nine coins 93-101, which are the same dimensions, are displayed to the casual observer of the neckwear by nine display segments 81-82, 84-88, 90-91, which are also the same dimensions, and have been configured to receive and display a coin. Each of the nine coins 93-101 is engraved with a unique design, none of which are not depicted in FIG. 2H. This neckband module 92 is not configured to receive or display a coin and, as shown in FIG. 2I, includes an aperture mechanism 102 to accommodate the neckband and to connect the neckband to the neckband module.

The display segments 81-82, 84-88, 90-91 of the neckwear shown in FIGS. 2H and 2I utilize the display segment and closure described above and shown in FIGS. 2F and 2G. The closure 103 on display segment one 81 is the only closure (of nine closures, one on each display segment) labeled in FIGS. 2H and 2I. This type of closure allows each of the nine uniquely engraved coins 93-101 to be quickly and easily intra-changed with one another through the respective closure on each of the nine display segments and interchanged with extrinsic coins that the neckwear was not comprised of originally. Each of the nine coins 93-101 included in the neckwear in this exemplary embodiment is an intra-changeable coin.

The components of the neckwear panel, which include the neckband module 92, nine display segments 81-82, 84-88, 90-91 and two torso segments 83, 89 in the exemplary embodiment shown in FIGS. 2H and 2I, are connected by eleven identical improved take-apart fasteners. Display segment eleven 91, the terminal display segment, also includes a second hinge member 105 at the bottom of the segment in order for this display segment to be intra-changeable with the other ten segments and for potential additional segments to be added to the neckwear. The only improved take-apart fasteners labeled in FIG. 2I are the first hinge member 104 and the second hinge member 105 connecting display segment one 81 and display segment two 82 and a second hinge member 105 at the bottom of the terminal segment 91. The improved take-apart fasteners, as further discussed below, allow the nine display segments and the two torso segments to be intra-changed and interchanged, including adding or removing display segments or torso segments for multiple lengths and fashionable appearances of the neckwear. In this exemplary embodiment, each of the nine display segments 81-82, 84-88, 90-91 is an intra-changeable display segment and each of the two torso segments 83, 89 is an intra-changeable torso segment allowing the wearer to choose from twelve different neckwear lengths including wearing only the neckband module 92. Each of the nine display segments may also be intra-changed with each of the two torso segments. Of course, in addition to the user being able to intra-change the eleven segments 81-91, intra-changeability of the neckwear may also be accomplished by the user intra-changing each of the nine coins 93-101 through each of their respective closures. The number of neckwear combinations from intra-changing the nine coins 93-101 equates to 9 factorial (9!) and the number of neckwear combinations from intra-changing the eleven segments 81-91 equates to 11 factorial (11!) affording the user a wide variety of neckwear combinations and appearances.

Figure 2L:
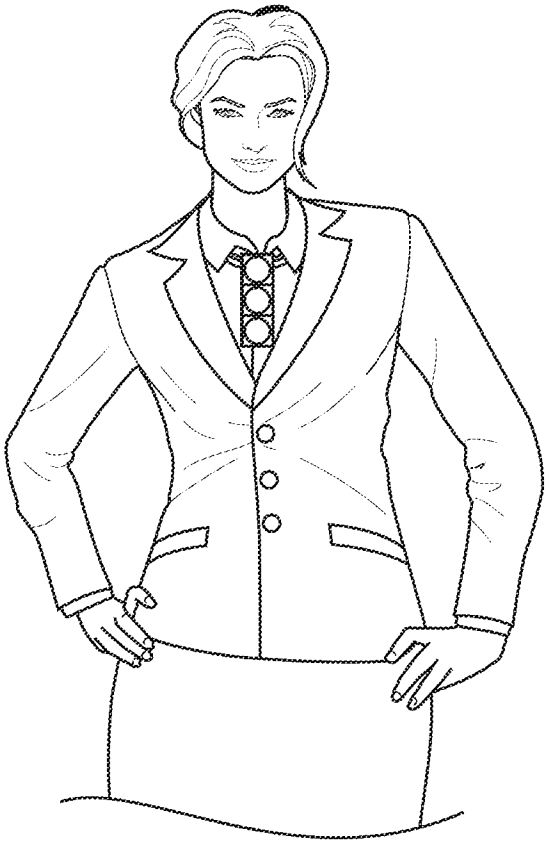
FIG. 2L is a front view of the neckwear on the woman in FIG. 2J and the neckwear now includes said two interchangeable display segments which have been added to the neckwear.
Figure 2K:
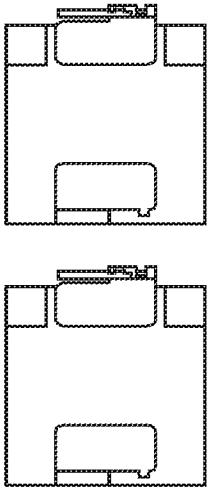
FIG. 2K is a rear view of an exemplary embodiment of two interchangeable display segments configured for said neckwear.
Figure 2J:
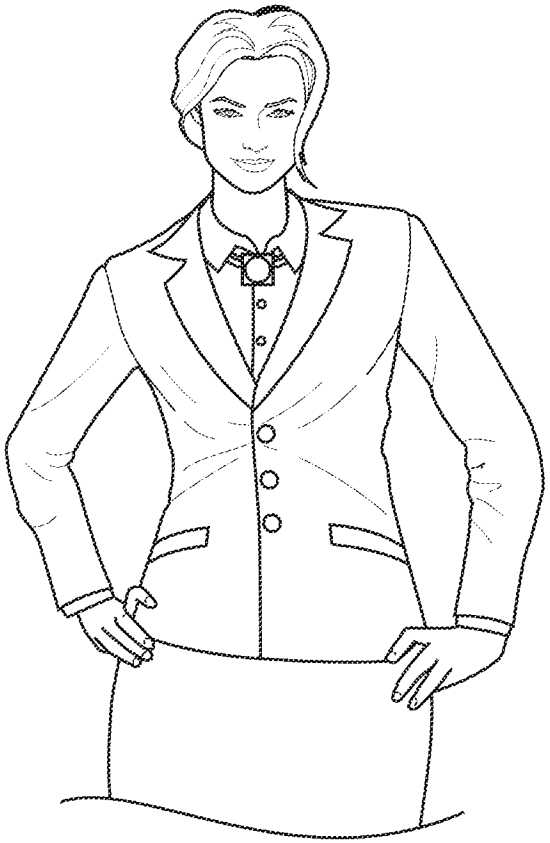
FIG. 2J is a front view of an exemplary embodiment of a neckwear including a neckband module (without any display or torso segments) worn by a woman.

An exemplary embodiment of a neckwear originally comprised of a neckband module (without any display or torso segments) worn by a woman is shown in FIG. 2J. The neckband module includes a coin (engraved design not depicted), a closure (not visible) at the top of the neckband module, and a second hinge member (female end) of an improved take apart fastener (not shown) at the bottom of the rear of the neckband module. This configuration of a neckwear allows interchangeable display or torso segments containing the same or different sized coins to be added to the neckband module, which renders the neckwear versatile as compared to other neckwear in the art. The wearer may add one or more interchangeable display or torso segments for multiple lengths of the neckwear. This is particularly important when a mint releases, for example, the first coin of a series or set of coins, before it releases subsequent coins of series or set, as is often the case.

The rear of two interchangeable display segments, each of which includes an improved take-apart fastener configured for the neckwear in FIG. 2J and a closure (which is quickly and easily connected and disconnected), is shown in the exemplary embodiment of FIG. 2K. FIG. 2L shows the neckwear of FIG. 2J on the same woman now including these two interchangeable display segments which have been added and connected to the neckwear by the improved take-apart fasteners. A neckwear that previously displayed a single coin (in FIG. 2J) now displays three coins (engraved designs not depicted), and the neckwear has the capacity to display additional coins by the wearer quickly and easily adding subsequent interchangeable display segments configured for the neckwear including display segments containing coins of a series or set. These interchangeable display segments connect to the terminal display segment of the neckwear (at the time), for example, by the first hinge member of an improved take-apart fastener at the top of the interchangeable display segment connecting to the second hinge member of an improved take-apart fastener at the bottom of the terminal display segment. This feature allows collectors to add coin(s), medal(s) or bar(s) to their neckwear as the individual members of a set or series are released by a mint over time. Of course, in addition to augmenting the length of the neckwear in FIG. 2J or FIG. 2L, each of the cumulative display segments (or torso segments) added to the neckwear may be rearranged in any order along the neckwear panel, and/or each of the coins along the neckwear panel may be rearranged in any order or flipped from obverse to reverse (or vice versa) by accessing the coins through the closure on the neckband module or on the display segments. These interchangeable display segments may also be temporarily removed and then added back to the neckwear, as desired by the wearer, to accommodate one's outfit for the day or occasion.

The size and shape of the front of the interchangeable display segments in FIG. 2K are the same as the size and shape as the front of the neckband module in the exemplary embodiment shown in FIGS. 2J and 2L. Although this advantageous geometric array for a neckwear maintains the neckwear's two axes of symmetry regardless of the segment position the user places each interchangeable display segment, interchangeable display segments may be different sizes or shapes provided the fasteners of the interchangeable display segments and the fasteners of the neckband module are configured for one another and lined up appropriately. For example, display segment one may be slightly wider (or narrower) than the neckband module and display segment two may be slightly wider (or narrower) than display segment one, et cetera. Of course, display segments of a neckwear having the same width does not mean that the compartments of the display segments, which house display inserts, coins, medals or bars, need to be the same width. In modified exemplary embodiments of the neckwear shown in FIGS. 2J-2L, the neckband module and/or any interchangeable display segments may be configured to be hermetically sealed or may be configured to accept display inserts, including accepting prior-art coin holders or capsules.

In addition to allowing the user to intra-change and interchange the coins, an advantageous feature of the display segments in the exemplary embodiments of FIGS. 2A-2L is that the user may easily flip over the coin in each display segment from the obverse side, as displayed to the casual observer of the neckwear when worn, to the reverse side, as displayed to the casual observer of the neckwear when worn or vice versa. Although the display windows of the display segments in the exemplary embodiments of FIGS. 2A-2L and the display windows of the neckband module in the exemplary embodiments of FIGS. 2A-2C and 2J-2L do not include glass display windows, in modified embodiments, the neckband module and/or one or more display segments include a glass display window. Moreover, in the exemplary embodiments of FIGS. 1A-1E, 2A-2C and 2J-2L in which the neckband module or display segments include one display window, in modified embodiments, the neckband module or display segments include two display windows, one in the front and one in the rear. In all these modified embodiments, the neckband module, display segments and the fasteners connecting them may be modified accordingly. Modifications include that for a given sized coin, medal or bar, the thickness (from front to back) of the neckband module or display segment may be increased to accommodate any glass display windows, and the type of fasteners connecting the neckwear panel and the positioning of these fasteners may also be modified for a neckband module or display segment including two display windows. For example, the fasteners or members of fastener may be positioned at the sides or bottom of the neckband module or display segments as to not impede the view of the coin, medal or bar from the rear of the neckband module or display segments. The size of the front and back frames around the display windows may also be modified. Of course, a neckband module or display segment may include any or all of these modifications even if the neckband module or display segment does not include a glass display window or does not include two display windows.

The exemplary embodiments of FIGS. 2A-2L (and as further described below the exemplary embodiments of 4A-4F, 5A-5D and 11A-11D) include display segments with closures. Any type of suitable closure that allows the user access to a coin, round, medal or bullion bar may be utilized for a display segment. A neckband module or display segment may be configured so that the closure may be situated at any position along the neckband module or display segment such as the closure being on the bottom or the sides of the neckband module or display segment. A closure may not completely detach from the neckband module or display segment and may open and close by a hinge connecting the closure to the neckband module or display segment.

Figure 2N:
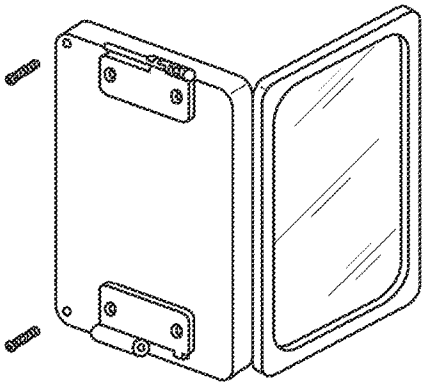
FIG. 2N is a rear view of said display segment.
Figure 2P:
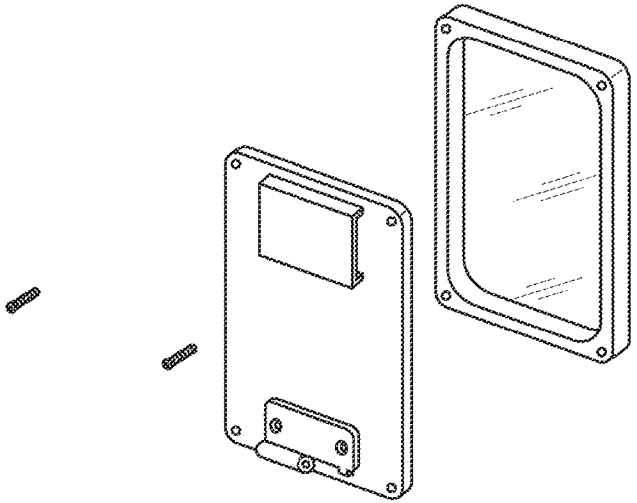
FIG. 2P is a rear view of said neckband module.
Figure 2M:
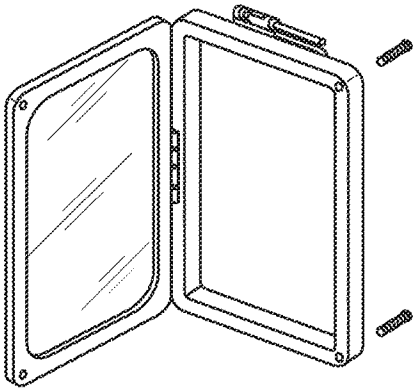
FIG. 2M is a front perspective view of an exemplary embodiment of a display segment resembling a clamshell container.

A neckband module or display segment may be also be configured in ways that differ from the exemplary embodiments of FIGS. 2A-2L (and as further described below the exemplary embodiments of 4A-4F, 5A-5D and 11A-11D). Indeed, any type of neckband module or display segment that secures and displays a coin, medal or bullion bar may be utilized for a neckwear including a neckband module or display segment which does not include a closure. For example, FIG. 2M is a front view of an exemplary embodiment of a display segment resembling a clamshell container consisting of two halves joined by a hinge which allows the display segment to open and close for the user to insert or remove a bullion bar. The front section of the display segment includes a glass display window. The two halves of the display segment are fastened together by screws. A clamshell type display segment may use a variety of fasteners to keep both portions of the display segment closed, including fasteners allowing the coin, medal or bullion bar to be quickly and easily intra-changed or interchanged such as snaps, self-locking tabs or by a friction fit mechanism. FIG. 2N is a rear view of the display segment which includes both members of an improved take-apart fastener on the back of the display segment for connectivity to a neckwear also configured with the improved take-apart fastener. This type of display segment may also be utilized as a neckband module which is configured to include an aperture mechanism to accommodate a neckband. Of course the improved take-apart fastener member at the top of the display segment is eliminated.

Figure 2O:
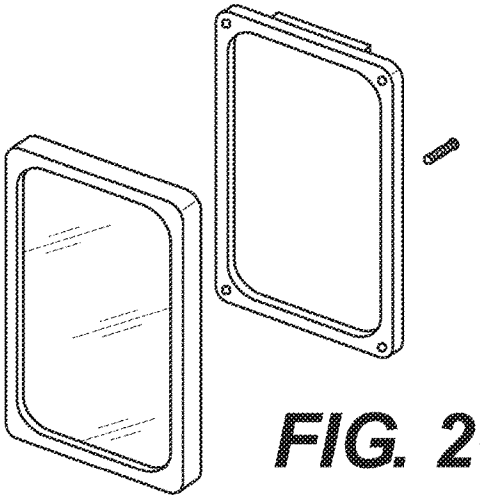
FIG. 2O is a front perspective view of an exemplary embodiment of a neckband module capable of connecting to interchangeable display segments.

Another example of a neckband module not including a closure is a neckband module with two sections (e.g., halves) which completely separate from each other for the user to have access to a coin, medal or bullion bar. FIG. 2O is a front view of an exemplary embodiment of two separated sections of a neckband module which fasten to each other by screws. The front section of the neckband module includes a glass display window to display a bullion bar. FIG. 2P is a rear view of the two separated sections of the neckband module which includes an aperture mechanism at the top of the rear section and a second hinge member of an improved take-apart fastener at the bottom of the rear section. Unlike bezels for a single coin, medal or bar, a neckwear panel originally comprising of a neckband module (without any display or torso segments such as shown in FIGS. 2O and 2P) which includes a member of an improved take-apart fastener, has the capacity for interchangeable display segments and interchangeable torso segments configured for the neckwear to be added to the neckwear. This feature allows the versatile neckwear to not only achieve multiple lengths, it provides the neckwear capacity to display additional bullion bars of a series or set as they are released over time such as the Suisse Lunar Series bullion bars discussed above. This style neckband module may also be utilized for a display segment in which the aperture mechanism is eliminated and a male member of an improved take-apart fastener is added. In modified embodiments, the display segment of FIGS. 2M and 2N and the neckband module of FIGS. 2O and 2P are configured for coins or medals. These display segments and neckband modules may be circular with round display windows or they may be square with round display windows. A neckwear may include multiple types of display segments such as with and without closures or may include different shapes of display segments. A neckwear panel may also include coins, medal and bullion bars.

This present inventor discovered that commercially available prior-art coin holders, coin capsules and bullion bar capsules are useful as display inserts for securing and displaying coins, medals or bullion bars in a neckband module and display segment of a neckwear. This novel use of these coin holders, coin capsules and bullion bar capsules is efficient to display and encapsulate coins, medals and bullion bars in a neckwear. Bullion, commemorative coins, and commemorative medals sold by mints are usually contained in coin capsules or bullion bar capsules when shipped from the mint. Most collector coins are stored in coin holders or coin capsules which offer protection from wear and tear and fingerprints on the metal. Although not hermetically sealed, coin holders, coin capsules and bullion bar capsules also reduce the rate of tarnishing, for example, of silver and copper coins and bars. Different sizes of coins, medals or bullion bars are efficiently displayed by a neckwear panel configured to house a single type of holder or capsule having the same outer dimensions but varying sized compartments for different sized coins, medals or bullion bars. This facilitates production of the neckwear panel since all display segments are uniform yet can house many different sized coins with a single type of coin holder, coin capsule or bullion bar capsule. Examples of prior-art coin holders and a bar capsule that may function as display inserts for use in a neckwear are shown in FIGS. 3A-3Q. These are commercially available for holding coins or bullion bars and were not previously intended, offered or used for a neckwear.

A circular prior-art Air-Tite coin holder (model: Direct Fit H32) 106 (also referred to as a coin capsule) is shown in FIG. 3A, which has been put together and contains a coin 107 (engraved design not depicted) the holder has been configured for. This round, rigid, clear coin holder is made of acrylic and consists of two parts. As shown in FIGS. 3B and 3C, the two disengaged parts of the coin holder comprise of the base 108 and cover 109, which have been configured to hold a coin 107. A top view of the base 108, compartment 110 facing up, and a top view of the cover 109, open side 111 facing up, are shown in FIG. 3D. The diameter of the compartment 110 of the base 108, which secures the encapsulated coin, is approximately 32.7 mm for this model coin holder. Coins having this diameter include the American Eagle One Ounce Gold Coin, Platinum American Eagle One Once Coin, and one ounce, 24 karat American Gold Buffalo, which are all produced by the United States Mint. As shown in FIGS. 3B and 3C, on and around the inside flap of the cover 109 are multiple evenly-spaced rectangular ridges 112. With the coin 107 inside the base 108, the cover 109 simply snaps onto the base 108 when pressure is applied to the cover, which causes the rectangular ridges 112 on the cover 109 to snap around the outer rim 113 (in FIG. 3D) of the base 108. To take apart the coin holder 106 and remove the coin sufficient force is applied between the edges of the cover 109, preferably with a fingernail or small lever, and the outer rim 113 of the base 108 until separation of the base 108 and cover 109 of the coin holder occurs allowing the user access to the coin.

The inner rim 114 around the base 108 in FIG. 3D acts as a gasket to tightly fit the aforementioned coins that are 32.7 mm in diameter into the approximate 32.7 mm (diameter) compartment 110. The overall outer diameter of the direct fit H32 model coin holder is 44.45 mm. In addition to the H32 model, various other commercially available direct fit models of Air-Tite coin holders also have an overall outer diameter of 44.45 mm, but have varying diameters of their respective compartments, which include H27 (compartment diameter approximately 27 mm), H34 (compartment diameter approximately 34 mm), H38 (compartment diameter approximately 38.1 mm) H39 (compartment diameter approximately 39 mm), and H40.6 (compartment diameter approximately 40.6 mm). Indeed, during the manufacturing process, an inner rim can be positioned anywhere along the base of these 44.45 mm (overall outer diameter) coin holders for any size compartment (up to approximately 40.6 mm in diameter) to fit custom designed (in terms of engraving, other design elements and dimensions including thickness) rounds, medals or bars.

It is important to note that despite the brand name, Air-Tite coin holders, these coin holders are not "air tight," which is also the case with other coin holders referenced herein. When this holder is put together, the gaps between the rectangular ridges 112 around the inside of the flap of the cover 109 and the base 108 allow environmental air to reach the coin. In experiments, Weimar W. White exposed silver dollars and copper coins encapsulated in coin holders to high levels of hydrogen sulfide gas, which is a common environmental contaminant causing coins to tarnish. The purpose of these experiments was to evaluate if in fact the coin holders were air tight. Air-Tite coin holders were one type of holder evaluated. Mr. White observed that even though the silver dollars and copper coins were in coin holders, they quickly tarnished after the coin holders containing these coins were exposed to high levels of hydrogen sulfide gas, which confirms that coin holders are not air tight, including the Air-Tite coin holder. See, White, Weimar W. Coin Chemistry Including Preservation and Cleaning, Third Edition. American Sports Media, 2012.

Another example of a circular Air-Tite coin holder (model: direct fit AE$/H-40) 115 (also referred to as a coin capsule) is shown in FIG. 3E, which has been put together and contains a coin 116 (engraved design not depicted) this holder has been configured for. Like the Air-Tite H32 model described above, the two disengaged parts of this model coin holder comprise of the base 117 and cover 118, as shown in FIGS. 3F and 3G. A top view of the base 117, compartment 119 facing up, and a top view of the cover 118, open side facing up, are shown in FIG. 3H. This Air-Tite AE$/H-40 model coin holder does not have an inner rim around the base (as do the Air-Tite H32 model and other models described above). The diameter of the compartment 119 of the base 117 on the Air-Tite AE$/H-40 model is approximately 40.6 mm which is also the diameter of the outer rim 120. An example of a coin having this diameter includes the American Eagle One Ounce Silver Coin produced by the United States Mint, which tightly fits around the outer rim 120 thereby rendering an inner rim unnecessary.

Figure 3I:
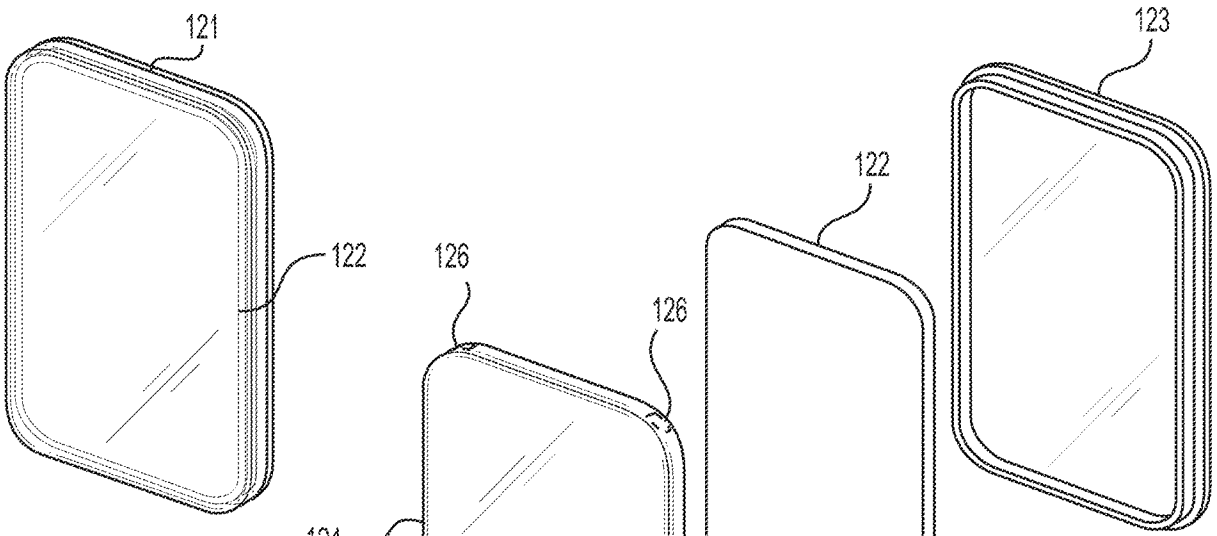
FIG. 3I (PRIOR ART)
FIG. 3I is a front perspective view of a prior-art bar holder that has been snapped together and configured for a bullion bar which is included within said holder.
Figure 3J:
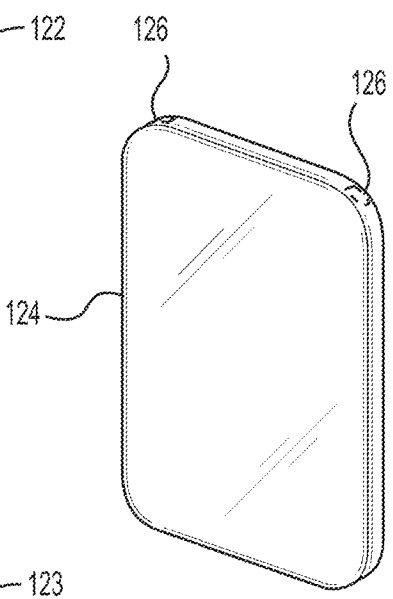
FIG. 3J (PRIOR ART)
FIG. 3J is a front perspective view of said bar holder which has been taken apart showing the cover and base of said bar holder and said bullion bar.
Figure 3K:
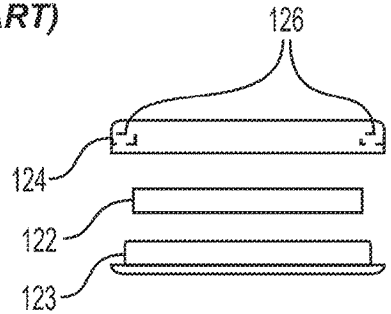
FIG. 3K (PRIOR ART)
FIG. 3K is a front view of the said cover, base and bullion bar.
Figure 3L:
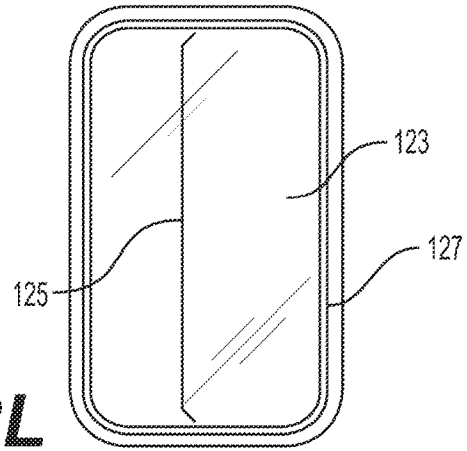
FIG. 3L (PRIOR ART)
FIG. 3L is a top view of said base of said bar holder.

An example of a holder which is not configured for a coin or round and that may function as a display insert for use in a neckwear is shown in FIG. 3I. This is a rounded-rectangle bar holder 121 (Air-Tite direct fit Bar model) for a rounded-rectangle bar, which has been put together and contains a bullion bar 122 (engraved design not depicted). Like the models for coins discussed above, this bar holder is rigid, clear acrylic and consists of two parts. This bar holder is also referred to as a bullion bar capsule or bar capsule as are other bar holders in the art. As shown in FIGS. 3J and 3K, the two disengaged parts of this bar holder comprise of the base 123 and cover 124. A top view of the base 123, compartment 125 facing up, is shown in FIG. 3L. As shown in FIGS. 3J and 3K, on and around the inside flap of the cover 124 are multiple, evenly-spaced rectangular ridges 126. With the bullion bar 122 inside the compartment 125 of the base 123, the cover 124 simply snaps onto the base 123 when pressure is applied to the cover, which causes the rectangular ridges 126 on the cover 124 to snap around the outer rim 127 of the base 123. This Air-Tite direct fit bar holder does not have an inner rim around the base (as does the Air-Tite H32 model); the outer rim 127 fits and secures the bullion bar 122 within the compartment 125. The length and width of the compartment 125 of the base 123 are 50.42 mm by 29.41 mm. This bar holder fits one-once silver bullion bars such as the 999 silver bullion bar produced by Sunshine Minting, Inc.

Figures 3M, 3N, 3O:
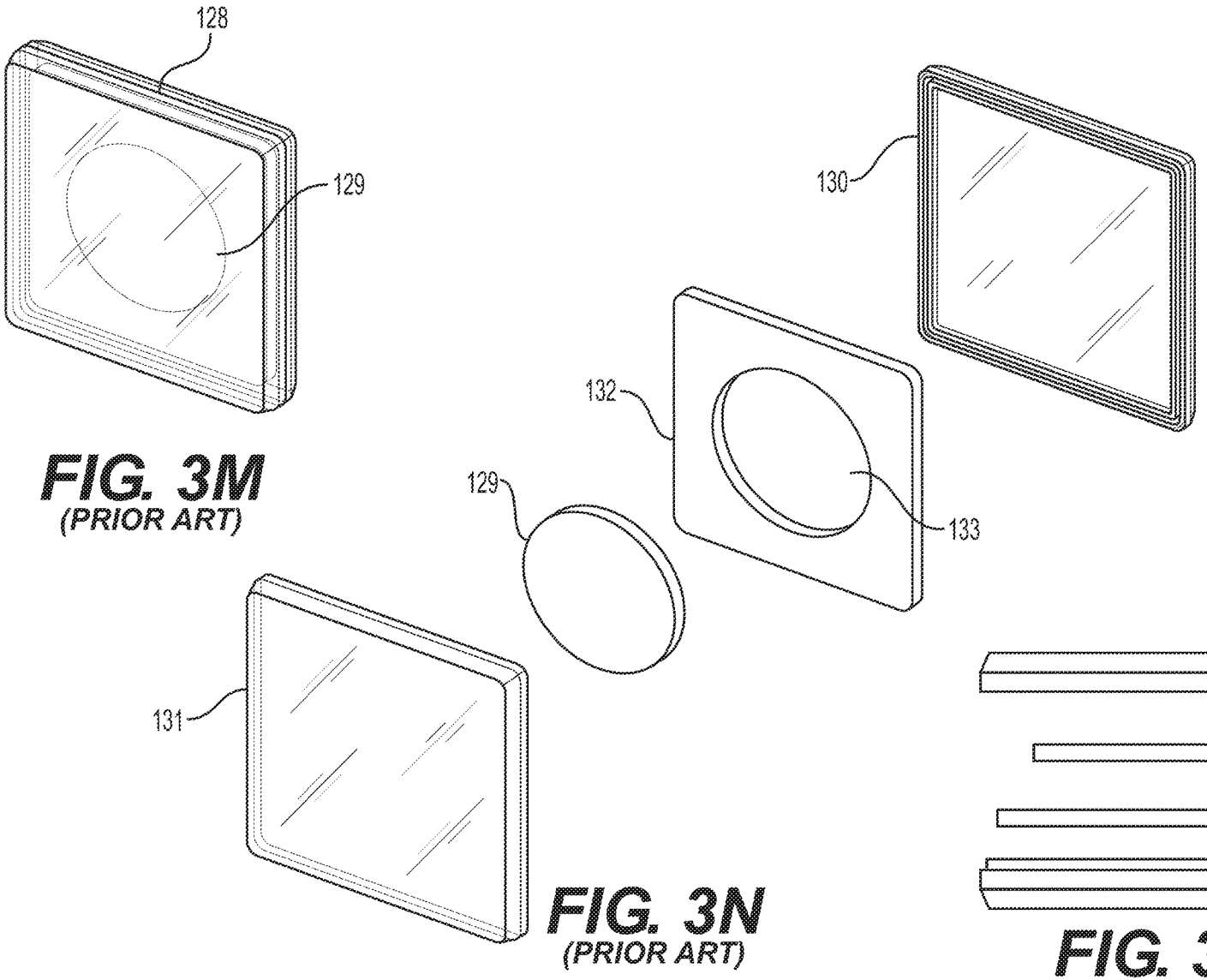
FIG. 3M (PRIOR ART)
FIG. 3N (PRIOR ART)
FIG. 3O (PRIOR ART)
FIG. 3M is a front perspective view of a prior-art coin holder with gasket that has been snapped together and configured for a 27 mm coin which is included within said holder.
FIG. 3N is a front perspective view of said coin holder which has been taken apart showing the cover, gasket and base of said coin holder and said coin.
FIG. 3O is a front view of the said cover, gasket, base and coin.

Another example of a type of commercially available coin holders that may function as display inserts for use in a neckwear is the Quadrum® Intercept Snaplock Holder with Black Gasket. These rounded-square coin holders are available in many models and each model includes a foam gasket with a different size circular opening (inner diameter) starting at an inner diameter of 14 mm, and increasing in increments of 1 mm, through 41 mm (with the exception of 24 mm and 40 mm inner diameter gaskets). This range of gasket sizes results in the capability of this type of coin holder to fit, secure and display virtually any size coin or round. The overall outer dimensions of this type of coin holder, regardless of the model and inner diameter of the gasket, are approximately 5.1 cm 5.1 cm. The 27-mm model 128, which has been put together containing a 27 mm coin 129, is shown in FIG. 3M. As shown in FIGS. 3N and 3O, this coin holder includes two engagable, rigid, clear-plastic parts consisting of the base 130 and cover 131, which interlock by snapping them together. A 27 mm diameter coin 129 (engraved design not depicted) fits inside the 27 mm (diameter) circular opening 133 of the foam gasket 132 which secures the coin 129 within the coin holder. The one-half ounce Chinese Gold Panda produced by the China Banknote Printing and Minting Corporation (CBPM) and the American Eagle One-Half Ounce Gold Coin produced by the United States Mint are examples of coins that fit this model coin holder.

Figure 3P:
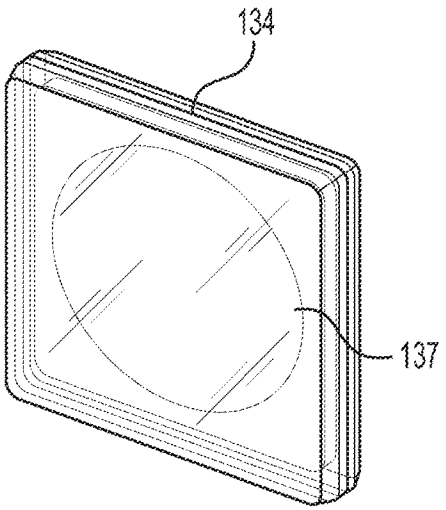
FIG. 3P (PRIOR ART)
FIG. 3P is a front perspective view of a prior-art coin holder with gasket that has been snapped together and configured for a 38 mm coin which is included within said holder.
Figure 3Q:
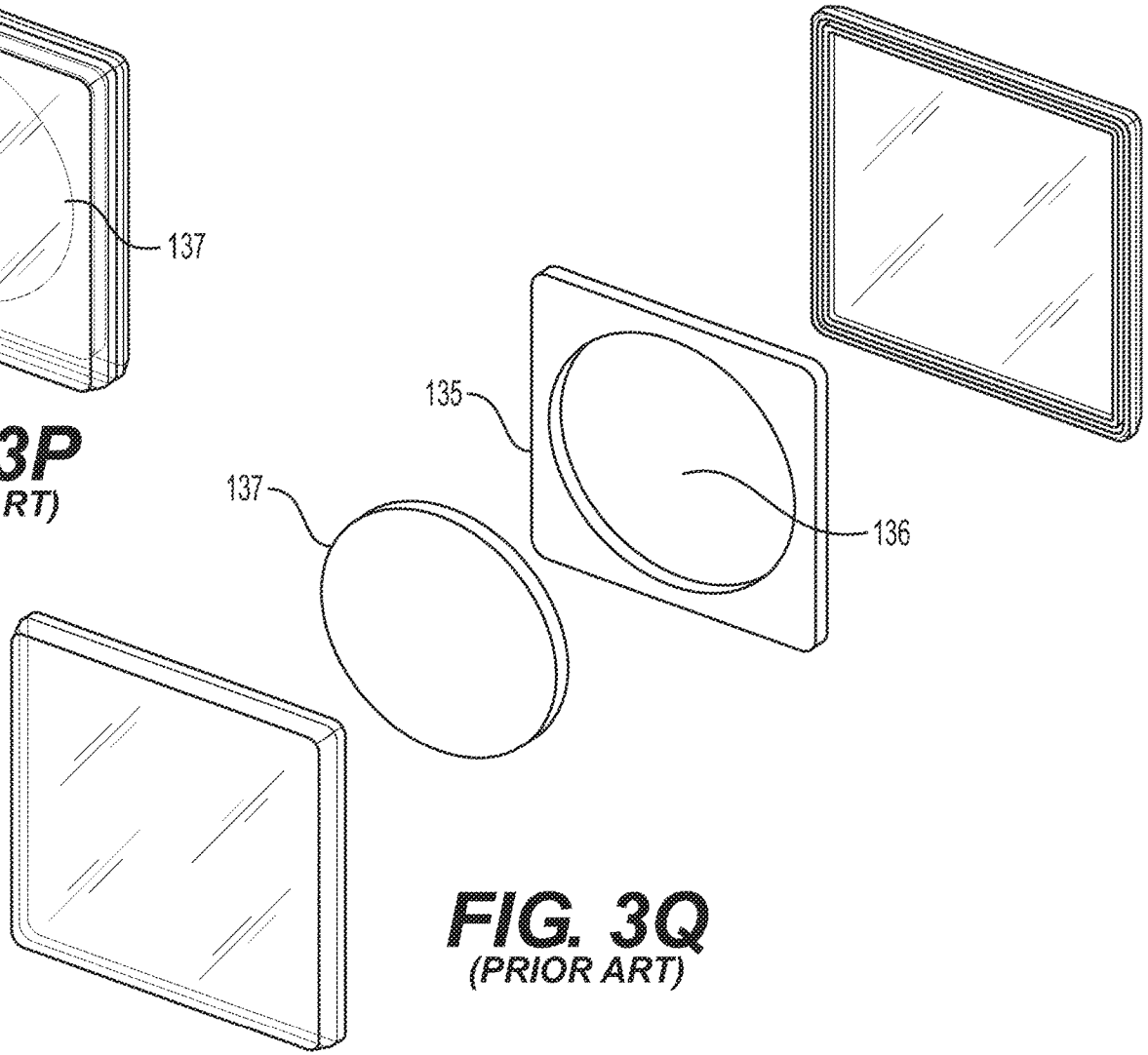
FIG. 3Q (PRIOR ART)
FIG. 3Q is a front perspective view of said coin holder which has been taken apart showing the cover, gasket and base of said coin holder and said coin.

The 38-mm model of the Quadrum® Intercept Snaplock Holder with Black Gasket 134 is shown in FIGS. 3P and 3Q. The gasket 135 has a 38 mm (diameter) circular opening 136 which fits a 38 mm (diameter) coin 129 (engraved design not depicted) and secures the coin in the coin holder. An example of a coin 137 that fits the gasket 135 of this coin holder is the one-ounce Silver Maple Leaf produced by the Royal Canadian Mint. The overall outer dimensions of this coin holder are the same as various other models, including the 27-mm model described above.

Figure 4B:
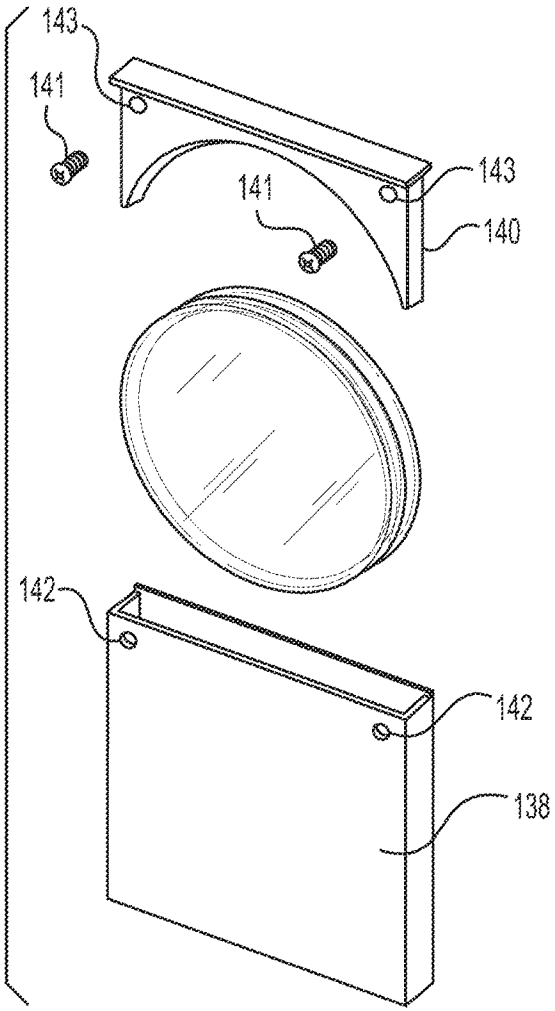
FIG. 4B is a rear perspective view of said display segment.
Figure 4A:
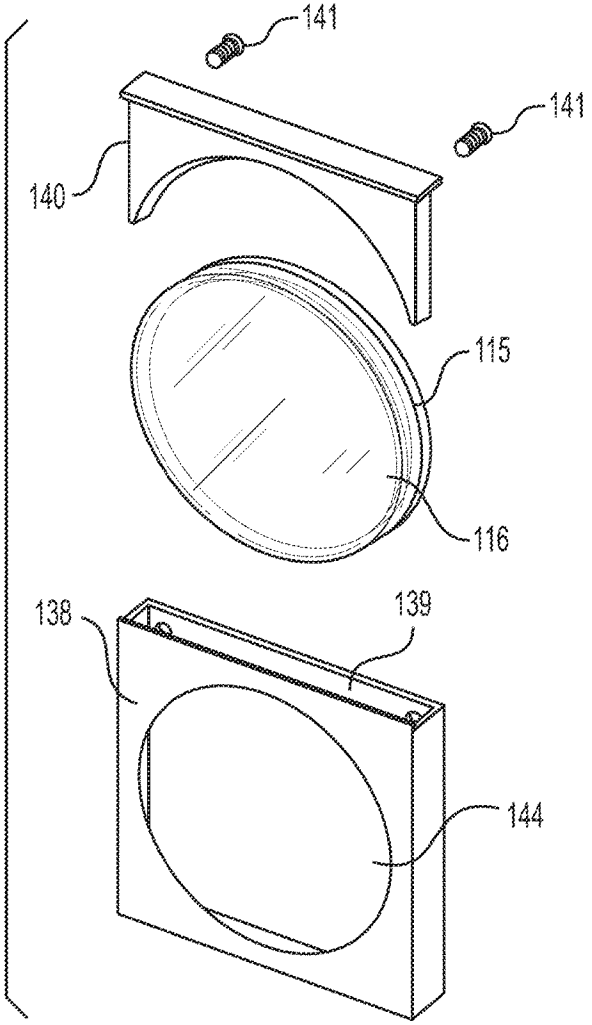
FIG. 4A is a front perspective view of an exemplary embodiment of a display segment configured to fit and secure the coin holder in FIGS. 3E-3H.

A display segment 138 configured to fit and secure the coin holder 115 including coin 116 described above and in FIGS. 3E-3H is shown in the exemplary embodiment of FIGS. 4A and 4B, which is a modified embodiment of the display segment in FIGS. 2D and 2E. A front perspective view of the display segment is shown in FIG. 4A and a rear perspective view of the display segment is shown in FIG. 4B. The opening 139 of the display segment 138 shown in FIG. 4A is larger to accommodate the thicker coin holder, as compared to just the coin. The closure 140 utilizes two screws 141 which are fastened through the two receiving holes 142 on the back of the display segment 138 and through the two receiving holes 143 on the closure. The positioning of both sets of receiving holes 142, 143 may streamline the width of the display segment as compared to the positioning of these holes 66, 67 in FIG. 2E. The diameter of the cutout display window 144 is approximately 40.6 mm which is the diameter of the largest coin capable of being encapsulated by the aforementioned models of this coin holder. This display segment 138 will also accommodate all of the other aforementioned Air-Tite models, which all have an overall outer diameter of 44.45 mm. In modified embodiments of FIGS. 4A and 4B, the width and length of the display segment approximately matches the diameter of the display window and coin encapsulated in the coin holder, which results in a more streamlined display segment.

Figure 4D:
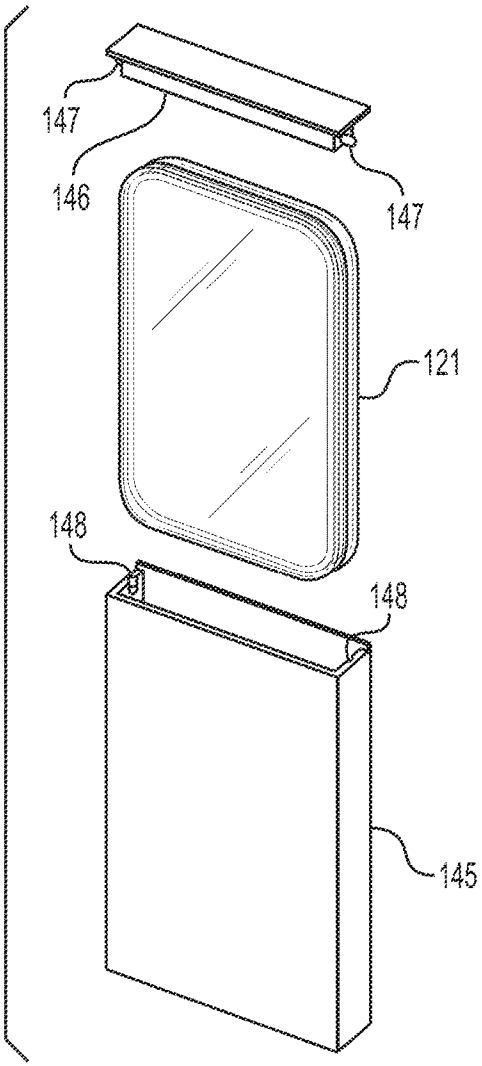
FIG. 4D is a rear perspective view of said display segment.
Figure 4C:
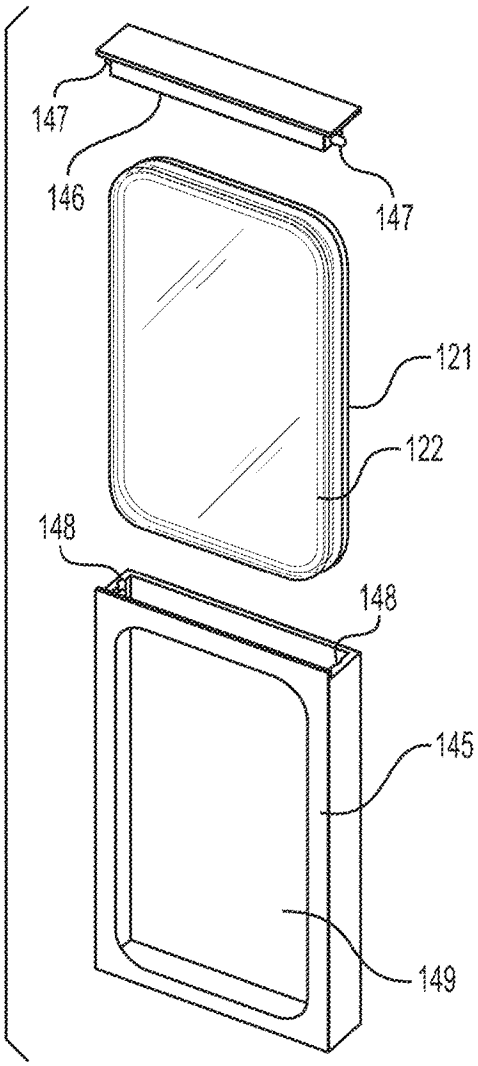
FIG. 4C is a front perspective view of an exemplary embodiment of a display segment configured to fit and secure the bar holder in FIGS. 3I-3L.

A display segment 145 configured to fit and secure the bar holder 121 including bar 122 described above and in FIGS. 3I-3L is shown in the exemplary embodiment of FIGS. 4C and 4D, which is a modified embodiment of the display segment in FIGS. 4A and 4B. A front perspective view of the display segment is shown in FIG. 4C and a rear perspective view of the display segment is shown in FIG. 4D. As compared to the display segment 138 in FIGS. 4A and 4B, the display segment 145 in FIGS. 4C and 4D accommodates a rounded-rectangle bar holder and the bottom of the closure 146 is flat. As shown in FIG. 4C, each end of the closure 146 includes two spring pins 147 which fit into two pin sockets 148 toward the top of the display segment 145 to fasten the closure to the display segment. The closure is opened by sliding the closure toward either end of the display segment 145, which releases one of the two spring pins 147. This closure 146 is another example of a closure that allows the contents in a display segment to be quickly and easily intra-changed and interchanged. In this example, it is a bar holder 121 containing a bullion bar 122. The cutout display window 149 is a rounded rectangle having dimensions of 50.42 mm by 29.41 mm which are length and width of the compartment 125 on the base 123 of the bar holder in FIG. 3L.

Figure 4F:
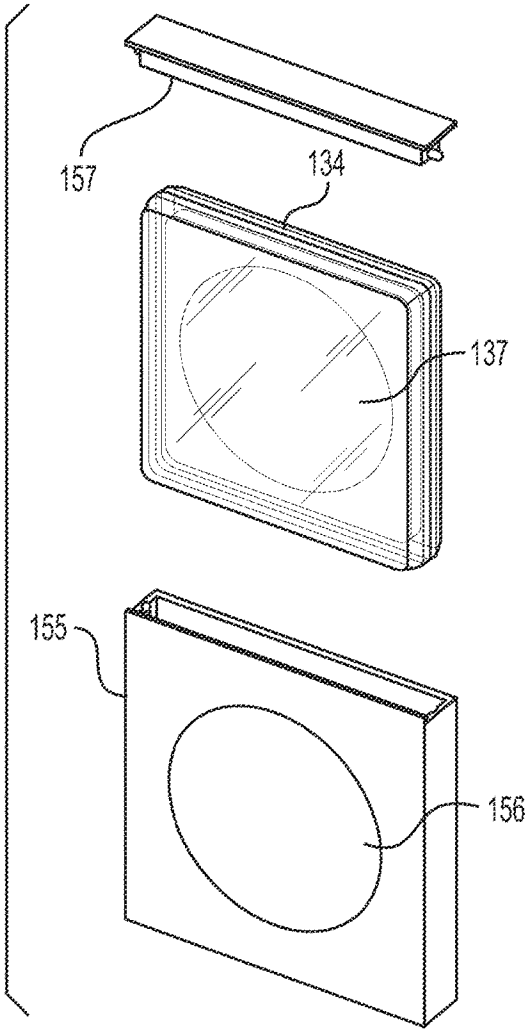
FIG. 4F is a front perspective view of an exemplary embodiment of a display segment configured to fit and secure the coin holder in FIGS. 3P and 3Q.
Figure 4E:
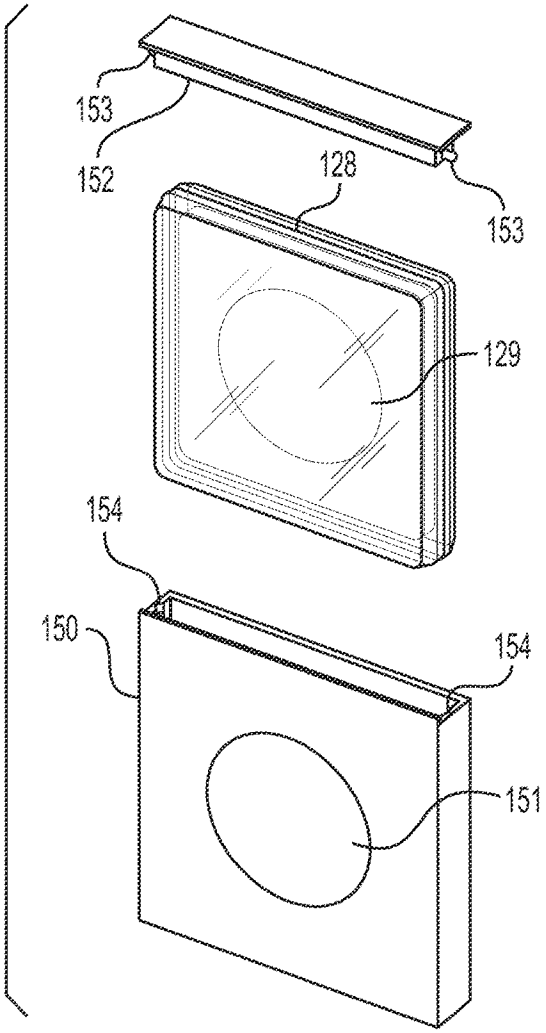
FIG. 4E is a front perspective view of an exemplary embodiment of a display segment configured to fit and secure the coin holder in FIGS. 3M-3O.

A front perspective view of a display segment 150 configured to fit and secure the coin holder 128 including coin 129 described above and in FIGS. 3M-3 is shown in the exemplary embodiment of FIG. 4E, which is a modified embodiment of the display segment in FIGS. 4C and 4D. As compared to the display segment 145 in FIGS. 4C and 4D, the display segment 150 in FIG. 4E accommodates a rounded-square coin holder 128. The diameter of the cutout display window 151 is 27 mm which matches the diameter of the coin 129 in FIGS. 3M-3O Like the closure in FIGS. 4C and 4D, this closure 152 fastens to this display segment 150 by two spring pins 153 which fit into two pin sockets 154 allowing the coin holder 128 to be quickly and easily intra-changed or interchanged.

A display segment 155 configured to fit and secure the coin holder 134 including coin 137 described above and in FIGS. 3P and 3Q is shown in the exemplary embodiment of FIG. 4F, which is a modified embodiment of the display segment in FIG. 4E. As compared to the display segment 150 in FIG. 4E, the display segment 155 in FIG. 4F has a larger cutout display window 156 (diameter of 40.6 mm), which matches the diameter of the coin 137 and is large enough to accommodate most coins Like the display segment in FIG. 4E, the closure 157 in FIG. 4F fastens to the display segment 155 by two spring pins which fit into two pin sockets allowing the coin holder 134 to be quickly and easily intra-changed or interchanged.

The exemplary embodiments of display segments herein, including those shown in FIGS. 2D-2G and 4A-4F may also be utilized as neckband modules modified accordingly, including they are configured to include an aperture mechanism to accommodate a neckband and the fastener member at the top of the display segments is eliminated.

Figure 5A:
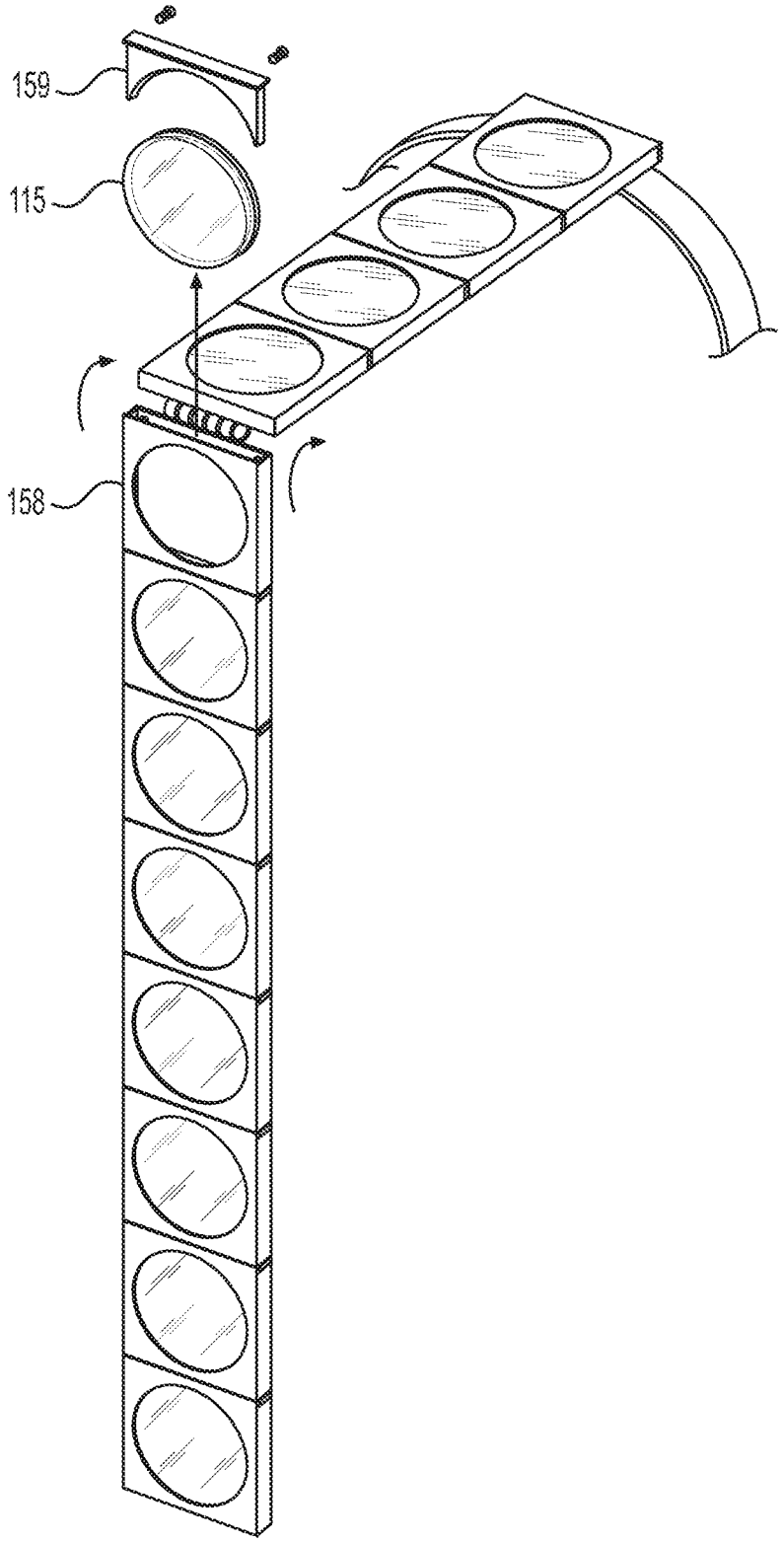
FIG. 5A is a front perspective view of an exemplary embodiment of a neckwear including the display segments of FIGS. 4A and 4B in which the neckwear panel is angled backwards above display segment four for access to the coin holder.
Figure 5B:
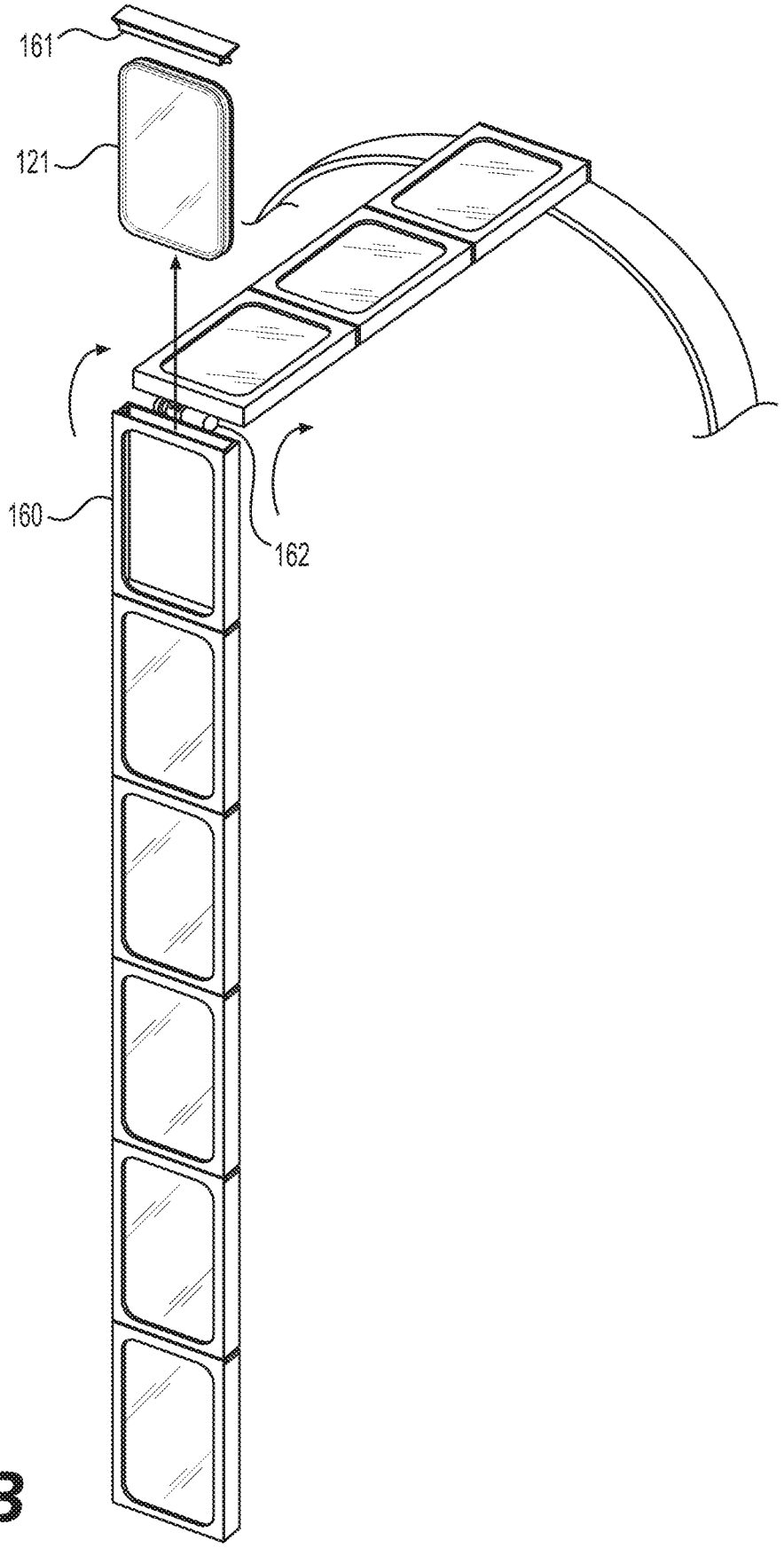
FIG. 5B is a front perspective view of an exemplary embodiment of a neckwear including the display segment of FIGS. 4C and 4D in which the neckwear panel is angled backwards above display segment three for access to the bar holder.

A neckwear including eleven display segments of FIGS. 4A and 4B is shown in the exemplary embodiment of FIG. 5A. The square neckband module with a circular cutout display window is connected to a series of square display segments with circular cutout display windows.

The neckband module and each of the eleven display segments includes the coin holder 115 of FIGS. 3E-3H and a uniquely engraved coin (engraved designs not depicted). The neckwear is angled above display segment four 158 as shown by the two arrows. The closure 159 for display segment four 158 has been disconnected and the coin holder 115 containing the coin has been removed from the display segment, as depicted by the straight arrow. Every display segment of the neckwear, including display segment four 158, has the capability to fit and secure a round display insert having an overall outer diameter of approximately 44 mm, including the coin holder 106 of FIGS. 3A-3D and other Air-Tite models described above. This feature of the neckwear provides tremendous versatility for intra-changing and interchanging display inserts, including the above coin holders, for an extensive number of potential neckwear combinations and fashion appearances. Display inserts for a neckwear include commercially available coin holders and display inserts specifically configured and manufactured for a neckband module or display segments of a neckwear.

A neckwear, including the display segment and closure of FIGS. 4C and 4D, is shown in the exemplary embodiment of FIG. 5B. The rectangular neckband module with a rounded-rectangular cutout display window is connected to a series of rectangular display segments with rounded-rectangular cutout display windows. The neckband module and each of the eight display segments contains the bar holder 121 of FIGS. 3I-3L and a uniquely engraved bar (engraved designs not depicted). The neckwear is angled above display segment three 160 as depicted by the two arrows. The closure 161 of display segment three 160 has been disconnected and the bar holder 121 (containing a bullion bar) has been removed from the display segment, as depicted by the straight arrow. This type of closure 161 (described above), also included on the neckband module and all other display segments of this neckwear, allows all nine bar holders housed in the neckwear panel to be quickly and easily intra-changed with one another or interchanged with extrinsic display inserts. This neckwear includes the improved take-apart hinge 162 (as further described below) across the rear of neckwear panel, which also allows the display segments of the neckwear to be intra-changed and interchanged, including that the neckwear may be worn at nine different lengths. These features of the neckwear provides tremendous versatility enabling an extensive number of potential neckwear combinations and fashion appearances.

The size and shape of the front of the neckband module and each of the display segments of the neckwear in FIG. 5B are the same. In this exemplary embodiment and other exemplary embodiments herein, the front of the neckband module and the front of each display segment are the same width and have two axes of symmetry (one vertically and one horizontally) resulting in the front neckwear panel also having two axes of symmetry. This unique geometric array for a neckwear maintains the neckwear's two axes of symmetry regardless of which display segments or how many display segments are intra-changed. Without disrupting the neckwear's symmetrical configuration, display segments the neckwear comprised of originally may be rearranged in any order and/or may be removed from, and added back to, the neckwear panel for multiple neckwear lengths as desired by the user. These multiple potential neckwear and fashion appearances are achieved by the neckwear's symmetrical and intra-changeability features without any additional extrinsic parts or ornaments. Likewise, without disrupting the neckwear's two axes of symmetry, this geometric array also allows one or more interchangeable display segments to replace any of the display segments the neckwear comprised of originally and/or allows one or more interchangeable display segments to be added at any position along the neckwear panel (below the neckband module). In addition to these functional advantages, symmetry is an aesthetic feature of the neckwear.

Figure 5C:
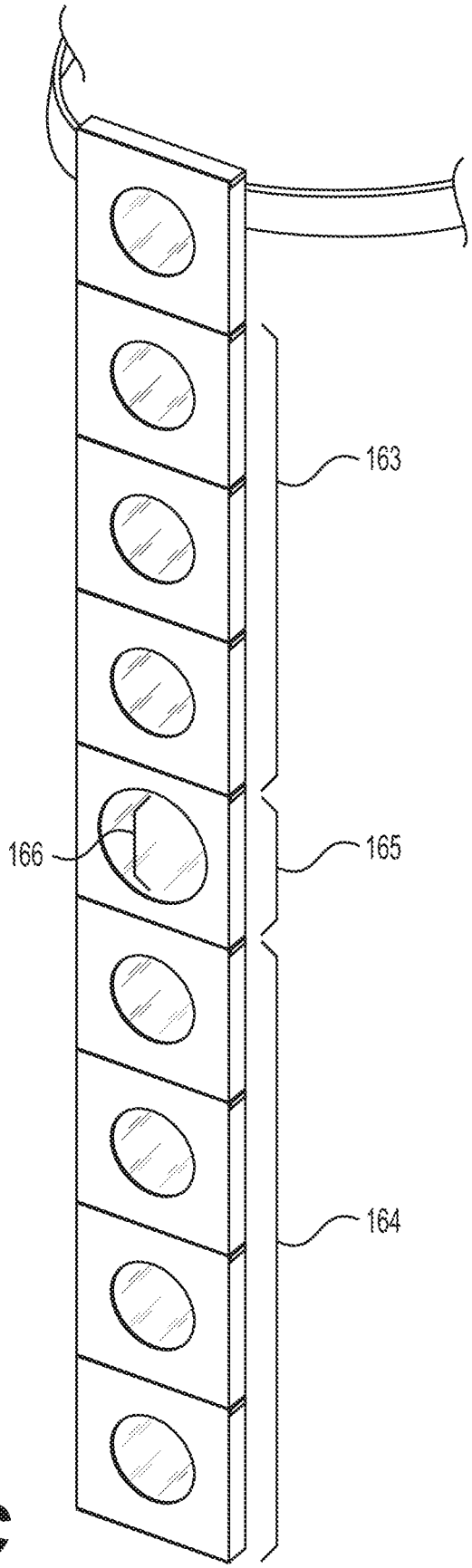
FIG. 5C is a front perspective view of an exemplary embodiment of a neckwear including the display segment and coin holder of FIG. 4E and the display segment and coin holder of FIG. 4F.

A neckwear including the display segment 150, closure 152 and coin holder 128 of FIG. 4E and the display segment 155, closure 157 and coin holder 134 of FIG. 4F is shown in the exemplary embodiment of FIG. 5C. The square neckband module with a circular cutout display window is connected to a series of square display segments with circular cutout display windows. The neckband module includes the closure 152 and coin holder 128 of FIG. 4E. Each of the nine coin holders contains a uniquely engraved coin in which the design is not depicted. Display segment one through three 163 and display segment five through eight 164 shown in FIG. 5C comprise the display segment 150 in FIG. 4E. Display segment four 165 shown in FIG. 5C comprises the display segment in FIG. 4F. The diameter of the cutout display windows of the neckband module and display segments (only the diameter of the display window 166 of display segment four 165 is labeled) corresponds to the inner diameter of the gaskets of the coin holders in the neckband module and display segments. In modified embodiments of a neckwear, the diameter of the display windows of all the display segments and the neckband module are constant across the neckwear panel.

Figure 5D:
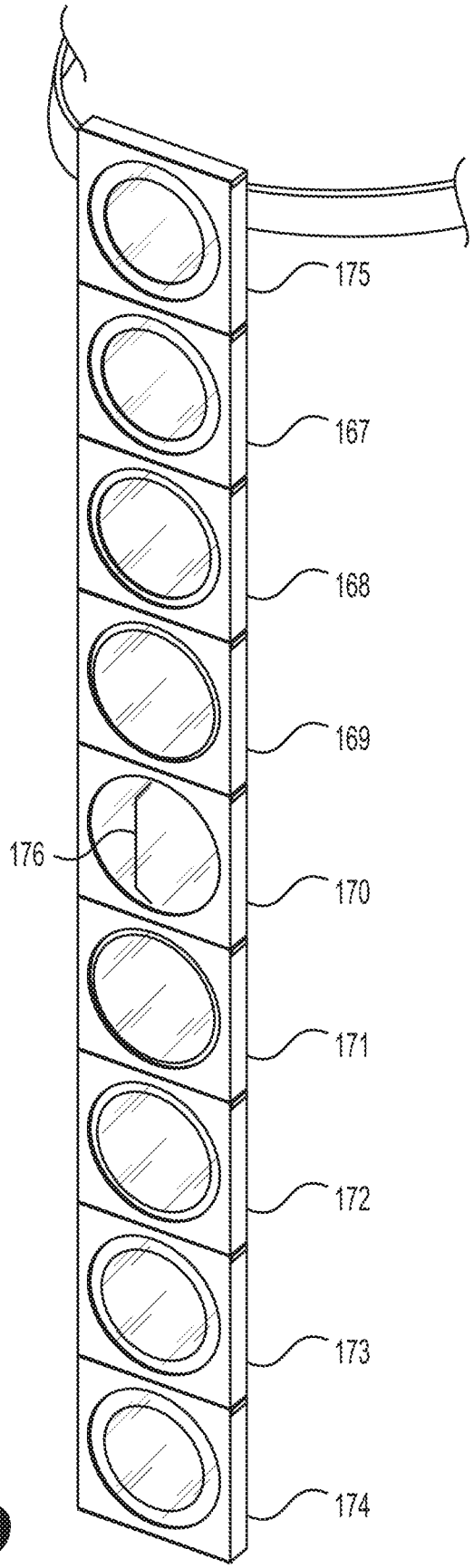
FIG. 5D is a front perspective view of an exemplary embodiment of a neckwear in which the neckband module and all eight display segments include the same size display window and house coin holders for various size coins.

For example, as shown in the exemplary embodiment of a neckwear in FIG. 5D, the eight display segments 167-174 and the neckband module 175 include circular display windows with the same diameter (only the diameter 176 of the display window of display segment four 170 is labeled). This neckwear includes the display segment 155, closure 157 and Quadrum® Intercept Snaplock Coin Holder 134 of FIG. 4F. This type of coin holder has the same outer dimensions with the following variable gasket sizes (inner diameter): the neckband module 175 includes the 30 mm gasket, display segment one 167 includes the 32 mm gasket, display segment two 168 includes the 34 mm gasket, display segment three 169 includes the 36 mm gasket, display segment four 170 includes the 41 mm gasket, display segment five 171 includes the 36 mm gasket, display segment six 172 includes the 34 mm gasket, display segment seven 173 includes the 32 mm gasket, and display segment eight 174 includes the 30 mm gasket. Each of the coin holders contains a uniquely engraved coin in which the designs are not depicted. The diameter of each coin in the coin holders in the neckband module 175 and display segments 167-174 corresponds to the above gasket sizes (inner diameter). This neckwear configuration allows virtually any size coin ranging from 14 mm in diameter through 41 mm in diameter to be displayed at any position along the neckwear panel whether or not the neckwear includes intra-changeable display segments. All nine display inserts of this neckwear, which in this exemplary embodiment comprise of coin holders, are intra-changeable display inserts, which are quickly and easily intra-changed and interchanged.

Methods known in the art that provide very thin display segments, neckband modules, torso segments and/or display inserts may be preferred for use in a neckwear in the interest of streamlining the neckwear. Generally, the thinner these are, the more aesthetically appealing and comfortable the neckwear becomes. It will be appreciated that specialized types of display glass that include the following characteristics: (i) high resistance to cracks, scratches and abrasions which enables thickness reduction of the glass, (ii) high optical clarity, (iii) light weight, and (iv) high chemical durability, are preferred for a neckband module, display segments and display inserts. An example of such a glass is Corning® Gorilla® glass, which is available as thin as 0.4 mm and includes the above characteristics.

Although a neckband module or display segment may be configured for a prior-art coin holder, coin capsule or bar capsule, a neckband module or display segment may also be configured for a display insert which is not prior-art coin holder, coin capsule or bar capsule and is specifically configured for a neckwear. Various modifications may be incorporated on prior-art coin holders, coin capsules or bullion bar capsules, which include that they are designed and manufactured so that less environmental air passes through them. Various types of metal-to-glass seals may be incorporated on these holders and capsules. An epoxied acrylic strip around the edge to block a portion of the air flow between the base and the cover of these holders and capsules would also be beneficial. They may also be produced in different sizes (e.g., thicker or thinner) to accommodate coins, rounds, medals or bars that configured and custom designed for a neckwear. Display inserts may comprise of a frame for a coin, round, medal or bar without any glass. Display inserts may by any size or shape or may be configured so that the coin, round, medal or bar partially protrudes through the cutout display window at the front of the neckband module or display segment.

The exemplary embodiments of neckwear herein include the following advantages, as compared to the fabric necktie and other types of neckwear resembling neckties: stain resistant and considerably easier and more economical to clean if soiled by food, beverages, ashes from smoking, ink or other contaminants, extensive intra-changeability and interchangeability, more durable, wrinkle proof, does not snag, impervious to burn holes from smoking, no need to tie a knot, more symmetrical to an observer when worn due to lack of necktie knot (and the resulting asymmetrical folds and crinkles below the necktie knot), and/or covers all of the front shirt buttons. Moreover, comfortable metallic neckwear provides a much needed formal and semi-formal fashion alternative to wearing a necktie or wearing a button-down dress shirt without a necktie.

Light reflectance in the visible spectrum (hemispherical directional reflectance at wavelength intervals of 10 nanometers (nm) from 390 to 700 nm, one angle, less than 20°) was analyzed by Surface Optics Corporation using a Cary 5000 integrating sphere reflectometer on three metal bars, three button-down dress shirts and three fabric neckties. The three metal bars provided for analysis were designed by Patuga LLC and manufactured by a private mint utilizing the pressing method. All three metal bars analyzed for light reflectance do not comprise of any enamel or post-engraved design elements. One of the metal bars is fine silver, the second is fine copper, and the third is brass (85% copper and 15% zinc). All three metal bars have the identical design and engraving including the same minted proof finish.

The three button-down dress shirts provided for light reflectance value (LRV) analysis were Stafford branded shirts, distributed by J.C. Penny Corporation in the United States of America (Travel, Easy-Care Broadcloth, comprised of 55 percent cotton and 45 percent polyester, regular fit size—16½, 32-33). Each of the three dress shirts was a solid color; the first was blue (labeled, blooming blue), the second was white (labeled, white) and the third was grey (labeled, rockefeller grey). The three fabric neckties provided for LRV analysis were J F J. Ferrar branded neckties, distributed by J.C. Penny Corporation, (narrow J F Backwall). Each of the three neckties was a solid color; the first was blue (labeled, extreme blue), the second was red (labeled, cayenne) and the third was yellow (labeled, bright buttercup). The label of the subject neckties did not disclose the type of fabric. All three neckties had a robust sheen.

All dress shirts and neckties analyzed were a solid color without any type of noticeable pattern on the fabric so there would be no ambiguity or issue when choosing a target location on the samples with the spectrophotometer if the fabrics, for example, included multiple colors or patterns. The target location on each sample for the spectrophotometer to analyze light reflectance was approximately 3 cm by 5 mm. The center of the target location on each of the three types of samples were as follows: for the metal bars, 3 mm from the top (as positioned on a neckwear) and centered from left to right, for the shirts, 2 cm below the tip of left the collar (while the shirts were still folded and pinned from the factory so that the fabric of the target location of each shirt was multi-layered), and for the neckties, 38 cm from the bottom tip of the necktie and centered from left to right.

Figure 6:
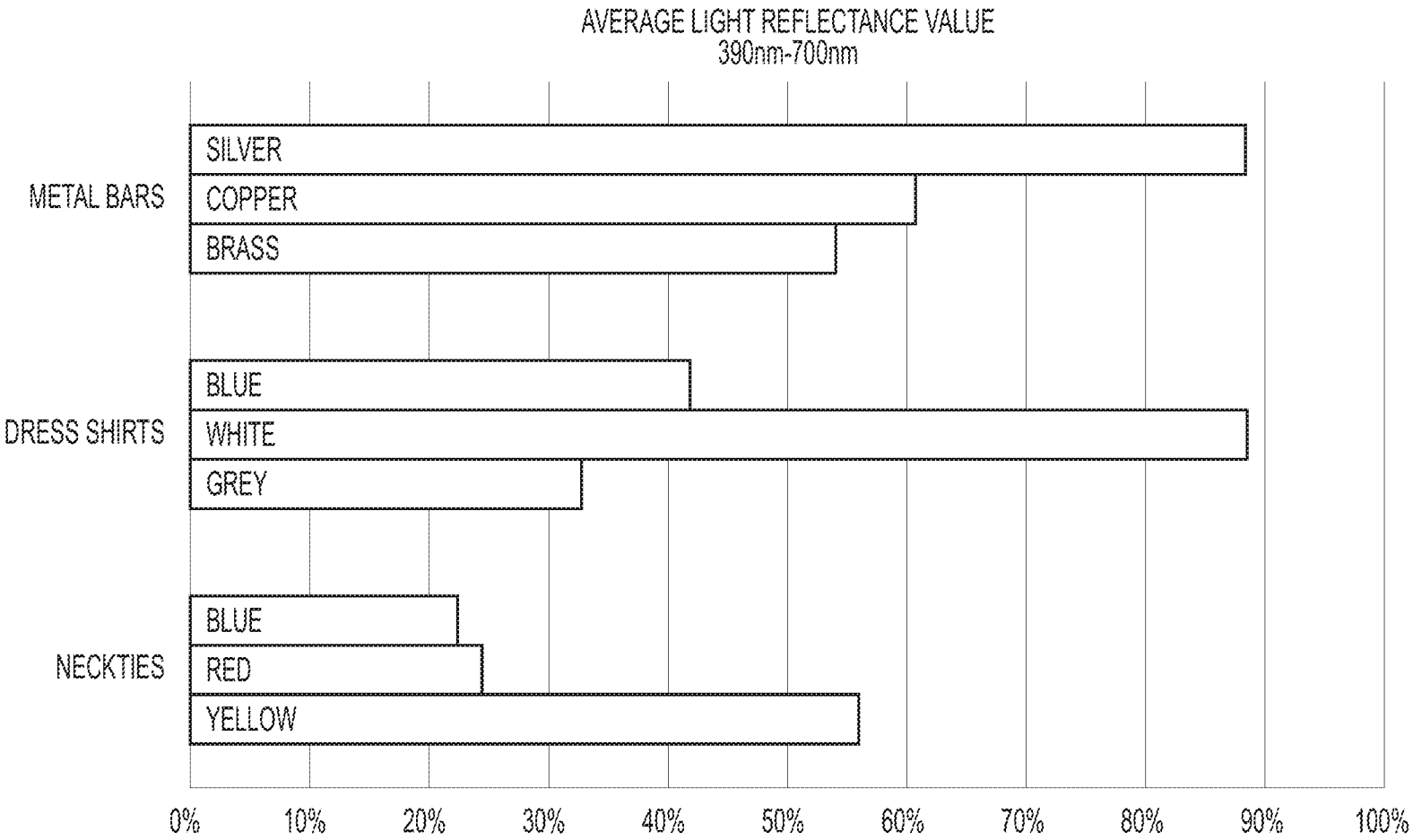
FIG. 6 is a bar graph depicting light reflectance values of three dress shirts, three neckties, and three bars provided by the pressing method.

Thirty-two light reflectance values were generated from each of the nine samples. The average of these thirty-two values for each of the nine samples is shown in a bar chart in FIG. 6. The average LRV of the silver bar (88.5 percent) was approximately equal to the average LRV of the white dress shirt (88.6 percent), which is remarkable that a metal reflects light as well as a white object. The average LRV of the silver bar (88.5 percent) was greater than the average LRV of the blue shirt (32.8 percent) and greater than the average LRV of the grey shirt (42.0 percent) and greater than the average LRV of all three neckties (blue: 22.5 percent, red: 24.6 percent and yellow: 56.2 percent). The average LRV of the copper bar (60.9 percent) was greater than the average LRV of the blue shirt (32.8 percent), greater than the average LRV of the grey shirt (42.0 percent) and greater than the average LRV of the all three neckties. The average LRV of the brass bar (54.1 percent) was greater than the average LRV of the blue shirt (32.8 percent), greater than the average LRV of the grey shirt (42.0 percent), approximately equal to the average LRV of the yellow necktie (56.2 percent), and greater than the average LRV of the blue necktie (22.5 percent) and greater than the average LRV of the red necktie (24.6 percent). These LRV results affirm that a neckwear including metal bars provided by the pressing method of a mint contrasts dramatically with fabrics of formal and semi-formal attire not only in color, composition and texture, but also in light reflectance. Metallic neckwear of the present disclosure, as part of formal and semi-formal attire, generates visual interest, excitement and drama.

Improved Take-Apart Hinges

Take-apart hinges, sometimes referred to as "lift off hinges," are well known in the art. They function similarly to typical hinges by connecting two objects and allowing one or both objects to move or rotate. Advantageous features of take-apart hinges are that an object connected to a take-apart hinge is disconnected and/or reconnected without any key, tool or the like and take-apart hinges are strong relative to their size in terms of handling force and weight loads.

In another aspect, the present inventor devised new and improved take-apart hinges, as disclosed in U.S. patent application Ser. No. 15/384,540, and referred herein as improved take-apart fasteners. The inventor identified a need for better securing an object using a take-apart hinge that has a greater level of security including increased theft deterrence and a reduced probability of the hinge inadvertently unlocking and sliding apart by random movement or impact. In some embodiments, the instant improved take-apart fastener may be utilized in the instant neckwear for securing components of the neckwear panel. Examples include the exemplary embodiments in FIGS. 1A-1E, 2H-2P and 5B. However, any embodiment of a neckwear herein may be modified to include an improved take-apart fastener.

In other exemplary embodiments, the instant improved take-apart fastener may be used for securing or quasi-locking any article to an object. Examples include securing a piece of art or securing valuables such as jewelry to a display in a retail environment. In this way, the improved take-apart fastener can provide increased security and assist in preventing theft while maintaining the advantages typical take-apart hinges provide.

Figure 7A:
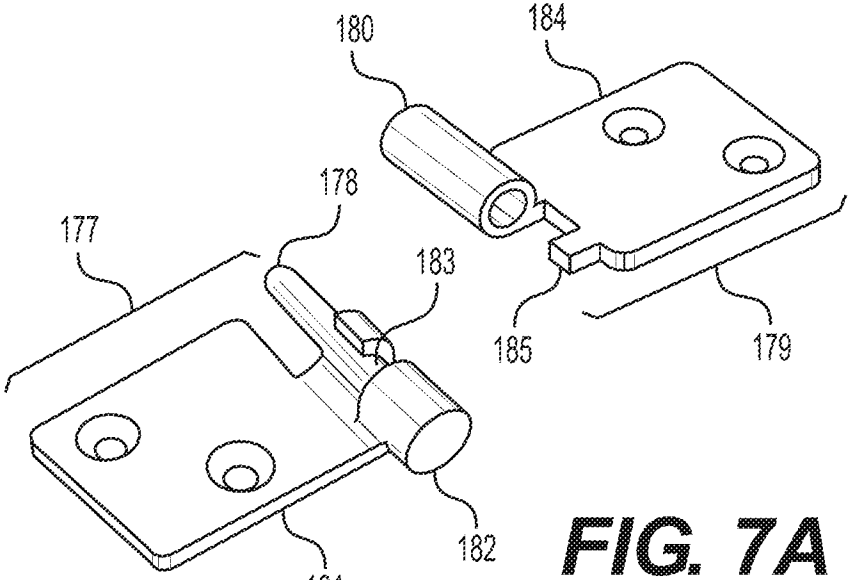
FIG. 7A (PRIOR ART)
FIG. 7A is a top perspective view of a prior-art take-apart hinge that has been unlocked and taken apart.
Figure 7B:
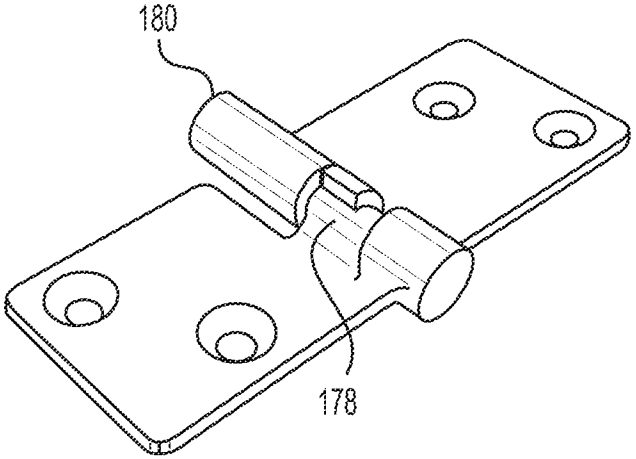
FIG. 7B (PRIOR ART)
FIG. 7B is a top perspective view of said hinge in the locked position.
Figure 7C:
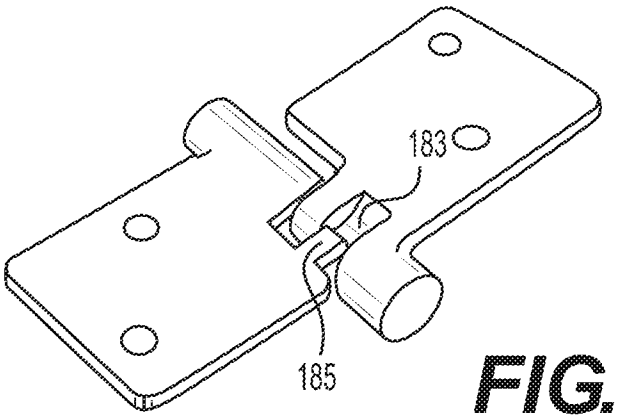
FIG. 7C (PRIOR ART)
FIG. 7C is a bottom perspective view of said hinge in the locked position.
Figure 7D:
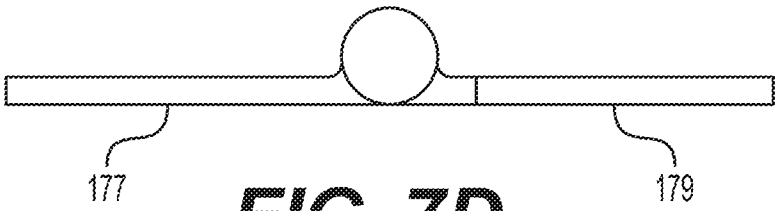
FIG. 7D (PRIOR ART)
FIG. 7D is a side view of said hinge in the locked position.

A typical, previously known take-apart hinge, Sea Dog Line made in Thailand, is cast stainless steel and shown in FIGS. 7A-7F. FIG. 7A is a top view of the prior-art take-apart hinge that has been unlocked and taken apart and consists of two members, a first hinge member (male end) 177 with a pin 178 and a second hinge member (female end) 179 with a barrel 180 which receives and houses the pin and acts as the pivot point. The first hinge member comprises a first leaf 181, a knuckle 182, a key groove 183, and a pin 178. The second hinge member comprises of a second leaf 184, a key 185 and a barrel 180. FIG. 7B is a top view of the prior-art take-apart hinge in the locked position showing the pin 178 is engaged with the barrel 180. FIG. 7C is a bottom view of said hinge in the locked position showing the key 185 is engaged with the key groove 183. FIG. 7D is a side view of said hinge in the locked position revealing that the bottom of the hinge is flat and straight across the first hinge member (male end) 177 and the second hinge member (female end) 179.

Figure 7E:
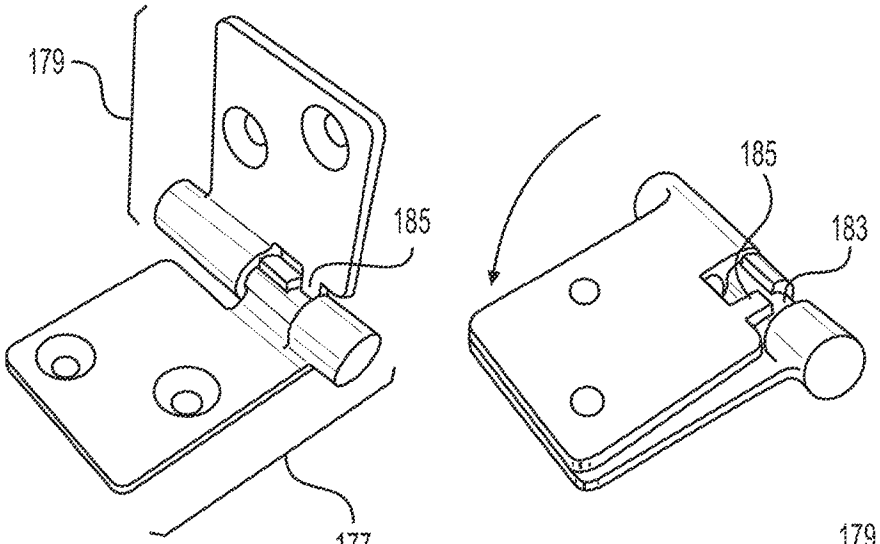
FIG. 7E (PRIOR ART)
FIGS. 7E and 7F illustrate the steps of unlocking and taking apart said hinge.
Figure 7F:
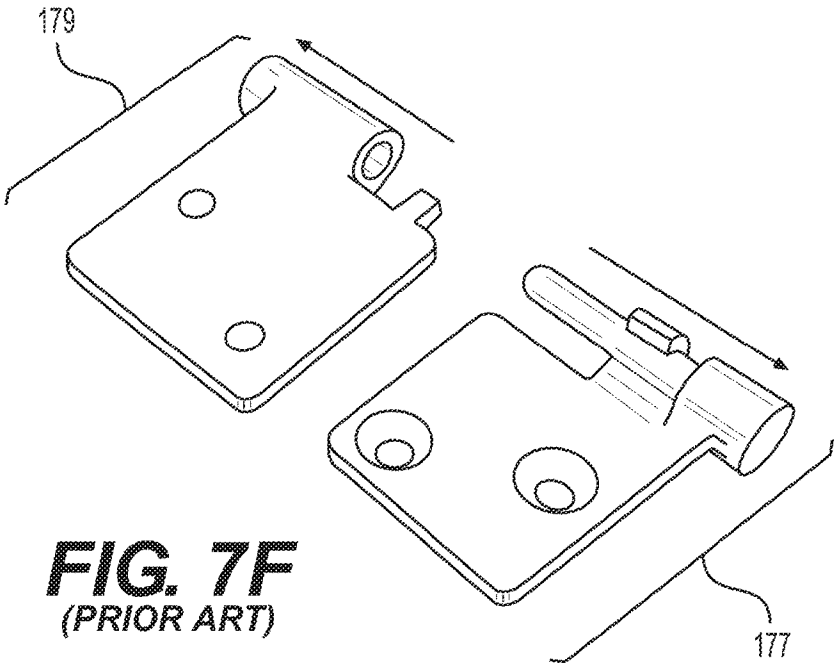
FIG. 7F (PRIOR ART)

Unlocking and taking-apart the prior-art take-apart hinge requires two steps. First, as compared to the flat position of the hinge in FIG. 7D, rotate (close from flat position) the hinge to the correct angle (at least approximately 150°) allowing the key 185 on the female end 179 to free itself from the key groove 183 on the male end 177, as illustrated in FIG. 7E. The key 185 is no longer constrained within the key groove 183 and both the male end 177 and the female end 179 are now unlocked. Second, as illustrated in FIG. 7F, slide apart the male end 177 and female end 179. To lock the hinge these two steps are performed in reverse order. Although said hinge is sufficient for certain applications and is strong when locked due to its composition and design, due to how easily said hinge unlocks, it is not adequate for applications requiring safeguards against disconnecting unintentionally by random movement or impact. These characteristics also render said hinge not practical for applications requiring a theft deterrent.

Figure 8A:
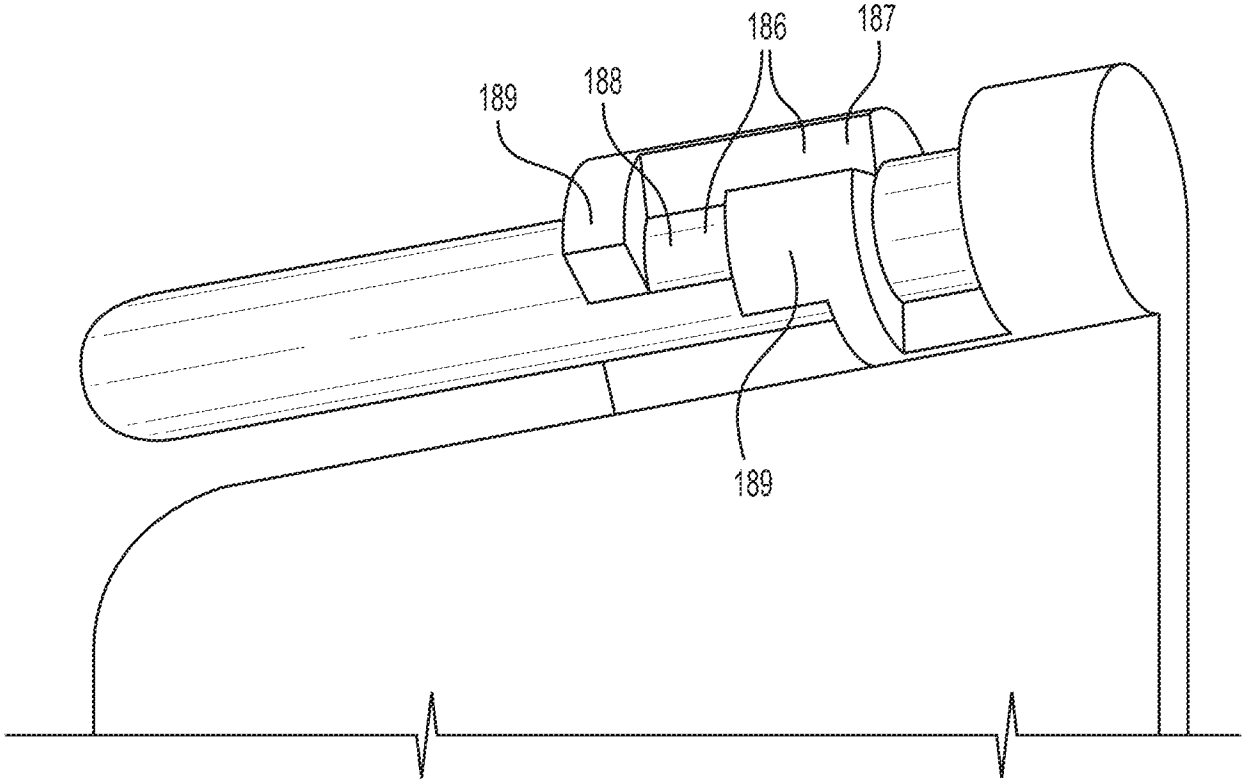
FIG. 8A is an enlarged top view of an exemplary embodiment of a keyway incorporated on the first hinge member of an improved take-apart fastener.
Figures 8B, 8C:
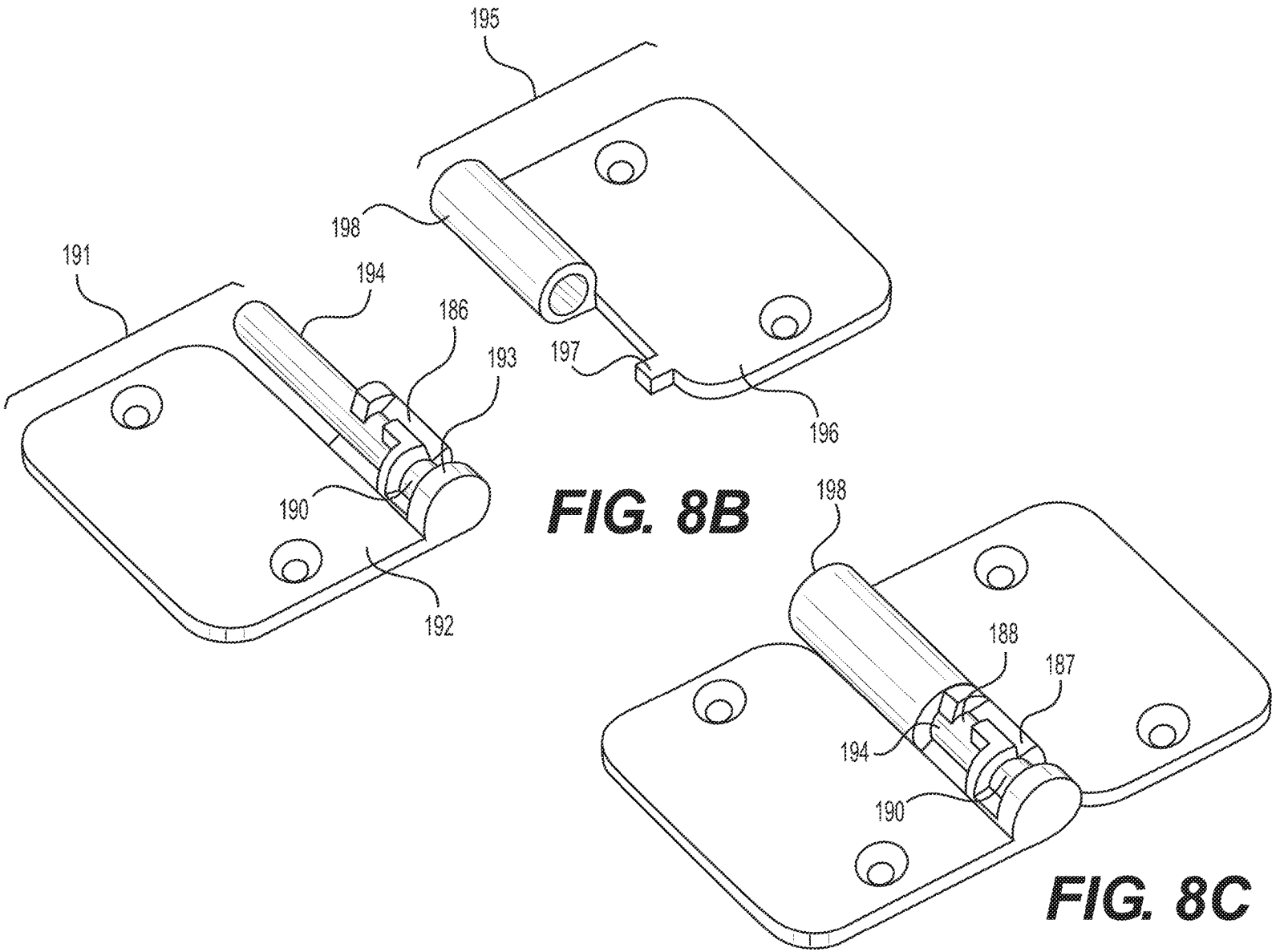
FIG. 8B is a top perspective view of said first hinge member and a second hinge member of said improved take-apart fastener that has been unlocked and taken apart.
FIG. 8C is a top perspective view of said fastener in the locked and flat position. The four steps of unlocking and taking apart said fastener are illustrated in FIGS. 8D-8G.

The instant improved take-apart fastener, which may be made by any method well known in the art including being cast with stainless steel, adds an important feature of additional security to the prior-art take-apart hinge described above. Examples of improved take-apart fasteners are shown in FIGS. 8A-8I. A keyway 186 consisting of two legs, a first leg 187 of the keyway and a second leg 188 of the keyway, has been incorporated on the first hinge member (male end) of the improved take-apart fastener as shown in FIG. 8A. The keyway, configured by elevated curls 189 on the pin, is a channel to engage the key. As further described below, since the key must be guided through the keyway for the hinge to lock and unlock, the incorporation of a keyway increases theft deterrence and greatly reduces the probability of the hinge inadvertently unlocking and sliding apart. The keyway 186 on the male end 191 of the improved take-apart fastener in FIG. 8B is separate and distinct from the key groove 183 on the prior-art take-apart hinge in FIG. 7A and separate and distinct from the key groove 190 on the male end 191 of the improved take-apart fastener in FIG. 8B. The prior-art take-apart hinge does not comprise a keyway; therefore, upon the key of said hinge exiting the key groove, both hinge members of said hinge are unlocked and may be immediately taken apart.

As shown in FIG. 8B, the improved take-apart fastener comprises a first hinge member (male end) 191 and a second hinge member (female end) 195. The first hinge member 191 comprises a first leaf 192, a keyway 186, a key groove 190, a knuckle 193, and a pin 194. The second hinge member 195 comprises a second leaf 196, a key 197 and a barrel 198. The first leaf 192 and the second leaf 196 each has holes to accommodate bolts or screws for mounting the improved take-apart fastener to objects. The knuckle 193 serves as the outside boundary of the key groove 190.

FIG. 8C is a top view of the improved take-apart fastener in the locked position revealing that a large portion of the pin 194 is in the barrel 198. The first leg 187 of the keyway and the second leg 188 of the keyway are also illustrated. When the key 197 is engaged with the key groove 190 and the pin 194 is engaged with the barrel 198, the first hinge member 191 and the second hinge member 195 can be rotated simultaneously including any articles mounted to the first hinge member and/or the second member. The first hinge member 191 and the second hinge member 195 can also be rotated independently including any articles mounted to the first hinge member and/or the second hinge member. The key groove 190 extends mostly around the circumference of the pin 194.

Figure 8E:
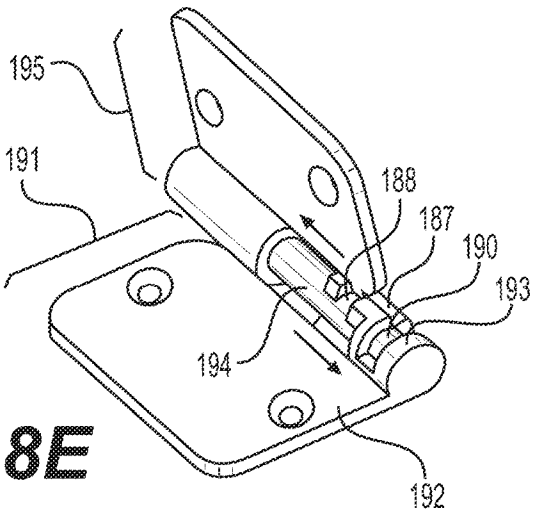
FIG. 8H is a top perspective view of a second example of a first hinge member of an improved take-apart fastener comprising a more complex keyway than that of FIG. 8A.
FIG. 8I is a top view of a third example of a first hinge member of an improved take-apart fastener comprising a more complex keyway than that of FIG. 8H.
Figure 8G:
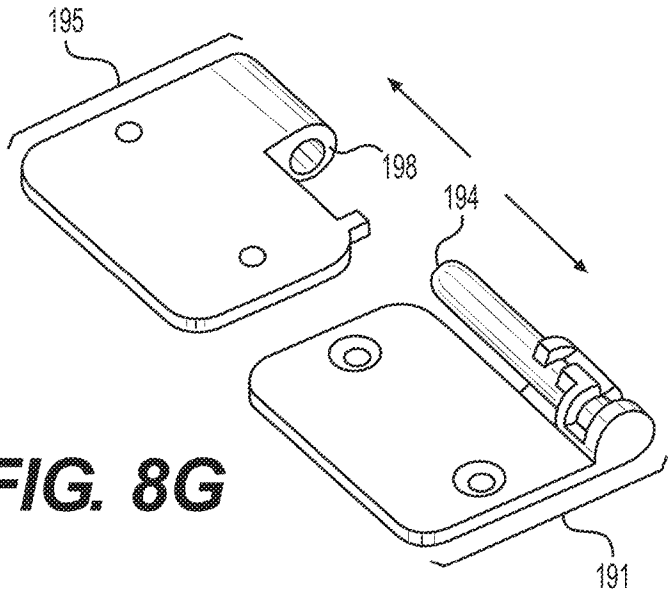
Figure 8D:
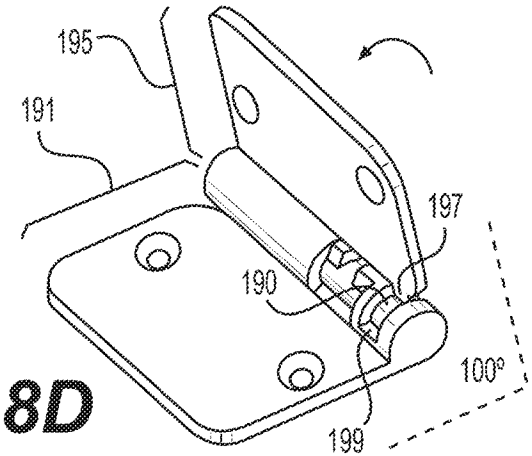
Figure 8F:
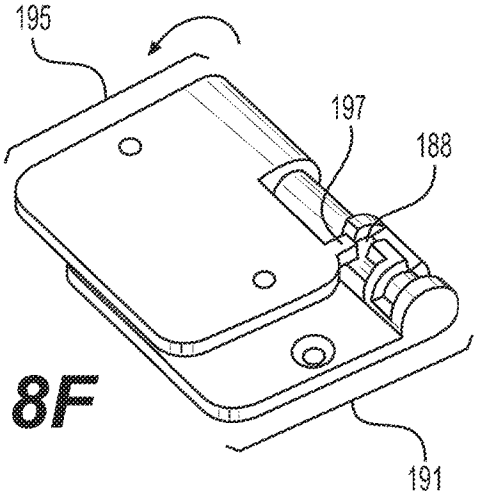

Unlocking and taking apart the instant improved take-apart fastener, with or without mounted articles such as display segments of a neckwear, requires the user to complete four simple steps as illustrated by the arrows in FIGS. 8D-8G. The first step, as illustrated in FIG. 8D, rotate (close from flat position of 180° in FIG. 8C) the first hinge member 191 and/or second hinge member 195 until the key 197 on the second hinge member is at the entry point of the first leg 187 of the keyway thereby positioning the key 197 within the key groove 190 at the appropriate angle (e.g., approximately 100°) to depart the key groove 190 and enter the first leg 187 of the keyway. (If the hinge member(s) are rotated too much from their flat position of 180° and the key 197 passes the entry point of the first leg 187 of the keyway, the improved take-apart fastener will remain locked since the key groove 190, including a terminal end 199 of the key groove, will not allow the key 197 to exit the key groove 190 unless the key 197 enters the first leg 187 of the keyway. Accordingly, the hinge member(s) are simply rotated back to the appropriate angle, which in this example is approximately 100°). The second step, as illustrated in FIG. 8E, slide the first hinge member 191 and/or second hinge member 195 partially apart, as indicated by the arrows, until the key 197 makes contact with the intersection of the first leg 187 of the keyway and the second leg 188 of the keyway, which prevents the first and second hinge members from further separation. In this example, the first leg 187 of the keyway extends along a longitudinal axis of the pin 194 and the second leg 188 of the keyway extends circumferentially with respect to the pin such that the intersection of the first and second legs of the keyway can be considered perpendicular along the pin. The third step, as illustrated in FIG. 8F, rotate the first hinge member 191 and/or second hinge member 195 further to the appropriate angle (e.g., at least to approximately 160° so that the key 197 passes through the second leg 188 of the keyway at which point the key is no longer constrained within the second leg of the keyway, which in this embodiment is the last leg of the keyway. Fourth, as illustrated in FIG. 8G, completely slide apart the first hinge member 191 and second hinge member 195, as indicated by the arrows, in which case the pin 194 has been removed from the barrel 198.

These two additional unlocking steps included in FIGS. 8D-8G, as compared to the unlocking steps illustrated in FIGS. 7E and 7F, transform the common take-apart hinge into a quasi-combination lock. Once unlocked and taken apart, putting together and locking the instant improved take-apart fastener simply entails the user performing the said four steps in reverse order. The locked improved take-apart fastener allows any mounted articles, such as the display segments, to pivot while the pin 194 rotates in the barrel 198 and while the key 197 is engaged with the key groove 190.

The improved take-apart fastener has only two parts consisting of a first hinge member (male end) and a second hinge member (female end), is very strong when locked and capable of handling high force and weight loads, does not comprise of any spring, coil, screw, bolt, clasp or the like to function (all of which generally deteriorate over time and eventually may break), has a low profile, and the bottom of said fastener is flat and straight. These features combined with the security feature of the keyway make the improved take-apart fastener an attractive fastening option for various applications including connecting jewelry articles together and connecting the neckband module, display segments and torso segments of a neckwear. The improved take-apart fastener, as compared to the prior-art take-apart hinge described above, greatly reduces the risk of the neckwear disconnecting unintentionally, for example, by random movement or by impact. Moreover, the improved take-apart fastener renders the neckwear more secure against acts of attempted theft while the neckwear is being worn, including attempts to forcibly remove neckwear panel components, as compared to, for example, link-type chains or other inadequate, unsecure fasteners typically used in jewelry.

Accordingly, the improved take-apart fastener provides an example of a fastener that may be mounted to the neckwear panel of a neckwear permitting connectivity across the neckwear panel allowing all of the display segments and/or torso segments to pivot and be quickly and easily intra-changed and interchanged. In the exemplary embodiment of FIGS. 1A and 1D, the first hinge member (male end) 33 and the second hinge member (female end) 34 of the improved take-apart fastener shown in FIG. 1D are mounted to the rear of the neckwear panel in the following fashion (for a neckwear, for example, originally comprising of a neckband module 9 and eight display segments 1-8): the female end 34 of the improved take-apart fastener (key pointing downward) to the bottom portion of the neckband module 9, the male end 33 of the improved take-apart fastener (knuckle facing upward) to the top portion of display segment one (display segment directly below the neckband module), the female end 34 of the improved take-apart fastener (key pointing downward) to the bottom portion of display segment one, the male end 33 of the improved take-apart fastener (knuckle facing upward) to the top portion of display segment two, the female end 34 of the improved take-apart fastener (key pointing downward) to the bottom portion of display segment two, the male end 33 of the improved take-apart fastener (knuckle facing upward) to the top portion of display segment three, the female end 34 of the improved take-apart fastener (key pointing downward) to the bottom portion of display segment three, the male end 33 of the improved take-apart fastener (knuckle facing upward) to the top portion of display segment four, the female end 34 of the improved take-apart fastener (key pointing downward) to the bottom portion of display segment four, the male end 33 of the improved take-apart fastener (knuckle facing upward) to the top portion of display segment five, the female end 34 of the improved take-apart fastener (key pointing downward) to the bottom portion of display segment five, the male end 33 of the improved take-apart fastener (knuckle facing upward) to the top portion of display segment six, the female end 34 of the improved take-apart fastener (key pointing downward) to the bottom portion of display segment six, the male end 33 of the improved take-apart fastener (knuckle facing upward) to the top portion of display segment seven, the female end 34 of the improved take-apart fastener (key pointing downward) to the bottom portion of display segment seven, the male end 33 of the improved take-apart fastener (knuckle facing upward) to the top portion of display segment eight, and the female end 34 of the improved take-apart fastener (key pointing downward) to the bottom portion of display segment eight.

The improved take-apart fasteners described herein, including those shown in FIG. 1D, are known as a left-handed or left-hand oriented hinges. The improved take-apart fastener may also be configured as a right-handed or right-hand oriented hinge, which may also be utilized for the instant neckwear and other articles. The method of mounting fasteners to a neckband module, display segment or torso segment depends on the type and composition of the fastener utilized for the neckwear panel and the composition of the neckband module, display segment or torso segment. The male end and the female end of the improved take-apart fastener may be mounted by any of the various methods known in the art, including soldering or by use of an epoxy, depending on the type and composition of fastener utilized and the composition of the neckband module, display segment, torso segment or any other article as the case may be. Indeed, fasteners, including improved take-apart fasteners, may be mounted to any article, including components of a neckwear panel, by methods well known in the art other than soldering or an epoxy such as, for example, utilizing screws or bolts. Portions of any fastener, including the improved take-apart fastener, may be provided by being formed as part of a single piece, along with the neckband module, display segment or torso segment, by casting or the pressing method.

The keyway of an improved take-apart fastener comprises one or more legs along the pin and includes any pattern along the pin including straight line(s), a portion of an arc, and/or a portion of an ellipse. Legs of the keyway may extend along a longitudinal axis of the pin or circumferentially with respect to the pin. The determination of the complexity of a keyway, including the number of legs and type of leg (e.g., linear legs or curved legs), to incorporate on the improved take-apart fastener is a tradeoff between security and ease of taking apart/putting together the improved take-apart fastener. The more complex the keyway, the greater level of security; the less complex the keyway, the lower level of security and the easier and faster the improved take-apart fastener is to unlock or lock. It will be appreciated that the key of the improved take-apart fastener may be any shape or size to engage the keyway and key groove, including shapes resembling a cuboid or cylinder. The key 197, as shown in FIG. 8B, approximates a rectangular prism apart from the one face of the key attached to the second leaf 196. Of course, whatever shape or size of the key, the dimensions of the keyway and key grove are coordinated and configured with those of the key for appropriate engagement.

Figure 8I:
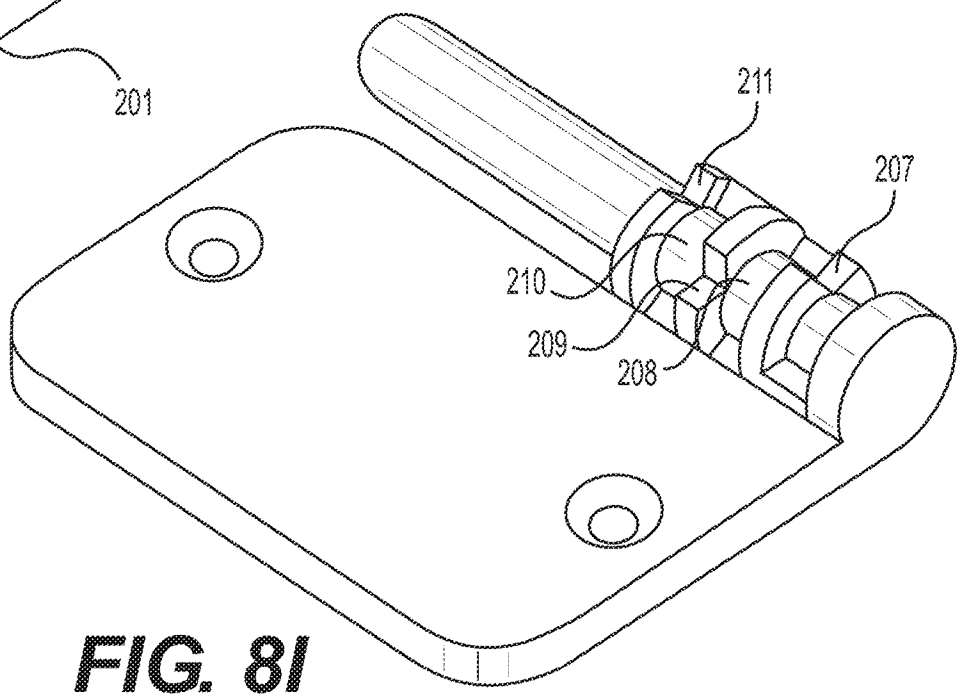
Figure 8H:
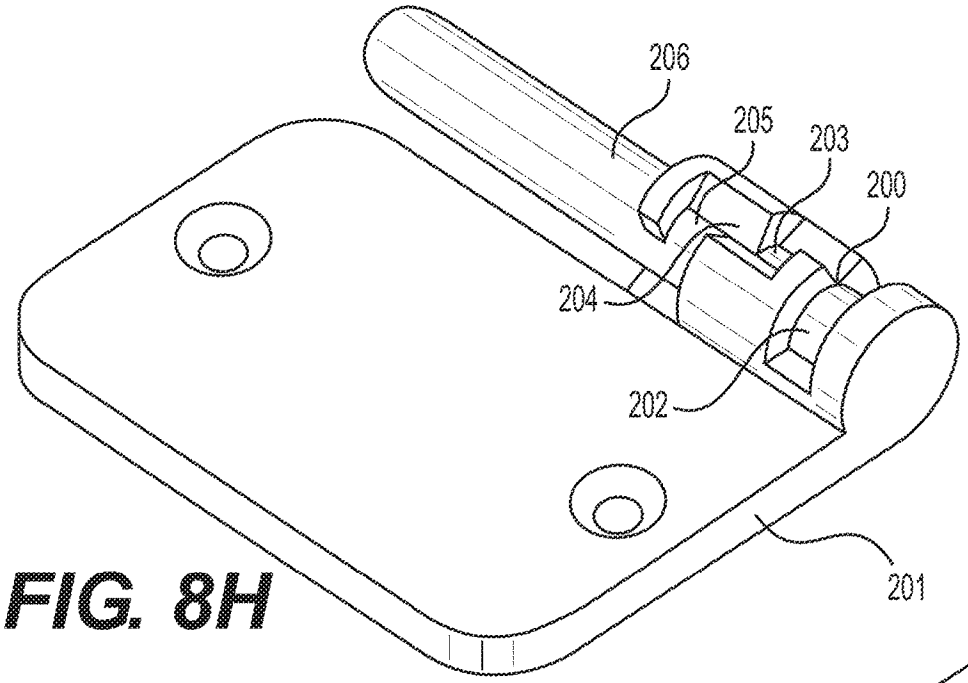

An exemplary embodiment of a more complex keyway with four legs is shown in FIG. 8H. This keyway requires two additional steps, six in total, to unlock or lock the improved take-apart fastener, as compared to the keyway described above and shown in FIG. 8A. The first step is rotate (close from flat position) the first hinge member and/or second hinge member until the key on the second hinge member (not shown) is at the entry point of the first leg 200 of the keyway on the first hinge member 201 thereby positioning the key on the second hinge member at the appropriate angle to depart the key groove 202 and enter the keyway. The second step is slide the first hinge member and/or second hinge member partially apart until the key makes contact with the intersection of the first leg 200 of the keyway and second leg 203 of the keyway which stops the first and second hinge members from further separation. The third step is rotate the first hinge member and/or second member further to the appropriate angle until the key is at the entry point of the third leg 204 of the keyway. The fourth step is slide the first hinge member and/or second hinge member partially apart further until the key makes contact with the intersection of the third leg 204 of the keyway and fourth leg 205 of the keyway which stops the first and second hinge members from further separation. The fifth step is rotate the first hinge member and/or second hinge member even further to the appropriate angle so that the key passes through the fourth leg 205 of the keyway at which point the key is no longer constrained within the keyway. The sixth step is completely slide apart the first and second hinge members in which case the key has passed the pin 206 and the pin has been removed from barrel.

An exemplary embodiment of an even more complex keyway of an improved take-apart fastener is shown in FIG. 8I. This keyway comprises five legs, a first leg 207, a second leg 208, a third leg 209, a fourth leg 210 and a fifth leg 211. This keyway requires six steps to unlock or lock the improved take-apart fastener. The first four steps are the same as above. The fifth step requires the user to rotate the first hinge member and/or second hinge member in the opposite direction, as compared to step three, the difference is that step five entails closing the hinge member(s) (from the flat position) not opening the hinge member(s) (from the flat position) as in step three. The additional security measure of this keyway, as compared to the keyway of FIG. 8H, is that for the portions of the keyway which extend circumferentially with respect to the pin, the key is free to engage these portions of the keyway in both circumferential directions upon the key making contact with an intersection of two legs. This feature makes an unauthorized user, who does not know the keyway pattern of a locked improved take-apart fastener, to guess as to which way to rotate the hinge member(s) when attempting to unlock the hinge.

In addition to the incorporation of the keyway for additional security, there are other improvements of improved take-apart fasteners herein, as compared to the prior-art take-apart hinge described above and shown in FIGS. 7A-7F. These improvements for some embodiments such as neckwear embodiments include, as shown in FIG. 8B, that the knuckle 193 of the improved take-apart fastener is flush with the first leaf 192 (does not overlap first leaf as shown in FIG. 7A) and the barrel 198 of the improved take-apart fastener does not protrude as much past the second leaf 196 on the barrel end. The size of the first leaf and the second leaf has been reduced in the exemplary embodiments herein of improved take-apart fasteners. Also, as shown in FIG. 8D, unlike the prior-art hinge, the improved take-apart fastener includes a second terminal end 199 of the key groove 190 not allowing the key 197 to exit the key groove 190 unless the key 197 enters the first leg 187 of the keyway. These additional improvements result in the improved take-apart fastener being more streamlined. It will be appreciated that the size of the first hinge member and second hinge member, including the diameter of the pin and barrel, may vary depending on the specific application.

The first leaf and/or second leaf of an improved take-apart fastener may include any number of holes in any position for mounting an article. As shown in FIGS. 8B-8I, every first leaf or second leaf has two holes for mounting an article. Improved take-apart fasteners may be screwed, for example, to any article including the display and torso segments and neckband module of a neckwear. In other embodiments, a first leaf and/or a second leaf may not include holes for mounting. For example, as shown in FIG. 1D, improved take-apart fasteners may be mounted by being soldered to the display segments and neckband module.

Improved Quick-Release Buckles

In another aspect, the present inventor devised new and improved quick-release buckles that can be used with a variety of articles. The inventor identified a need for better connecting objects with quick-release buckles, including the need for a quick-release buckle to have the capability to be mounted, for instance screwed, to one or more rigid objects and the need for a quick-release buckle to provide pivoting capability to these rigid objects mounted to the quick-release buckle(s).

In some exemplary embodiments, improved quick-release buckle(s) allow rigid mounted objects to be intra-changeable or interchangeable. Improved quick-release buckles may be used with the instant neckwear herein for connecting components of a neckwear panel and providing pivoting capability to the display segments and torso segments and features of intra-changeability and interchangeability. In other exemplary embodiments, improved quick-release buckles may be mounted to any rigid objects requiring pivoting capability and capability to be quickly and easily intra-changed or interchanged. Any article equipped with improved quick-release buckles offers greater utility including versatility to the user since many combinations may be achieved by intra-changing or interchanging only a portion of an article resulting in drastically altered appearances of the article. For example, in the exemplary embodiment of FIGS. 11A and 11B as further described below, improved quick-release buckles connecting the neckwear panel allow the neckwear panel to be shortened by removing any number of the eight display segments, or the neckwear panel may be lengthened by adding display or torso segments, and the position of each of the eight display segments may be rearranged with one another. In each of these scenarios, the neckwear takes take on a completely new look. Any embodiment of a neckwear herein may be modified to include improved quick-release buckles.

Quick-release buckles are well known in the art and are useful to connect and disconnect belts and to join and unjoin webbing straps. They have impressive force and weight load capacities and do not require any tools or the like to engage or disengage. U.S. Pat. No. 6,226,844 B1 to Lerra et al. discloses side release buckles which include a first buckle component having an engagement end and a module receiving portion opposite the engagement end, and a second buckle component having an engagement end constructed for releasable engagement with the engagement end of the first buckle component and a module receiving portion opposite the engagement end.

Figure 9A:
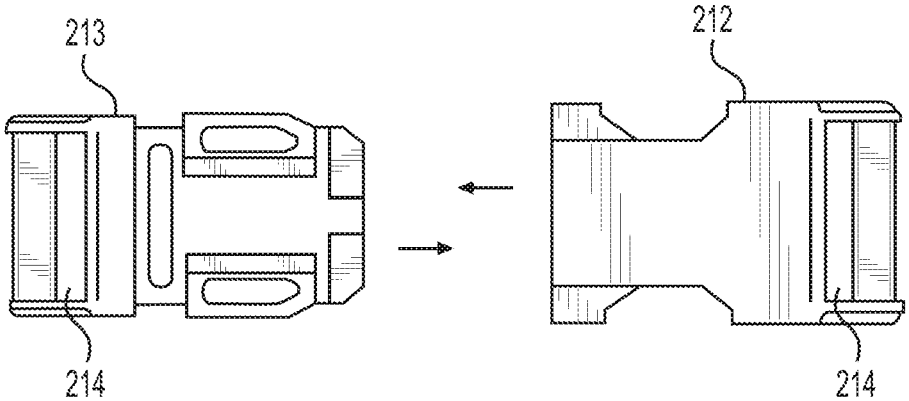
FIG. 9A (PRIOR ART)
FIG. 9A is a top view of a prior-art belt buckle in the disengaged position, which is FIG. 2 in U.S. Pat. No. 6,792,654 B2 to Schmitz.
Figure 9B:
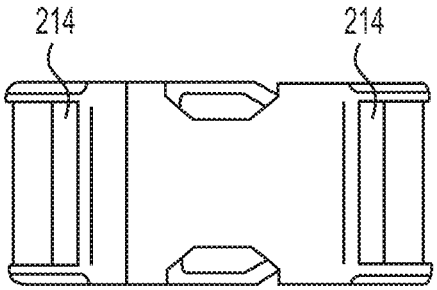
FIG. 9B (PRIOR ART)
FIG. 9B is a top view of said buckle in the engaged position, which is FIG. 3 in said patent.
Figure 9C:
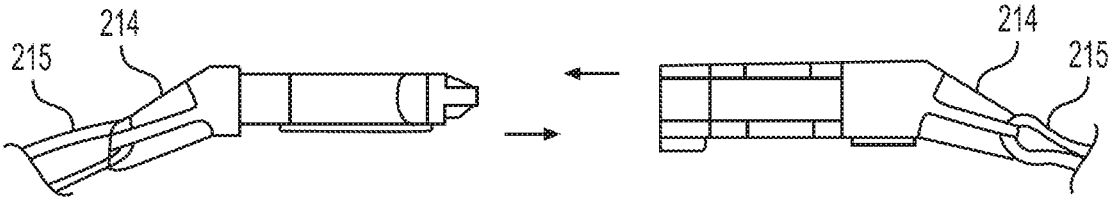
FIG. 9C (PRIOR ART)
FIG. 9C is a side view of said buckle in the disengaged position, which is FIG. 1 in said patent.

U.S. Pat. No. 6,792,654 B2 to Schmitz (published international application WO 01/82737) discloses a metal belt buckle comprising two buckle members, fastened on belt ends, the first of said members having a receiving compartment in which the second buckle member is axially inserted and said second buckle member comprises snap-fit members that are adjusted against a spring force and that interact with undercuts in the first buckle member to secure the fitted buckle members. FIG. 9A (FIG. 2 in 654 patent) is a top view of the belt buckle to Schmitz in which the first buckle member 212 including eye loop 214 and the second buckle member 213 including eye loop 214 are in the disengaged position. A top view of the belt buckle in the engaged position is shown in FIG. 9B (FIG. 3 in 654 patent) demonstrating that the two eye loops 214 at the end of both buckle members, including the bars forming and surrounding the two eye loops, cumulatively comprise a large portion of the entire length of the belt buckle. A side view of the belt buckle in the disengaged position is shown in FIG. 9C (FIG. 1 in 654 patent) revealing that belt ends 215 are secured to the eye loops 214 of the first and second buckle members, and the eye loops are angled downward creating a hindrance for mounting or connecting articles for applications requiring a fastener with a low profile and/or with a flat and straight bottom (planar bottom).

Although Lerra's side release buckles and Schmitz's belt buckle are useful to connect and disconnect belts and to join and unjoin webbing straps or other similar types of flexible articles (e.g., for backpacks or luggage), these and other quick-release buckles are not intended, designed or suited for being mounted (including being screwed or soldered) to rigid objects including the neckband module and display segments of a neckwear. Moreover, the side release buckles to Lerra et al., the belt buckle to Schmitz, and other quick-release buckles do not include any mechanism such as a hinge to allow display segments, torso segments or other rigid objects to pivot. Indeed, prior art quick-release buckles are useless for these types of applications.

Figure 10A:
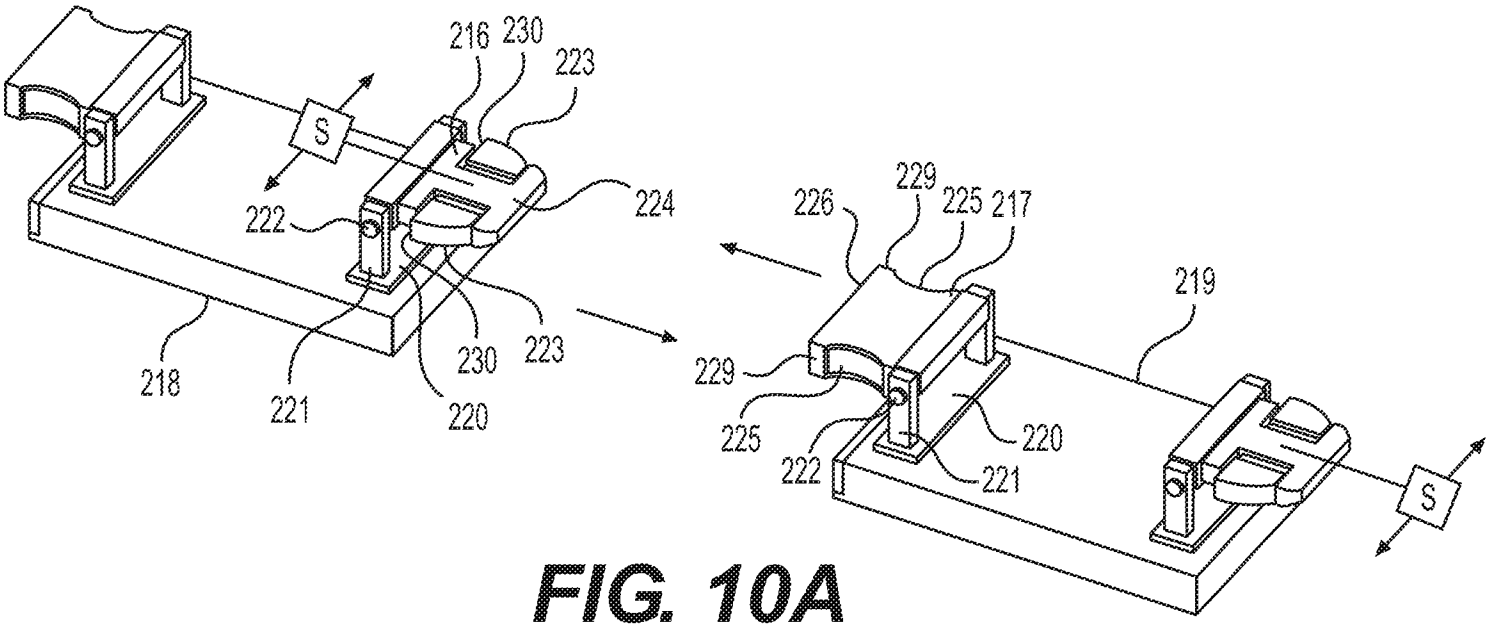
FIG. 10A is a top perspective view of an exemplary embodiment of improved quick-release buckles in the disengaged position and mounted to display segments.
Figure 10B:
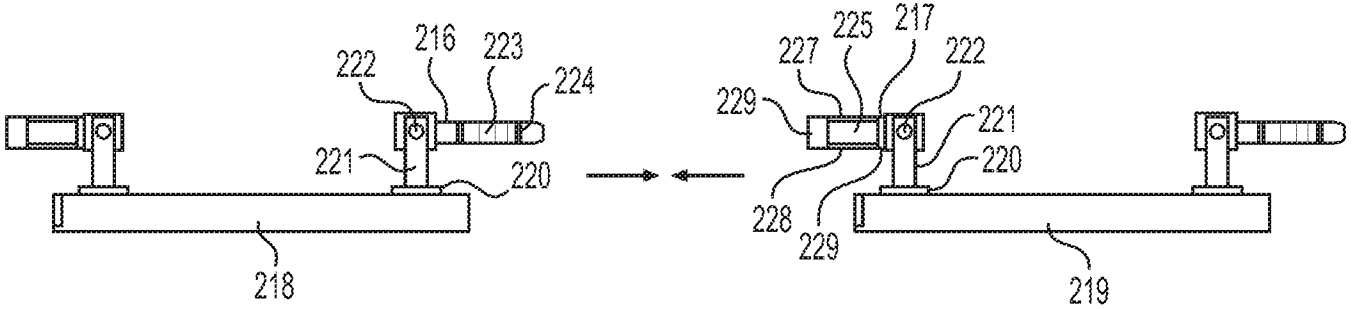
FIG. 10B is a side view of said buckles in the disengaged position mounted to said display segments.

Accordingly, improved quick-release buckles provide an example of a fastener that may be mounted to the neckwear panel of a neckwear permitting connectivity across the neckwear panel and allowing mounted display segments or torso segments to pivot and be intra-changed. FIG. 10A is a top perspective view and FIG. 10B is a side view of an exemplary embodiment of an improved quick-release buckle (in cast metal), which includes a first buckle member (male end) 216 and a second buckle member (female end) 217 mounted to the rear of two display segments 218, 219. The male end 216 includes two spring-fit arms 223, a spring (represented by a spring symbol "S" in FIG. 10A with arrows showing directionality of the force of the spring) and center guide 224, and the female end 217 includes one release opening 225 on each side of the receiving chamber 226. The receiving chamber 226 is a hollow cavity within the female end 217 and is open at the front of the female end to engage the center guide 224. As illustrated by the arrows, the front of the center guide 224 is the engagement end of the male end and the receiving chamber 226 is the engagement end of the female end. As shown in FIG. 10B, each release opening 225 is delimited by an upper wall portion 227, a lower wall portion 228, and a side wall portion 229 on each side of both release openings 225. The upper wall portion 227 and lower wall portion 228, above and below each release opening 225 on each side of the female end 217, are clipped and curved inward for engagement of the spring-fit arms 223. The dimensions of the male end 216 are coordinated with the female end 217 in such a way that the male end can be inserted or pushed into the receiving chamber 226 of the female end. Accordingly, the male end 216 includes a center guide 224 to which are articulated or coupled two latching or spring-fit arms 223 in such a way that when the male end is inserted into the receiving chamber, the spring-fit arms pivot inwardly. Once the two spring-fit arms 223 have passed the side wall portions (in front of the release openings) 229 and have fully entered the two release opening 225, the two spring-fit arms move and pivot outwardly by a compression spring (represented by a spring symbol "S" with arrows showing directionality of the force of the spring) that acts upon them so that each rear facing corner 230 of each spring-fit arm 223 comes to rest and catches behind each side wall portion (in front of the release openings) 229, thereby locking the improved quick-release buckle. Therefore, locking the improved quick-release buckle is extraordinarily simple and takes approximately one second either by inserting the male end 216 into the female end 217 or by pushing the female end past the two spring-fit arms 223 of the male end. Any type of suitable spring or spring-like mechanism may be employed within the male end to allow the spring-fit arms to move and pivot.

As shown in FIG. 10A, a hinge platform 220, a hinge tower 221 and a hinge 222 are mounted on the first buckle member (male end) 216 opposite the engagement end and are mounted on the second buckle member (female end) 217 opposite the engagement end. Identical hinges 222 are in lieu of the eye loops for the securement of belt ends of the belt buckle of the 654 patent (similar to the web-receiving slots to join webbing straps or the like of the quick-release buckles in the 844 patent) and the bars forming and surrounding said eye loops (and likewise said web-receiving slots). The hinges 222 are positioned approximately at the location of said eye loops/web-receiving slots. Identical hinge towers 221 support the hinges 222 and the hinge towers are connected to the hinge platforms 220 which are mounted to the rear of each of two display segments 218, 219. Said eye loops and web-receiving slots for receiving belt straps, webbing straps or the like on prior-art quick-release buckles are not only rendered useless for certain applications of the improved quick-release buckle, including being mounted to and connecting a neckband module and display segments of neckwear herein, but would impede the functionality of applications of the instant improved quick-release buckle. The male end 216 including the hinge 222 and the female end 217 including the hinge 222 may be disposed at any distance above the hinge platforms 220, and by extension, any articles mounted to the hinge platforms, which in this example are the two display segments 218, 219. Although hinge platforms 220 provide greater strength and security, they may be eliminated in which case the hinge towers 221 or the hinges 222 are directly mounted to the display segments 218, 219 or other articles as the case may be. Any suitable type or size of hinge may be included on an improved quick-release buckle.

Figure 10C:
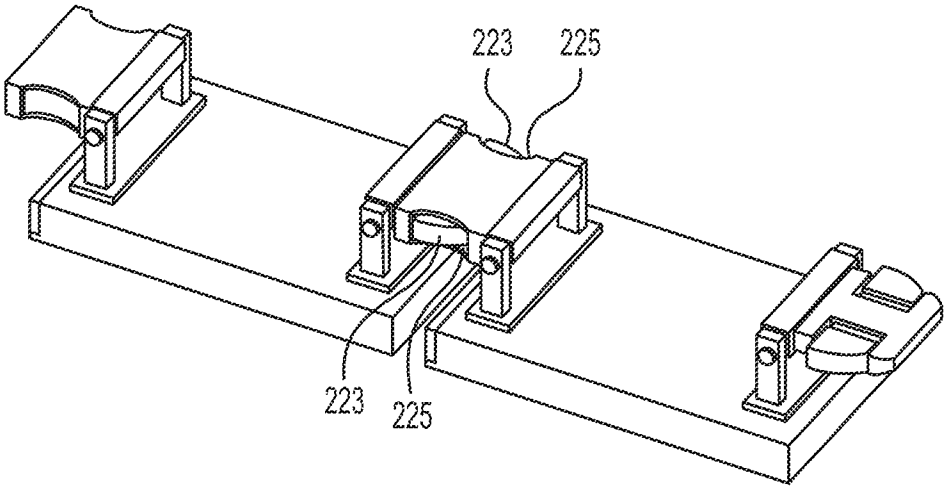
FIG. 10C is a top perspective view of said buckles in the engaged position mounted to said display segments.

As shown in FIG. 10C, two spring-fit arms 223 have entered and are fully expanded into the release openings 225 locking the first and second buckle members of the improved quick-release buckle. Once the spring-fit arms are fully expanded into the release openings, they snap and lock. The fact that the user hears a clicking sound upon the buckle members being locked is an advantageous feature of the improved quick-release buckle for all embodiments disclosed herein since this "click" provides assurance that the buckle is indeed locked. This interlocking action is what affords side-release buckles their tremendous strength relative to their size and makes improved quick-release buckles an ideal solution for a number of fastening applications. Moreover, unlike center-release buckles which have a single pressure point or trigger mechanism to disengage and unlock the center release buckle, the improved quick-release buckle has two pressure points to disengage and unlock the buckle, thereby reducing the risk of the buckle disconnecting inadvertently by random movement or impact. To unlock the improved quick-release buckle, the user simply presses the spring-fit arms 223 simultaneously while sliding apart the male end and/or the female end to disengage them from both release openings 225.

Figure 11A:
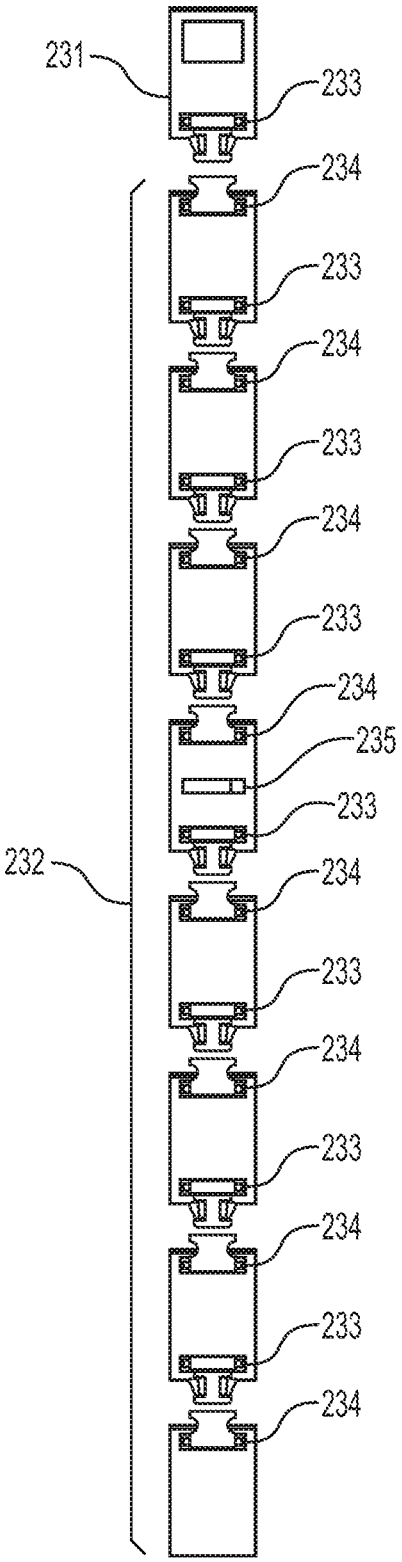
FIG. 11A is a rear view of an exemplary embodiment of a disconnected neckwear panel including disengaged improved quick-release buckles. Said buckles are engaged in FIG. 11B thereby connecting the neckwear panel.

In the exemplary embodiment shown in FIG. 11A, which is a modified embodiment of FIG. 5B described above, hinge platforms of the first buckle member (male end) and second buckle member (female end) of an improved quick-release buckle are shown connecting the rear of the neckwear panel instead of the improved take-apart hinges. These buckle members are mounted in the following fashion (for a neckwear, for example, originally comprising of a neckband module 231 and eight display segments 232): the male end 233 of the quick-release buckle (lead of center guide facing downward) to the bottom portion of the neckband module 231, the female end 234 of the quick-release buckle (opening of receiving chamber facing upward) to the top portion of display segment one (display segment directly below the neckband module), the male end 233 of the quick-release buckle (lead of center guide facing downward) to the bottom portion of display segment one, the female end 234 of the quick-release buckle (opening of receiving chamber facing upward) to the top portion of display segment two, the male end 233 of the quick-release buckle (lead of center guide facing downward) to the bottom portion of display segment two, the female end 234 of the quick-release buckle (opening of receiving chamber facing upward) to the top portion of display segment three, the male end 233 of the quick-release buckle (lead of center guide facing downward) to the bottom portion of display segment three, the female end 234 of the quick-release buckle (opening of receiving chamber facing upward) to the top portion of display segment four, the male end 233 of the quick-release buckle (lead of center guide facing downward) to the bottom portion of display segment four, the female end 234 of the quick-release buckle (opening of receiving chamber facing upward) to the top portion of display segment five, the male end 233 of the quick-release buckle (lead of center guide facing downward) to the bottom portion of display segment five, the female end 234 of the quick-release buckle (opening of receiving chamber facing upward) to the top portion of display segment six, the male end 233 of the quick-release buckle (lead of center guide facing downward) to the bottom portion of display segment six, the female end 234 of the quick-release buckle (opening of receiving chamber facing upward) to the top portion of display segment seven, the male end 233 of the quick-release buckle (lead of center guide facing downward) to the bottom portion of display segment seven, the female end 234 of the quick-release buckle (opening of receiving chamber facing upward) to the top portion of display segment eight, the male end 233 of the quick-release buckle (lead of center guide facing downward) to the bottom portion of display segment eight, and the female end 234 of the quick-release buckle (opening of receiving chamber facing upward) to the top portion of display segment nine. The hinge platforms, hinge towers or hinges of the first buckle member (male end) and second buckle member (female end) of the improved quick-release buckle may be mounted by any of the various methods known in the art, including soldering or use of an epoxy, depending the type and composition of the buckle members, hinge platforms, hinge towers and/or hinges utilized and the composition of the neckband module, display segment, torso segment or any other article as the case may be.

Figure 11B:
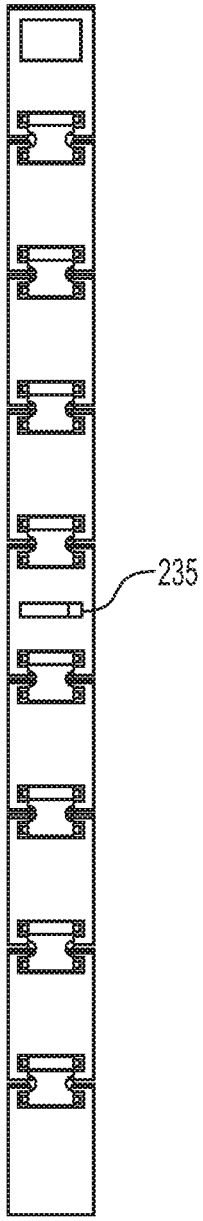
FIG. 11C is a front view of an exemplary embodiment of three interchangeable display segments for the neckwear panel of FIG. 11A.
FIG. 11D is a front view of an exemplary embodiment of an interchangeable torso segment and an exemplary embodiment of an interchangeable display segment for the neckwear panel of FIG. 11A.

As shown in FIG. 11B, all improved quick-release buckles have been locked by engaging the first buckle members (male end) 233 and second buckle member (female end) 234, as described above, thereby connecting all components of the neckwear panel. The instant improved quick-release buckle includes all three aforementioned features of a fastener for a neckwear. A display-clip segment including a tie-clip-like mechanism 235 has been positioned at display segment four.

Figure 11C:
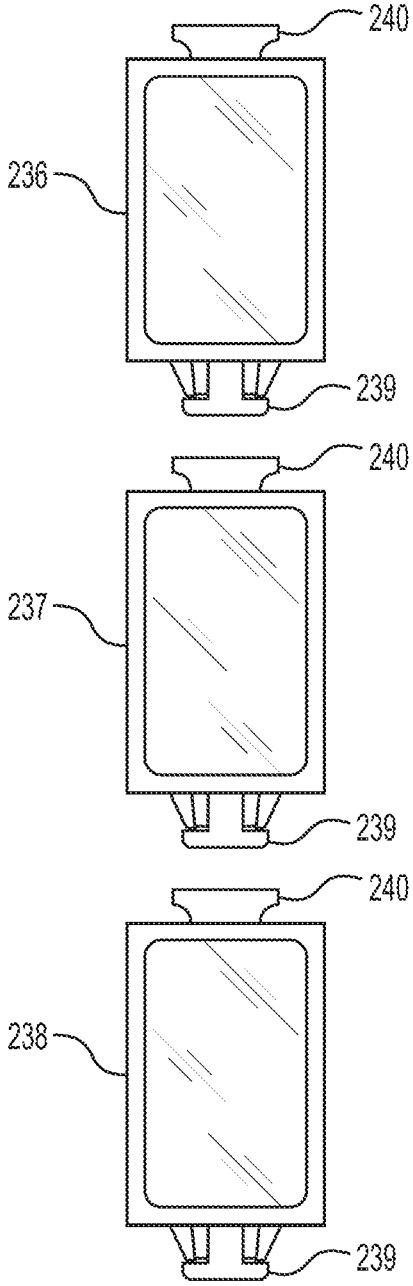

Three interchangeable display segments 236-238 shown in the exemplary embodiment of FIG. 11C are configured for the neckwear in FIGS. 11A and 11B. Each of these interchangeable display segments includes a male end 239 and female end 240 of an improved quick-release buckle. Each of these three interchangeable display segments may replace any display segment of the neckwear in FIGS. 11A and 11B or may be added to the neckwear at any segment position along the neckwear panel.

Figure 11D:
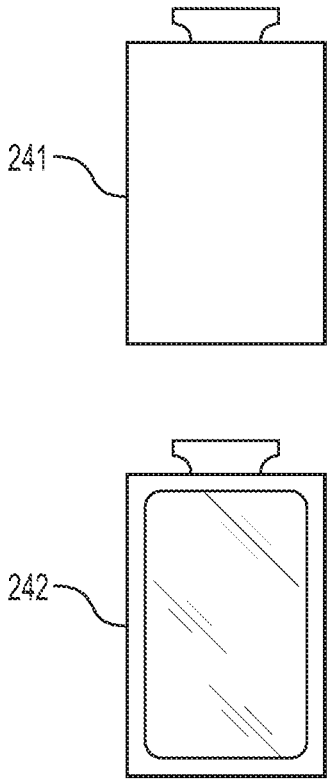

In the event the user desires to replace the terminal display segment of the neckwear in FIGS. 11A and 11B and does not desire the male end the improved quick-release buckle to be visible (at the bottom of the segment) to the casual observer by utilizing the interchangeable display segments 236-238 in FIG. 11C, the interchangeable torso segment 241 or the interchangeable display segment 242 in the exemplary embodiment of FIG. 11D may be utilized for the terminal segment of the neckwear in FIGS. 11A and 11B. These do not include the male end 239 of the improved quick-release buckle. Terminal display segments without a fastener member at their bottom may also be relocated at the display segment one position for a one-display-segment neckwear panel.

Mounting a member or portion of any fastener toward the bottom of a terminal display segment or torso segment of any exemplary embodiment of a neckwear herein is optional. In the exemplary embodiment shown in FIGS. 1A and 1D, the second hinge member (female end) 34 of the improved take-apart fastener toward the bottom of display segment eight 8 (terminal display segment in this example) has been included in FIG. 1D. In the exemplary embodiment of FIGS. 11A and 11B, the first buckle member (male end) 233 of the improved quick-release buckle toward the bottom of display segment eight (terminal display segment in this example) has been excluded. Display segment eight may still be attached to the neckband module 231 for a one-display-segment neckwear. Mounting a member or portion of a fastener toward the bottom of the terminal display segment (or torso segment) such as the second hinge member 34 in FIG. 1D or the first buckle member 233 in FIG. 11A allows the terminal display segment (or torso segment) to be intra-changeable with each of the other intra-changeable display segments (or torso segments) and allows display segments (or torso segments) to be added to the terminal display segment (or torso segment). Of course not including a member or portion of a fastener toward the bottom of the terminal display segment (or torso segment), which a neckwear comprised of originally, reduces the number of potential neckwear combinations accordingly.

Fasteners or a member or portion of any fastener to connect the neckband module, display segments or torso segments may be provided as part of a casting of the neckband module, display segment or torso segment or by any other method. If not part of a casting, the composition of the fasteners to connect the neckband module, display segments or torso segments is in part determined by the composition of the neckband module, display segments or torso segments. The composition of the fasteners of a neckwear may each be made from a variety of suitable materials. For example, and in no way limiting, the fasteners may incorporate any of metals, metal alloys, fiber reinforced polymers (such as carbon-fiber reinforced polymers), and synthetic polymers including plastics.

If the fasteners are not part of a casting of the neckband module, display segments or torso segments, the composition of the fasteners and the composition of the neckband module, display segments or torso segments of a neckwear play a role in determining the method of mounting the fasteners to the neckband module, display segments or torso segments. For example, if a display segment is a carbon-fiber reinforced polymer, soldering or brazing is not an option to mount the fasteners to the display segment. Fasteners and components of a neckwear panel may include holes for mounting with screws, for example, or fasteners and components of a neckwear panel may not include holes for mounting. For example, a metallic neckband module may not have mounting holes and may be soldered to a metallic fastener or an epoxy may be used.

What is claimed is:

1. A neckwear configured to house and display a single coin, medal or bullion bar, said neckwear capable of being expandable to house and display at least one additional coin, medal or bullion bar, and comprising:

a neckband and a neckband module;

wherein said neckband directly connects to said neckband module;

wherein said neckband module includes a compartment that is configured to house a first intra-changeable display insert to contain and display a first coin, medal or bullion bar; and wherein said neckband module includes a fastener or a first member of a first fastener capable of pivotably and directly connecting said neckband module to a first interchangeable display segment comprising a compartment to house a second intra-changeable display insert for displaying a second coin, medal or bullion bar or to a first interchangeable segment; said first interchangeable display segment or said first interchangeable segment includes another fastener or a second member of the first fastener.

2. The neckwear of claim 1, wherein said neckband module contains said first intra-changeable display insert.

3. The neckwear of claim 2, further comprising said first intra-changeable display insert, wherein said first intra-changeable display insert contains the first coin, medal or bullion bar.

4. The neckwear of claim 2, wherein said first intra-changeable display insert contained within said neckband module comprises a coin holder, coin capsule or bullion bar holder.

5. The neckwear of claim 4, wherein said coin holder, coin capsule or bullion bar holder contains the first coin, medal or bullion bar.

6. The neckwear of claim 5, wherein the first coin, medal or bullion bar and the second coin, medal or bullion bar are members of a set or series of coins, medals or bullion bars.

7. The neckwear of claim 1, wherein the neckband module includes a closure.

8. The neckwear of claim 1, further comprising at least one segment that does not include a compartment that is configured to house a display insert.

9. The neckwear of claim 1, further comprising the first interchangeable display segment including the compartment, the compartment being configured to house the second intra-changeable display insert, wherein the first interchangeable display segment includes a second fastener or a first member of the second fastener for directly connecting the first interchangeable display segment to a second interchangeable display segment to house a third intra-changeable display insert for displaying a third coin, medal or bullion bar.

10. The neckwear of claim 9, comprising a plurality of interchangeable display segments, said plurality including the first rigid interchangeable display segment and the second interchangeable display segment, the second interchangeable display segment including a compartment that is configured to house the third intra-changeable display insert.

11. The neckwear of claim 9, wherein the first interchangeable display segment includes a closure.

12. The neckwear of claim 9, wherein said first interchangeable display segment contains the second intra-changeable display insert.

13. The neckwear of claim 12, wherein said second intra-changeable display insert contained within said first interchangeable display segment comprises a coin holder, coin capsule or bullion bar holder.

14. The neckwear of claim 12, wherein the second intra-changeable display insert contains the second coin, medal or bullion bar.

15. The neckwear of claim 14, further comprising the first coin, medal or bullion bar, wherein the first coin, medal or bullion bar and the second coin, medal or bullion bar are members of a set or series of coins, medals or bullion bars.

16. The neckwear of claim 12, further comprising the first intra-changeable display insert, wherein the first intra-changeable display insert and the second intra-changeable display insert are intra-changeable with one another.

17. A neckwear, comprising:

a neckband;

a neckband module;

at least two display segments including a first display segment and a second display segment;

a first fastener and a second fastener;

a first display insert comprising a first coin holder, coin capsule or bullion bar holder configured to contain a first coin, medal or bullion bar; and a second display insert comprising a second coin holder, coin capsule or bullion bar holder configured to contain a second coin, medal or bullion bar, a third display insert comprising a third coin holder, coin capsule or bullion bar holder configured to contain a third coin, medal or bullion bar, wherein said neckband directly connects to said neckband module, said neckband module directly connects to said first display segment; and said first display segment directly connects to said second display segment;

wherein said neckband module includes a compartment that is configured to house the first display insert;

wherein said first display segment includes a compartment that is configured to house the second display insert;

wherein said second display segment includes a compartment that is configured to house the third display insert;

wherein said first fastener pivotably and directly connects said neckband module to said first display segment; and wherein said second fastener pivotably and directly connects said first display segment to said second display segment.

18. The neckwear of claim 17, further comprising the first coin, medal or bullion bar; the second coin, medal or bullion bar; and the third coin, medal or bullion bar;

wherein the first coin holder, coin capsule or bullion bar holder contains the first coin, medal or bullion bar, the second coin holder, coin capsule or bullion bar holder contains the second coin, medal or bullion bar, and the third coin holder, coin capsule or bullion bar holder contains the third coin, medal or bullion bar.

19. The neckwear of claim 18, wherein the first coin, medal or bullion bar, the second coin, medal or bullion bar, and the third coin, medal or bullion bar are members of a set or series of coins, medals or bullion bars.

20. The neckwear of claim 17, wherein the first coin holder, coin capsule or bullion bar holder, the second coin holder, coin capsule or bullion bar holder, and the third coin holder, coin capsule or bullion bar holder are intra-changeable among one another.

21. The neckwear of claim 17, wherein the neckband module includes a closure.

22. The neckwear of claim 17, further comprising at least one segment that does not include a compartment that is configured to house a display insert.

23. A neckwear, comprising:

a neckband;

a neckband module;

at least two display segments including a first display segment and a second display segment;

a first fastener and a second fastener; and a first display insert comprising a first coin holder, coin capsule or bullion bar holder configured to contain a first coin, medal or bullion bar, a second display insert comprising a second coin holder, coin capsule or bullion bar holder configured to contain a second coin, medal or bullion bar, wherein said neckband directly connects to said neckband module, said neckband module directly connects to said first display segment, and said first display segment connects to said second display segment;

wherein said neckband module is not configured to house any display insert;

wherein said first display segment includes a compartment that is configured to house the first display insert;

wherein said second display segment includes a compartment that is configured to house the second display insert;

wherein said first fastener pivotably and directly connects said neckband module to said first display segment; and wherein said second fastener pivotably and directly connects said first display segment to said second display segment.

24. The neckwear of claim 23, wherein the first coin holder, coin capsule or bullion bar holder contains the first coin, medal or bullion bar, and the second coin holder, coin capsule or bullion bar holder contains the second coin, medal or bullion bar.

25. The neckwear of claim 24, wherein the first coin, medal or bullion bar and the second coin, medal or bullion bar are members of a set or series of coins, medals or bullion bars.

26. The neckwear of claim 23, wherein the first display segment and the second display segment are intra-changeable with one another.

* * * * *